United States Patent [19]

Ogawa et al.

[11] Patent Number: 4,857,449

[45] Date of Patent: Aug. 15, 1989

[54] SILVER HALIDE COLOR PHOTOGRAPHIC PHOTOSENSITIVE MATERIALS

[75] Inventors: Tadashi Ogawa; Osamu Takahashi, both of Kanagawa, Japan

[73] Assignee: Fuji Photo Film Co., Ltd., Kanagawa, Japan

[21] Appl. No.: 159,074

[22] Filed: Feb. 23, 1988

[30] Foreign Application Priority Data

Feb. 23, 1987 [JP] Japan ..... 62-39825
Jun. 26, 1987 [JP] Japan ..... 62-158948

[51] Int. Cl.[4] ..... G03C 7/26; G03C 7/32
[52] U.S. Cl. ..... 430/546; 430/550
[58] Field of Search ..... 430/546, 550, 567

[56] References Cited

U.S. PATENT DOCUMENTS 3,619,195 11/1971 Van Campen ..... 430/546
4,203,716 5/1980 Chen ..... 430/545
4,368,258 1/1983 Fujiwhara et al. ..... 430/546
4,745,047 5/1988 Asami et al. ..... 430/567

*Primary Examiner*—Richard L. Schilling

*Attorney, Agent, or Firm*—Sughrue, Mion, Zinn, Macpeak, and Seas

[57] ABSTRACT

A silver halide color photosensitive material comprising, on a support, at least one silver halide photographic emulsion layer comprising an emulsified dispersion of fine lipophilic particles comprising at least one type of oil-soluble coupler which is non-diffusible and which forms a dye by coupling with the oxidized form of a primary aromatic amine color developing agent and at least one type of high boiling point organic solvent, said emulsified dispersion of fine lipophilic particles comprises a dispersion obtained by emulsifying and dispersing a mixed solution which comprises at least one type of coupler, and at least one type of high boiling point organic solvent as mentioned above, and at least one type of homopolymer or copolymer which is water-insoluble and soluble in organic solvent, and which comprises at least one type of repeating unit which does not have acid groups on the main chain or on a side chain, and said silver halide emulsion comprises a monodispersed silver chloride, silver chlorobromide or silver bromide emulsion, containing essentially no silver iodide, and of which the (100) plane has, in the main, been enclosed.

25 Claims, No Drawings

SILVER HALIDE COLOR PHOTOGRAPHIC PHOTOSENSITIVE MATERIALS

BACKGROUND OF THE INVENTION

This invention relates to silver halide color photographic photosensitive materials, and more precisely to silver halide color photographic photosensitive materials of which the stability of the photographic sensitivity during manufacture and storage and of the colored image after processing are excellent.

The dye images of silver halide color photographic materials may be maintained under conditions in which they are exposed to light or kept in the dark for long periods of time and it is known that the image fades considerably whatever the conditions, depending on the wavelength and quantity of the light, or conditions such as the heat, humidity and oxygen, etc., to which it is exposed. In general, fading on exposure to light for long periods is known as light fading and fading which occurs in the dark is known as dark fading. In cases where a processed color photographic material is to be stored for a long period of time as a recording medium, it is desirable that the balance between the extent of fading of the yellow, magenta and cyan dye images should be preserved while suppressing as far as possible the extent of light fading and dark fading, while raising the light fastness and dark fastness of the colored image. However, the extent of light fading and dark fading of each of the yellow, magenta and cyan dye images differ and, on storing for long periods of time, the overall tricolor balance is destroyed. This is disadvantageous in that the image quality deteriorates both in terms of color reproduction and gradation.

The extent of light fading and dark fading differs depending on the couplers which have been used and various other factors but, with the dyes which have often been used in color photographic photosensitive materials in the past, the cyan dye image has been most liable to dark fading, followed by the yellow dye image and the magenta dye image. It is well known in the art that the extent of the dark fading of the cyan dye image is markedly greater than that of the other dye images.

Thus, the dark fading of the cyan dye image must be suppressed as much as possible if a good color balance is to be maintained over long periods of time when tricolor yellow, magenta and cyan fading occurs. Consequently, various attempts have been made in the past to provide improvements with respect to light fading and dark fading. These attempts can be broadly divided into two types. The first type involves the development of new couplers which form dye images which are less prone to fading while the second type has involved the development of new additives designed to prevent the occurrence of fading.

A great many phenolic type cyan couplers are known for the formation of cyan dyes. For example, the 2-(α-2,4-di-tert-amylphenoxybutanamido)-4,6-dichloro-5-methylphenol disclosed in U.S. Pat. No. 2,801,171, forms a colored dye which has good resistance to light, but it is also known to have poor heat resistance.

Moreover, couplers in which the 3- and 5-positions of the phenol are substituted with alkyl groups which have at least 2 carbon atoms are disclosed, for example, in Japanese Patent Publication No. 11572/74 and Japanese Patent Application (OPI) Nos. 209735/85 and 205447/85 (the term "OPI" as used herein refers to a "published unexamined Japanese patent application").

The dark fastness of the cyan images formed with these couplers is improved to a certain extent, but is still imperfect. Moreover, it is known that the light fading characteristics are worse than those obtained with the aforementioned cyan couplers.

Furthermore, 2,5-diacylaminophenol based cyan couplers, in which the 2- and 5- positions of the phenol are substituted with acylamino groups, are disclosed, for example, in U.S. Pat. Nos. 2,369,929, 2,772,162 and 2,895,826 and Japanese Patent Application (OPI) Nos. 112038/75, 109630/78 and 163537/80. The dark fastness of the cyan images formed with these 2,5-diacylaminophenol based couplers is very good, but the light fastness of the cyan images which are formed is worse than that obtained with the two types of cyan couplers referred to above. Furthermore, when these materials are used in photosensitive materials for obtaining prints, there is a further disadvantage in that the hue is biased slightly to the short wavelength side. This type of coupler has been used in the form of mixtures with cyan couplers of the two types mentioned above in order to overcome this problem, but this is known to have an adverse effect on the dark fastness.

In general, the 1-hydroxy-2-naphthamide type cyan couplers have inadequate light fastness.

Furthermore, the 1-hydroxy-2-acylaminocarbostyril cyan couplers disclosed in Japanese Patent Application (OPI) No. 104333/81 are fast to both light and heat. However, the spectral absorption characteristics of the colored images formed with these couplers are not preferred for color reproduction in color photography, and it has been discovered that these couplers also give rise to problems such as the formation of pink stains on irradiation with light, etc.

The cyan polymer couplers disclosed in U.S. Pat. No. 3,767,412 and Japanese Patent Application (OPI) Nos. 65844/84 and 39044/86, for example, have excellent dark fastness under low humidity conditions. However, they have been found to have inadequate dark fastness under conditions of high humidity.

Furthermore, methods in which hydrophobic substances such as oil soluble couplers, etc., are dissolved in organic solvents which are miscible with water and then mixed with a loadable polymer latex, so that the hydrophobic substances are loaded onto the polymer have been developed, are disclosed in U.S. Pat. No. 4,203,716, for example. However, when methods of this type involving the use of a loadable polymer latex are employed, problems arise with regard to a deterioration of the light fastness of the cyan image, particularly, when compared to cases in which water-immiscible high boiling point organic solvents are employed. Moreover, a large quantity of polymer must be used in order to carry a sufficient quantity of coupler and to obtain a satisfactory maximum color density.

This has been found to be disadvantageous both in terms of the cost of the photosensitive materials in which these materials are used and in view of the increase in film thickness. Photosensitive materials which contain emulsified dispersions of couplers in which homopolymers of hydrophobic monomers of a specified structure, or copolymers with hydrophilic monomers which have a specified structure, which are soluble in organic solvents are used in place of the high boiling point organic solvents with which the film properties, recoloring failure, light fading and storage properties before processing are improved, are disclosed in Japanese Patent Publication No. 30494/73. However, it has been found that when a homopolymer of a hydrophobic monomer, such as those referred to above, is used to replace a high boiling point organic solvent, the color forming ability is reduced, especially in developers which do not contain benzyl alcohol, and that the stability of the emulsified dispersion is poor during storage. On the other hand, copolymers of the aforementioned hydrophobic monomers with hydrophilic monomers, such as acrylic acid, improve the stability of the emulsified dispersion and also improve the color forming properties. However, the effect is totally inadequate. Moreover, it has been found that the dark fastness deteriorates, especially under conditions of high humidity, when the proportion of hydrophilic monomer in the copolymer is increased in order to improve the color forming properties.

Furthermore, when the method of Japanese Patent Publication No. 30494/73 is applied, especially in the case of a cyan coupler, there is a serious problem in that the light fastness is markedly worse than the case wherein a cyan coupler is emulsified and dispersed in a conventional high boiling point organic solvent.

Thus, in the past, all of the couplers of which dark fastness has been improved through modification of the coupler structure, have proven to be inadequate with respect to hue, color forming properties and staining. More particularly, these methods have proved to be inadequate with respect to light fastness. Therefore, a novel technique for overcoming all of these problems simultaneously is required.

Benzyl alcohol is widely used for improving color forming properties and reducing processing times in the color development of silver halide color photosensitive materials in which conventional oil protected type couplers have been used.

However, benzyl alcohol has low water solubility and solvents such as diethylene glycol, triethylene glycol or alkanolamines have therefore been required to facilitate the dissolution of the benzyl alcohol. These compounds, including benzyl alcohol, have a high BOD (biological oxygen demand) and COD (chemical oxygen demand) values, which indicate the extent of environmental pollution. Therefore, it is desirable from the point of view of environmental protection that these compounds not be used.

Moreover, when benzyl alcohol is used, there is still a disadvantage in that time is required to form a solution, even when the above-mentioned solvents are used.

Furthermore, if the benzyl alcohol is carried over into the bleach bath or bleach-fix bath, the leuco form of the cyan dye is readily formed, resulting in a lowering of the color density. Moreover, the wash-out rate of the developer components is retarded, and there are cases where this has an adverse effect on the image storing ability of the processed photosensitive material. Hence, it is also desirable that benzyl alcohol not be used from these points of view.

Accordingly, the development of couplers, and emulsified dispersions thereof, which provide improved image storage properties, and which have good color forming properties without the use of benzyl alcohol, is desirable.

On the other hand, it has been discovered that couplers or emulsified dispersions which have excellent color image fastness, such as those described earlier, often act on a silver halide emulsion in such a way as to affect the photographic speed. That is to say, it has been found that there is a lowering of color sensitized speed when the phenol based cyan couplers described earlier are used, and a similar desensitization is observed when certain types of magenta coupler or yellow coupler are used. It is desirable that any technique used for improving the fastness of the color image should not have any such action, and the development of emulsion technology in which such effects are unlikely to arise has been predicted.

Hence, the first aim of the invention is to provide silver halide color photographic photosensitive materials in which the light fastness and dark fastness are improved, and more precisely, with which it is possible to form color images which have excellent storage properties, even under conditions of high temperature and high humidity.

The second aim of the invention is to provide silver halide color photographic photosensitive materials which have a good balance between yellow, magenta and cyan color fading, and with which color reproduction does not deteriorate even on long term storage.

The third aim of the invention is to provide silver halide color photographic photosensitive materials with which a dye image having good color image storage properties can be formed without adverse effect on the photographic properties, and more precisely, without reducing the photographic sensitivity during the manufacture or storage of the photosensitive material.

The fourth aim of the invention is to provide silver halide color photographic photosensitive materials which have adequate color forming properties even when processed in color developers which are essentially benzyl alcohol free and which have excellent color image storage properties, consisting of coupler emulsified dispersions which have excellent stability.

The fifth aim of the invention is to provide silver halide color photosensitive materials in which, in terms of the fastness of the cyan dye image, the dark fastness is improved without degrading the light fastness.

SUMMARY OF THE INVENTION

As a result of extensive research, the inventors have discovered that the aforementioned aims can be realized with the following silver halide color photographic materials.

A silver halide color photosensitive material which comprising, on a support, at least one silver halide photographic emulsion layer comprising an emulsified dispersion of fine lipophilic particles comprising at least one type of oil-soluble coupler which is nondiffusible and which forms a dye by coupling with the oxidized form of a primary aromatic amine color developing agent and at least one type of high boiling point organic solvent, the aforementioned emulsified dispersion of fine lipophilic particles comprises a dispersion obtained by emulsifying and dispersing a mixed solution which comprises at least one type of coupler and at least one type of high boiling point organic solvent as mentioned above, and at least one type of homopolymer or copolymer which is water-insoluble and soluble in organic solvent and which comprises at least one type of repeating unit which does not have acid groups on the main chain or on a side chain, and the aforementioned silver halide emulsion comprises a monodispersed silver chloride, silver chlorobromide or silver bromide emulsion containing essentially no silver iodide, and of which the (100) plane has, in the main, been enclosed.

DETAILED DESCRIPTION OF THE INVENTION

The silver halide color photographic photosensitive materials of the present invention may be comprised of a repeating unit which does not have an acid group of the aforementioned polymer, but instead has a —CO— bond in its main chain or in a side chain, or a —COO— group in its main chain or in a side chain.

The silver halide color photographic photosensitive materials of the present invention may further comprise a repeating unit which does not have an acid group of the aforementioned polymer, but instead, has a

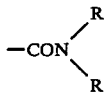

group (wherein R represents two substituent groups which may be the same or different, each of which may be a hydrogen atom or a substituted or unsubstituted alkyl group or aryl group) in a side chain.

The silver halide color photographic photosensitive materials as disclosed above may also be comprised of at least one phenol based cyan coupler, or a pyrazoloazole based coupler as the oil-soluble coupler.

The silver halide color photographic photosensitive materials of the present invention may comprise a silver halide emulsion which is spectrally sensitized, wherein the spectral sensitizing dye can be selected from among the monomethine, trimethine or pentamethine cyanine dyes.

The silver halide color photographic photosensitive materials of the present invention may further comprise the silver halide emulsion layer, which may contain at least two of the aforementioned monodispersed silver halide emulsions.

This invention is based upon the discovery that the desensitization of silver halide emulsions, which occurs in dispersions obtained by the emulsification and dispersion of a high boiling point organic solvent and a coupler, etc., in the presence of a surfactant, can be reduced by using an emulsified dispersion which contains certain polymers. The fact that the desensitization of the type mentioned above, and desensitization during the storage of the photosensitive material after coating, are markedly reduced in accordance with the habit of the silver halide crystal grains, only when these polymers are present, would have been difficult to predict.

In cases where the polymer, high boiling point organic solvent, and coupler which are introduced into the emulsified dispersion, interact in the way stated above with the silver halide emulsion, and the color image fastness is improved by the polymer, the fact that the use of a specified silver halide emulsion would also bring about an improvement in the sensitivity and storage properties was completely unknown in view of conventional techniques.

For example, there is no mention of any such specific requirements for the silver halide emulsions in the aforementioned U.S. Pat. No. 4,203,716, in which disclosures concerning latex dispersion are made.

Furthermore, only the preferred dispersing agents are mentioned in Japanese Patent Publication No. 30494/73, in which polymer dispersions are disclosed, and there is no mention of any requirement for a preferred emulsion.

Moreover, although the use of red-sensitive silver chlorobromide gelatin emulsions, green-sensitive silver chlorobromide gelatin emulsions and blue-sensitive silver chlorobromide gelatin emulsions is mentioned in the examples of Japanese Patent Publication No. 30494/73, there is no mention at all of any further effective requirements. Furthermore, it is stated in the specification of the Japanese Patent Publication above that coated materials which contain polymers had no effect on the characteristics in sensitivity measurements, and that there wa a rise in the relative sensitivity of the coated material when some of the gelatin was replaced by a non-gelatin hydrophilic colloidal binding agent, but this effect is produced by a difference in permeation by the developer, etc., and is different from the phenomena which contribute to the color sensitization of the type which is the question at issue in this invention. Moreover, there is no mention of the actual spectral sensitizing agents used or of the characteristics of the silver halide emulsion, other than to say that it is a silver chlorobromide in the specification of the Japanese Patent Publication above.

Moreover, no mention is made of these facts in Japanese Patent Application (OPI) Nos. 25133/76, 140344/85 or 151636/85.

In the aforementioned disclosures, an acid group designates the residual part obtained when the hydrogen atom which can be replaced by a metal is removed from a molecule of the acid and corresponds to the anionic part of a salt.

Furthermore, a repeating unit which has no acid groups signifies a repeating unit which has, for example, no carboxylic acid, sulfonic acid or phenol, which has at least one electron withdrawing group in a position ortho or para to the hydroxyl group and which has a pKa of less than about 10. Naphthol, an active methylene group or salts thereof are examples of such a repeating unit. Hence, the coupler structure can be regarded here as an acid group.

Cyan couplers which are oil-soluble and which are nondiffusible, as mentioned above, are represented by formula (I) or formula (II) as set forth below, which are especially desirable in this invention.

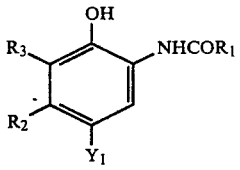

(I)

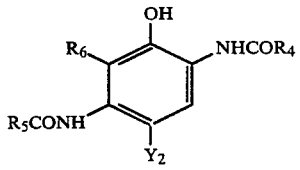

(II)

In these formulae, $R_1$, $R_4$ and $R_5$ each represents an aliphatic group, an aromatic group, a heterocyclic group, an aromatic amino group or a heterocyclic amino group. $R_2$ represents an aliphatic group. $R_3$ and $R_6$ each represents a hydrogen atom, a halogen atom, an aliphatic group, an aliphatic oxy group or an acylamino group. Here, the term "aliphatic group" signified a linear chain, branched chain or cyclic alkyl group, alkenyl group or alkynyl group.

Furthermore, $R_2$ and $R_3$, or $R_5$ and $R_6$, may be joined together to form 5-, 6- or 7-membered rings, becoming condensed rings such as a carbostyril, oxyindole, etc.

Moreover, oligomers in the form of dimers or above may be formed, via $R_1$, $R_2$, $R_3$ or $Y_1$, or $R_4$, $R_5$, $R_6$ or $Y_2$.

In formulae (I) and (II), $Y_1$ and $Y_2$ represent hydrogen atoms or groups which can be eliminated after the coupling reaction of the oxidation products of the color developing agent.

The aforementioned high boiling point organic solvent is preferably selected from among those compounds which can be represented by formulae (III), (IV), (V), (VI), (VII) or (VIII) set forth below.

In these formulae, $W_1$, $W_2$ and $W_3$ each represents a substituted or unsubstituted alkyl group, cycloalkyl group, alkenyl group, aryl group or heterocyclic group. $W_4$ represents a $W_1$, O—$W_1$ or an S—$W_1$ group. In these formulae, n is an integer from 1 to 5, and when n is 2 or more, the $W_4$ groups may be the same or different. In formula (VII), $W_1$ and $W_2$ may be joined together to form a condensed ring.

In these formulae, $W_6$ represents a substituted or unsubstituted alkyl group or aryl group, wherein the total number of carbon atoms in $W_6$ is at last 12.

The silver halide color photographic photosensitive materials of this invention are preferably exposed and then developed in an essentially benzyl alcohol free color developer.

Here, an essentially benzyl alcohol free color developer signifies a color developer in which the concentration of benzyl alcohol is not more than 0.5 cc/liter. A developer which does not contain any benzyl alcohol is preferred.

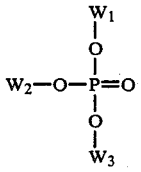
(III)

$W_1$—COOW$_2$ (IV)

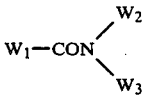
(V)

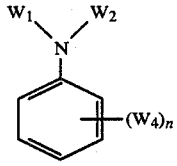
(VI)

$W_1$—O—$W_2$ (VII)

HO—$W_6$ (VIII)

Any polymer can be used in the invention, provided that it is water-insoluble, soluble in organic solvents and consists of at least one type of repeating unit which does not have acid groups on the main chain or on a side chain. However, polymers of which the repeating unit has a —CO— bond are preferred from the point of view of the fastness of the colored image. On the other hand, when a polymer consisting of monomers which have acid groups, such as those disclosed, for example, on page 24 et seq. of Japanese Patent Application (OPI) No. 65236/80 is used, there is often a marked decline in the improving effect on the colored image fastness. This is undesirable. However, they can be used in small quantities, where there is not too much reduction of the improving effect. Actual examples of polymers which can be used in the invention are described below, but the polymers of the invention are understood not to be limited to these examples.

(A) Vinyl Polymers

Acrylic Acid Esters: for example, methyl acrylate, ethyl acrylate, n-propyl acrylate, isopropyl acrylate, n-butyl acrylate, isobutyl acrylate, sec-butyl acrylate, tert-butyl acrylate, amyl acrylate, hexyl acrylate, 2-ethylhexyl acrylate, octyl acrylate, tertoctyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxy acrylate, 2-butoxyethyl acrylate, 2-(2-methoxyethoxy)ethyl acrylate, 2-(2-butoxyethoxy)ethyl acrylate, ω-methoxypolyethylene glycol acrylate (addition mol number n=9), 1-bromo-2-methoxyethyl acrylate and 1,1-dichloro-2-ethoxyethyl acrylate, etc., are typical of the monomers from which the vinyl polymers of this invention are formed. Apart from these, polymers obtained using the monomers indicated below can also be used.

Methacrylic Acid Esters: actual examples include methyl methacrylate, ethyl methacrylate, n-propyl methacrylate, isopropyl methacrylate, n-butyl methacrylate, isobutyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxy polyethylene glycol methacrylate (addition mol number n=6), allyl methacrylate, methacrylic acid dimethylaminoethylmethyl chloride salt, etc.

Vinyl Esters: actual examples include vinyl acetate, vinyl propionate, vinyl butyrate, vinyl isobutyrate, vinyl caproate, vinyl chloroacetate, vinyl methoxyacetate, vinyl phenylacetate, vinyl benzoate, vinyl salicylate, etc.

Acrylamides: for example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide, diacetonacrylamide, etc.

Methacrylamides: for example, methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, N-(2-acetoacetoxyethyl)methacrylamide, etc.

Olefins: for example, dicyclopentadiene, ethylene, propylene, 1-butene, 1-pentene, vinyl chloride, vinylidene chloride, isoprene, chloroprene, butadiene, 2,3-dimethylbutadiene, etc.; styrenes: for example, styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, bromostyrene, vinyl benzoic acid methyl ester, etc.

Vinyl Ethers: for example, methyl vinyl ether, butyl vinyl ether, hexyl vinyl ether, methoxyethyl vinyl ether, dimethylaminoethyl vinyl ether, etc.

Others: for example, butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, vinylidene chloride, methylene malonitrile, vinylidene, etc.

The monomers used in the polymers of this invention (for example, the monomers mentioned above) can also be formed into copolymers using two or more monomers for various purposes, for example, such as improving coupler solubility. Furthermore, monomers which have acid groups, such as those indicated as examples below, can also be used as comonomers in the range where the copolymer does not become water-soluble, in order to improve the color forming and dissolution properties of the silver halide color photosensitive materials.

Acrylic acid; methacrylic acid; itaconic acid; maleic acid; monoalkyl itaconates, for example, monomethyl itaconate, monoethyl itaconate, monobutyl itaconate, etc.; monoalkyl maleates, for example, monomethyl maleate, monoethyl maleate, monobutyl maleate, etc.; citraconic acid; styrene sulfonic acid; vinylbenzyl sulfonic acid; vinyl sulfonic acid; acryloyloxyalkyl sulfonic acid, for example, acryloyloxymethyl sulfonic acid, acryloyloxyethyl sulfonic acid, acryloyloxypropyl sulfonic acid, etc.; methacryloyloxyalkyl sulfonic acids, for example, methacryloyloxymethyl sulfonic acid, methacryloyloxyethyl sulfonic acid, methacryloyloxypropyl sulfonic acid, etc.; acrylamidoalkyl sulfonic acids, for example, 2-acrylamido-2-methylethane sulfonic acid, 2-acrylamido-2-methylpropane sulfonic acid, 2-acrylamido-2-methylbutane sulfonic acid, etc.; methacrylamidoalkyl sulfonic acids, for example, 2-methacrylamido-2-methylethane sulfonic acid, 2-methacrylamido-2-methylpropane sulfonic acid, 2-methacrylamido-2-methylbutane sulfonic acid, etc.; and alkali metal (for example, Na, K, etc.) or ammonium ion salts of these acids.

When the vinyl monomers indicated above and the hydrophilic monomers from among the other vinyl monomers which can be used in the invention (there are water-soluble when formed into homopolymers) are used as comonomers, no particular limitation is imposed on the proportion of the hydrophilic monomer which is included in the copolymer, provided that the copolymer does not become soluble in water. However, preferably the proportion of the water-soluble monomer is normally not more than 40 mol %, and more preferably not more than 20 mol %, and most preferably not more than 10 mol %. Furthermore, when the hydrophilic comonomers which are copolymerized with the monomers of this invention have acid groups, the proportion of the comonomer which has acid groups in the copolymer is normally not more than 20 mol %, and preferably not more than 10 mol %, and most preferably none of this type of comonomer is included.

The methacrylate based monomers, acrylamide based monomers and methacrylamide based monomers are preferred for the polymers of this invention.

(B) Polyester Resins Obtained by Condensing Polyhydric Alcohols with Polybasic Acids:

Glycols or polyalkylene glycols which have the structure HO-$R_1$-OH (wherein $R_1$ is a hydrocarbon chain, especially an aliphatic hydrocarbon chain, with from 2 to about 12 carbon atoms) are effective as the polyhydric alcohols, and acids which have the structure HOOC-$R_2$-COOH (where $R_2$ represents a single bond or a hydrocarbon chain with from 1 to about 12 carbon atoms) are effective as polybasic acids.

Actual examples of polyhydric alcohols include ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13tridecanediol, 1,4-diol, glycerine, diglycerine, triglycerine, 1-methylglycerine, erythritol, mannitol, sorbitol, etc.

Actual examples of polybasic acids include oxalic acid, succinic acid, glutaric acid, adipic acid, pimelic acid, suberic acid, azelaic acid, sebacic acid, nonane dicarboxylic acid, decane dicarboxylic acid, undecane dicarboxylic acid, dodecane dicarboxylic acid, fumaric acid, maleic acid, itaconic acid, citraconic acid, phthalic acid, isophthalic acid, terephthalic acid, tetrachlorophthalic acid, metaconic acid, isopimelic acid, cyclopentadiene-maleic anhydride adduct, rosin-maleic anhydride adduct, etc.

(C) Others

For example, polyesters obtained by ring opening polymerization of the type indicated below:

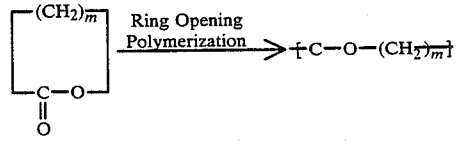

In this formula, m represents an integer of value 4 to 7. The —$CH_2$— chain may be branched.

β-Propiolactone, ε-caprolactone, dimethylpropiolactone, etc., are appropriate monomers for the formation of these polyesters.

If the molecular weight and degree of polymerization of the polymers of this invention exceed about 2,000, it will not have any major effect in practice on the effect of this invention. However, if the molecular weight is too high, a longer time is required to dissolve the polymer in the high boiling point organic solvent or auxiliary solvent, and emulsification and dispersion become more difficult because of the increased viscosity of the solution. Accordingly, problems are liable to arise, such as the formation of large grains and a worsening of color forming properties. Hence, the molecular weight of the polymers which can be used in the invention is preferably not more than 1,000,000 and at least 2,000, more preferably not more than 400,000 and at least 5,000, and most preferably not more than 150,000 and at least 10,000.

The ratio of polymer to auxiliary solvent employed when preparing an emulsified dispersion containing a polymer of this invention differs according to the type of polymer which is being used, and can vary across a wide range depending on the solubility of the polymer in the auxiliary solvent and the degree of polymerization, etc., and on the solubility of the coupler, etc. Normally, at least three items, namely, a coupler, a high boiling point organic solvent and a polymer, are dissolved in the auxiliary organic solvent. The quantity of auxiliary organic solvent required to reduce the viscosity sufficiently and facilitate the dispersion of the solution in water or aqueous hydrophilic colloid solution is used. The viscosity of the above-mentioned solution rises as the degree of polymerization of the polymer increases, and so it is therefore difficult to formulate a rule for relating the proportions of auxiliary organic solvent and polymer irrespective of the polymer, the coupler and high boiling point organic solvent which are also present, but normally a ratio within the range from about 1/0.2 to 1/50 by weight is preferred.

The polymers or copolymers of this invention may be used individually or in the form of mixtures of two or more, and, moreover, mixtures with other polymers than the polymers of the invention mixed within a range such that the effect of the invention is not lost, can also be used. Different polymers may be used in different layers in the photosensitive material.

Actual examples of polymers which can be used in the invention are indicated below, but the invention is understood not to be limited by these examples.

(P- 1): Poly(vinyl acetate)
(P- 2): Poly(vinyl propionate)
(P- 3): Poly(methyl methacrylate)
(P- 4): Poly(ethyl methacrylate)
(P- 5): Poly(ethyl acrylate)
(P- 6): Poly(heptyl acrylate)
(P- 7): Poly(butyl acrylate)
(P- 8): Poly(butyl methacrylate)
(P- 9): Poly(isobutyl methacrylate)
(P- 10): Poly(isopropyl methacrylate)
(P- 11): Poly(octyl acrylate)
(P- 12): Poly(hexadecyl acrylate)
(P- 13): Poly(hexyl acrylate)
(P- 14): Poly(isobutyl acrylate)
(P- 15): Poly(isopropyl acrylate)
(P- 16): Poly(3-methoxybutyl acrylate)
(P- 17): Poly(2-methoxycarbonylphenyl acrylate)
(P- 18): Poly(3-methoxycarbonylphenyl acrylate)
(P- 19): Poly(4-methoxycarbonylphenyl acrylate)
(P- 20): Poly(2-methoxyethyl acrylate)
(P- 21): Poly(4-methoxyphenyl acrylate)
(P- 22): Poly(3-methoxypropyl acrylate)
(P- 23): Poly(methyl acrylate)
(P- 24): Poly(3,5-dimethyladamantyl acrylate)
(P- 25): Poly(3-dimethylaminophenyl acrylate)
(P- 26): Poly(2-cyanomethylphenyl methacrylate)
(P- 27): Poly(4-cyanophenyl methacrylate)
(P- 28): Poly(decyl methacrylate)
(P- 29): Poly(dodecyl methacrylate)
(P- 30): Poly(diehylaminoethyl methacrylate)
(P- 31): Poly(ethyl methacrylate)
(P- 32): Poly(2-ethylsulfinylethyl methacrylate)
(P- 33): Poly(hexadecyl methacrylate)
(P- 34): Poly(hexyl methacrylate)
(P- 35): Poly(2-hydroxypropyl methacrylate)
(P- 36): Poly(4-methoxycarbonylphenyl methacrylate)
(P- 37): Poly(3,5-dimethyladamantyl methacrylate)
(P- 38): Poly(dimethylaminoethyl methacrylate)
(P- 39): Poly(3,3-dimethylbutyl methacrylate)
(P- 40): Poly(3,3-dimethyl-2-butyl methacrylate)
(P- 41): Poly(3,5,5-trimethylhexyl methacrylate)
(P- 42): Poly(octadecyl methacrylate)
(P- 43): Poly(tetradecyl methacrylate)
(P- 44): Poly(pentyl acrylate)
(P- 45): Poly(4-butoxycarbonylphenyl methacrylate)
(P- 46): Poly(pentyl methacrylate)
(P- 47): Poly(4-carboxyphenyl methacrylate)
(P- 48): Poly(4-ethoxycarbonylphenyl methacrylate)
(P- 49): Poly(4-methoxycarbonylphenyl methacrylate)
(P- 50): Poly(butylbutoxycarbonyl methacrylate)
(P- 51): Poly(butyl chloroacrylate)
(P- 52): Poly(butyl cyanoacrylate)
(P- 53): Poly(cyclohexyl chloroacrylate)
(P- 54): Poly(ethyl chloroacrylate)
(P- 55): Poly(ethylethoxycarbonyl methacrylate)
(P- 56): Poly(N-sec-butylacrylamide)
(P- 57): Poly(N-tert-butylacrylamide)
(P- 58): Poly(ethyl ethacrylate)
(P- 59): Poly(cyclohexyl methacrylate)
(P- 60): Poly(ethyl fluoromethacrylate)
(P- 61): Poly(hexylhexyloxycarbonyl methacrylate)
(P- 62): Poly(tert-butyl methacrylate)
(P- 63): Poly(isobutyl chloroacrylate)
(P- 64): Poly(N-tert-butylmethacrylamide)
(P- 65): Poly(isopropyl chloroacrylate)
(P- 66): Poly(methyl chloroacrylate)
(P- 67): Poly(methyl fluoroacrylate)
(P- 68): Poly(methyl fluoromethacrylate)
(P- 69): Poly(methylphenyl acrylate)
(P- 70): Poly(benzyl acrylate)
(P- 71): Poly(4-biphenyl acrylate)
(P- 72): Poly(4-butoxycarbonylphenyl acrylate)
(P- 73): Poly(sec-butyl acrylate)
(P- 74): Poly(tert-butyl acrylate)
(P- 75): Poly(2-tert-butylphenyl acrylate)
(P- 76): Poly(4-tert-butylphenyl acrylate)
(P- 77): Poly[3-chloro-2,2-bis(chloromethyl)propyl acrylate]
(P- 78): Poly(2-chlorophenyl acrylate)
(P- 79): Poly(4-chlorophenyl acrylate)
(P- 80): Poly(pentachlorophenyl acrylate)
(P- 81): Poly(4-cyanobenzyl acrylate)
(P- 82): Poly(cyanoethyl acrylate)
(P- 83): Poly(4-cyanophenyl acrylate)

(P- 84): Poly(4-cyano-3-butyl acrylate)
(P- 85): Poly(cyclohexyl acrylate)
(P- 86): Poly(2-ethoxycarbonylphenyl acrylate)
(P- 87): Poly(3-ethoxycarbonylphenyl acrylate)
(P- 88): Poly(4-ethoxycarbonylphenyl acrylate)
(P- 89): Poly(2-ethoxyethyl acrylate)
(P- 90): Poly(3-ethoxypropyl acrylate)
(P- 91): Poly(1H,1H,5H-octafluoropentyl acrylate)
(P- 92): Poly(propyl chloroacrylate)
(P- 93): Poly(2-methylbutyl acrylate)
(P- 94): Poly(3-methylbutyl acrylate)
(P- 95): Poly(1,3-dimethylbutyl acrylate)
(P- 96): Poly(2-methylpentyl acrylate)
(P- 97): Poly(2-naphthyl acrylate)
(P- 98) Poly(phenyl acrylate)
(P- 99) Poly(propyl acrylate)
(P-100): Poly(m-tolyl acrylate)
(P-101): Poly(o-tolyl acrylate)
(P-102): Poly(p-tolyl acrylate)
(P-103): Poly(N-butylacrylamide)
(P-104): Poly(N,N-dibutylacrylamide)
(P-105): Poly(N-isohexylacrylamide)
(P-106): Poly(N-isooctylacrylamide)
(P-107): Poly(N-methyl-N-phenylacrylamide)
(P-108): Poly(adamantyl methacrylate)
(P-109): Poly(benzyl methacrylate)
(P-110): Poly(2-bromoethyl methacrylate)
(P-111): Poly(2-N-tert-butylaminoethyl methacrylate)
(P-112): Poly(sec-butyl methacrylate)
(P-113): Poly(2-chloroethyl methacrylate)
(P-114): Poly(2-cyanoethyl methacrylate)
(P-115): 1,4-Butanediol-adipic acid polyester (P-116): Ethylene glycol-sebacic acid polyester
(P-117): Polycaprolactone
(P-118): Polypropiolactone
(P-119): Polydimethylpropionlactone
(P-120): Vinyl acetate-vinyl alcohol copolymer (95/5) (by mol, hereinafter the same)
(P-121): Butyl acrylate-acrylamide copolymer (95/5)
(P-122): Stearyl methacrylate-acrylic acid copolymer (90/10)
(P-123): Butyl methacrylate-N-vinyl-2-pyrrolidone copolymer (90/10)
(P-124): Methyl methacrylate-vinyl chloride copolymer (70/30)
(P-125): Methyl methacrylate-styrene copolymer (90/10)
(P-126): Methyl methacrylate-ethyl acrylate copolymer (50/50)
(P-127): Butyl methacrylate-methyl methacrylate-styrene copolymer (50/30/20)
(P-128): Vinyl acetate-acrylamide copolymer (85:15)
(P-129): Vinyl chloride-vinyl acetate copolymer (65/35)
(P-130): Methyl methacrylate-acrylonitrile copolymer (65/35)
(P-131): Diacetonacrylamide-methyl methacrylate copolymer (50/50)
(P-132): Methyl vinyl ketone-isobutyl methacrylate copolymer (55/45)
(P-133): Ethyl methacrylate-butyl acrylate (70/30)
(P-134): Diacetonacrylamide-butyl acrylate copolymer (60/40)
(P-135): Methyl methacrylate-styrene methyl methacrylate-diacetonacrylamide copolymer (40/40/20)
(P-136): Butyl acrylate-styrene methacrylate-diacetonacrylamide copolymer (70/20/10)
(P-137): Stearyl methacrylate-methyl methacrylate-acrylic acid copolymer (50/40/10)
(P-138): Methyl methacrylate-styrene-vinyl sulfonamide copolymer (70/20/10)
(P-139): Methyl methacrylate-phenyl vinyl ketone copolymer (70/30)
(P-140): Butyl acrylate-methyl methacrylate-butyl methacrylate copolymer (35/35/30)
(P-141): Butyl methacrylate-pentyl methacrylate-N-vinyl-2-pyrrolidone copolymer (38/38/24)
(P-142): Methyl methacrylate-butyl methacrylate-isobutyl methacrylate-acrylic acid copolymer (37/29/25/9)
(P-143): Butyl methacrylate-acrylic acid copolymer (95/5)
(P-144): Methyl methacrylate-acrylic acid copolymer (95/5)
(P-145): Benzyl methacrylate-acrylic acid copolymer (90/10)
(P-146): Butyl methacrylate-methyl methacrylate-benzyl methacrylate-acrylic acid copolymer (35/35/25/5)
(P-147): Butyl methacrylate-methyl methacrylate-benzyl methacrylate copolymer (35/30/35)
(P-148): Cyclohexyl methacrylate-methyl methacrylate-propyl methacrylate copolymer (37/29/34)
(P-149): Methyl methacrylate-butyl methacrylate copolymer (65/35)
(P-150): Vinyl acetate-vinyl propionate copolymer (75/25)
(P-151): Butyl methacrylate-3-acryloxybutane-1-sulfonic acid, sodium salt, copolymer (97/3)
(P-152): Butyl methacrylate-methyl methacrylate-acrylamide copolymer (35/35/30)
(P-153): Butyl methacrylate-methyl methacrylate-vinyl chloride copolymer (37/36/27)
(P-154): Butyl methacrylate-styrene copolymer (90/10)
(P-155): Methyl methacrylate-N-vinyl-2-pyrrolidone copolymer (90/10)
(P-156): Butyl methacrylate-vinyl chloride copolymer (90/10)
(P-157): Butyl methacrylate-styrene copolymer (70/30)
(P-158): Diacetonacrylamide-methyl methacrylate copolymer (62/38)
(P-159): N-tert-Butylacrylamide-methyl methacrylate copolymer (40/60)
(P-160): tert-Butyl methacrylate-methyl methacrylate copolymer (70/30)
(P-161): N-tert-Butylacrylamide-methylphenyl methacrylate copolymer (60/40)
(P-162): Methyl methacrylate-acrylonitrile copolymer (70/30)
(P-163): Methyl methacrylate-methyl vinyl ketone copolymer (38/72)
(P-164): Methyl methacrylate-styrene copolymer (75/25)
(P-165): Methyl methacrylate-hexyl methacrylate copolymer (70/30)
(P-166): N-Methyl-N-benzylacrylamide-butyl acrylate-dibutyl fumarate copolymer (55/35/10)
(P-167): Poly[N-(1,1-dimethyl-3-oxobutyl)acrylamide]
(P-168): Poly(N-octylmethacrylamide)
(P-169): N,N-Diethylacrylamide-butyl acrylate copolymer (40/60)
(P-170): N,N-Diethylacrylamide-2-butoxyethyl acrylate copolymer (65/35)
(P-171): N-tert-Butylacrylamide-butyl acrylate copolymer (60/40)

(P-172): N-tert-Octylacrylamide-2-ethylhexyl acrylate copolymer (65/35)
(P-173): N,N-Dibutylacrylamide-dibutyl maleate copolymer (75/25)
(P-174): N-(1,1 -Dimethyl-3-oxobutyl)acrylamide-butyl acrylate copolymer (55/45)
(P-175): N-(1,1-Dimethyl-3-oxobutyl)acrylamide-butyl acrylate copolymer (70/30)
(P-176): N-tert-Butylacrylamide-butyl acrylate copolymer (45/55)
(P-177): N-Octyl-N-ethylacrylamide-ethyl acrylate copolymer (45/55)
(P-178): N-Butylmethacrylamide-2-ethylhexyl acrylate copolymer (90/10)
(P-179): N,N-Dibutylmethacrylamide-propyl acrylate copolymer (80/20)
(P-180): N-(2-Phenylethyl)acrylamide-butyl acrylate copolymer (25/75)
(P-181): N-Acryloylmorpholine-2-ethoxyethyl acrylate copolymer (40/60)
(P-182): N-Methyl-N'-acryloylpiperazine-butyl acrylate copolymer (15/85)
(P-183): N-Acryloylpiperidine-2-butoxyethyl acrylate copolymer (40/60)
(P-184): N-(1,1-Dimethyl-3-hydroxybutl)acrylamide-2-ethylhexyl methacrylate copolymer (75/25)
(P-185): N-Acryloylpiperidine-butyl acrylate copolymer (50/50)
(P-186): N-(p-Hydroxyphenyl)acrylamide-butyl acrylate copolymer (25/75)
(P-187): N-[3-(Dimethylamino)propyl]acrylamide-butyl acrylate copolymer (35/65)
(P-188): N-Methyl-N'-methacryloylpiperazine-2-ethoxyethyl acrylate copolymer (40/60)
(P-189): 2,6-Dimethyl-4-methacryloylmorpholine-butyl acrylate copolymer (55/45)
(P-190): N-tert-Butylacrylamide-butyl acrylate-2-ethoxyethyl acrylate copolymer (55/25/20)
(P-191): N-(1,1-Dimethyl-3-oxobutyl)acrylamide-butyl acrylate-N,N-diethylacrylamide copolymer (30/50/20)
(P-192): N-Methyl-N'-methacryloylpiperazine-2-ethoxybutyl acrylate-ethyl acrylate copolymer (30/40/30)
(P-193): 1,6-Hexanediol-ascorbic acid-sebacic acid polyester
(P-194): Diethylene glycol-adipic acid polyester
(P-195): Trimethylolpropane-adipic acid-phthalic acid polyester
(P-196): Diethylene glycol-trimethylolpropane-adipic acid polyester
(P-197): Ethylene glycol-adipic acid polyester
(P-198): Ethylene glycol-1,4-butanediol-adipic acid polyester
(P-199): 1,4-Bis(β-hydroxyethoxy)benzene-sebacic acid polyester
(P-200): Ethylene glycol-azelaic acid polyester The oil-soluble couplers of the present invention which have been rendered nondiffusible are described in detail below.

The oil-soluble couplers which have been rendered nondiffusible are couplers which are soluble in the high boiling point solvents which will be described later, and which have been rendered non-diffusible in such a way that they are able to diffuse only with difficulty within a photographic photosensitive material. The following methods can be used in order to render the couplers nondiffusible.

Firstly, there are methods in which one or more so-called diffusion resistant groups, which contain as part of their structure aliphatic groups, aromatic groups or heterocyclic groups and which have a molecular weight above a certain level, are introduced into the coupler molecule. The total number of carbon atoms in the diffusion resistant group is normally preferably at least 6, and more preferably at least 12. It is also possible to link two coupler molecules together by means of a diffusion resistant group of some type. The molecular weight of these couplers is preferably 250 to 2,000 per molecule of coupler, and more preferably 300 to 1,500 per molecule of coupler. Secondly, there are methods in which the couplers are formed into polymer couplers as oligomers and rendered nondiffusible by increasing the molecular weight in this way.

Cyan couplers which can be used in the invention are described below.

The groups which can be eliminated and which are represented by $Y_1$ and $Y_2$ in formulae (I) and (II) may be, for example, halogen atoms (fluorine atoms, chlorine atoms, bromine atoms), sulfo groups, alkoxy groups, acyloxy groups, aryloxy groups, heterocyclic oxy groups, alkylthio groups, arylthio groups or heterocyclic thio groups, etc.

$R_1$, $R_4$ and $R_5$ each represents an aliphatic group which preferably has 1 to 36 carbon atoms, an aromatic group which preferably has from 6 to 36 carbon atoms (for example, a phenyl group or a naphthyl group, etc.), a heterocyclic group (for example, a 3-pyridyl group, a 2-furyl group, etc.) or an aromatic or heterocyclic amino group (for example, an anilino group, a naphthylamino group, a 2-benzothiazolylamino group, a 2-pyridylamino group, etc.). These groups may be substituted with groups selected from alkyl groups, aryl groups, heterocyclic groups, alkoxy groups (for example, methoxy groups, 2-methoxyethoxy groups, etc.), aryloxy groups (for example, 2,4-di-tert-amylphenoxy groups, 2-chlorophenoxy groups, 4-cyanophenoxy groups, etc.), alkenyloxy groups (for example, 2-propenyloxy groups, etc.), acyl groups (for example, acetyl groups, benzoyl groups, etc.), ester groups (for example, butoxycarbonyl groups, phenoxycarbonyl groups, acetoxy groups, benzoyloxy groups, butoxysulfonyl groups, toluenesulfonyloxy groups, etc.), amido groups (for example, acetylamido groups, ethylcarbamoyl groups, dimethylcarbamoyl groups, methanesulfonamido groups, butylsulfamoyl groups, etc.), sulfamido groups (for example, dipropylsulfamoylamino groups, etc.), imido groups (for example, succinimido groups, hydantoinyl groups, etc.), uredio groups (for example, phenylureido groups, dimethylureido groups, etc.), aliphatic or aromatic sulfonyl groups (for example, methanesulfonyl groups, phenylsulfonyl groups, etc.), aliphatic or aromatic thio groups (for example, ethylthio groups, phenylthio groups, etc.), hydroxyl groups, cyano groups, carboxyl groups, nitro groups, sulfo groups, halogen atoms, etc.

In this specification the term "aliphatic group" signifies a linear chain, branched chain or cyclic aliphatic hydrocarbyl group, including saturated and unsaturated groups such as alkyl groups, alkenyl groups, alkynyl groups, etc. Typical examples of these groups include methyl groups, ethyl groups, butyl groups, dodecyl groups, octadecyl groups, icosenyl groups, isopropyl groups, tert-butyl groups, tert-octyl groups, tert-dodecyl groups, cyclohexyl groups, cyclopentyl groups, allyl groups, vinyl groups, 2-hexadecenyl groups, propargyl groups, etc.

In formula (I), $R_2$ is preferably an aliphatic group which has 1 to 20 carbon atoms, which may be substituted with the substituent groups permitted on $R_1$.

$R_3$ and $R_6$ in formulae (I) and (II) each represents a hydrogen atom, a halogen atom (for example, a fluorine atom, a chlorine atom, a bromine atom, etc.), an aliphatic group which preferably has 1 to 20 carbon atoms, an aliphatic oxy group which preferably has 1 to 20 carbon atoms, or an acylamino group which preferably has 1 to 20 carbon atoms (for example, an acetamido group, a benzamido group, a tetradecanamido group, etc.). These aliphatic groups, aliphatic oxy groups and acylamino groups may further be substituted with the substituent groups permitted on $R_1$.

$R_2$ and $R_3$ in formula (I) may be joined together to form a 5- to 7-membered ring.

$R_5$ and $R_6$ in formula (II) may be joined together to form a 5- to 7-membered ring.

Oligo-couplers in the form of dimers or oligomers may be formed via any one of the groups $R_1$, $R_2$, $R_3$ or $Y_1$ in formula (I) or any one of the groups $R_4$, $R_5$, $R_6$ or $Y_2$ in formula (II), either independently or conjointly. In the case of a dimer, these groups may be simple bonds or divalent linking groups (for example, divalent groups, such as alkylene groups, arylene groups, ether groups, ester groups, amido groups and divalent groups consisting of combinations of these groups, etc.). In the case of oligomer formation, these groups may take the form of the main chain of a polymer, but they are preferably linked into a main polymer chain via the difunctional groups described for dimers. When a polymer is formed, it may take the form of a homopolymer of the coupler derivative or it may take the form of a copolymer, including one or more non-color forming ethylenic monomers (for example, acrylic acid, methacrylic acid, n-butylacrylamide, $\beta$-hydroxy methacrylate, vinyl acetate, acrylonitrile, styrene, crotonic acid, maleic anhydride, N-vinylpyrrolidone, etc.).

Substituted or unsubstituted alkyl groups and aryl groups are preferred for $R_1$ in formula (I) and for $R_5$ in formula (II). Phenoxy groups, which may be substituted, and halogen atoms, are especially desirable as substituent groups on the alkyl groups (moreover, alkyl groups, alkoxy groups, halogen atoms, sulfonamido groups and sulfamido groups are preferred as substituent groups on the phenoxy groups). Phenyl groups which have been substituted with at least one halogen atom, alkyl group, sulfonamido group or acylamino group are preferred aryl groups.

The preferred $R_4$ group in formula (II) is a substituted alkyl group or a substituted or unsubstituted aryl group. Halogen atoms are preferred substituents on the alkyl groups, while the preferred aryl groups are a phenyl group or a phenyl group which has at least one halogen atom or sulfonamido group as a substituent.

The preferred $R_2$ in formula (I) is an alkyl group of 1 to 20 carbon atoms, which may be substituted. Alkyl or aryl oxy groups, acylamino groups, alkyl or aryl thio groups, imido groups, ureido groups and alkyl or aryl sulfonyl groups are the preferred substituent groups for $R_2$.

$R_3$ in formula (I) is preferably a hydrogen atom, a halogen atom (preferably a fluorine atom or a chlorine atom) or an acylamino group. A halogen atom is the most preferred of these groups.

$R_6$ in formula (II) is preferably a hydrogen atom or an alkyl group of 1 to 20 carbon atoms, or an alkenyl group, and most preferably a hydrogen atom.

$R_5$ and $R_6$ in formula (II) preferably form a 5- or 6-membered nitrogen-containing heterocyclic ring.

$R_2$ in formula (I) is most desirably an alkyl group of 2 to 4 carbon atoms.

The oil protected type indazolone based couplers or cyanoacetyl based couplers, and preferably the 5-pyrazolone based and pyrazoloazole based couplers such as the pyrazolotriazoles can be used as magenta couplers in this invention. Of the 5-pyrazolone based couplers, those substituted with an alkylamino group or an acylamino group in the 3-position are preferred from the points of view of the hue of the colored dye which is formed and the color density. Typical examples of these couplers are disclosed in U.S. Pat. Nos. 2,311,082, 2,343,703, 2,600,788, 2,908,573, 3,062,653, 3,152,896, and 3,936,015. The nitrogen atom releasing groups disclosed in U.S. Pat. No. 4,310,619, or the arylthio groups disclosed in U.S. Pat. No. 4,351,897, are preferred as the 2-equivalent releasing groups of the 5-pyraolone based couplers. Furthermore, the 5-pyrazolone based couplers which have ballast groups disclosed in European Patent No. 73636 provide a high color density.

The pyrazolobenzimidazoles disclosed in U.S. Pat. No. 3,369,879, and preferably the pyrazolo[5,1-c][1,2,4]triazoles disclosed in U.S. Pat. No. 3,725,067, the pyrazolotetrazoles disclosed in *Research Disclosure,* RD No. 24220 (June, 1984) and the pyrazolopyrazoles disclosed in *Research Disclosure,* RD No. 24230 (June, 1984) can be employed as pyrazoloazole based couplers. The imidazo[1,2-b]pyrazoles disclosed in European Patent No. 119741 are preferred in view of the low level of auxiliary absorbance on the yellow side of the colored dye and their light fastness, and also in view of the fact that they enable the effect of the invention to be increased. The pyrazolo[1,5-b][1,2,4]triazoles disclosed in European Patent No. 119860 are especially desirable in this regard. These couplers can be represented by the formula indicated below.

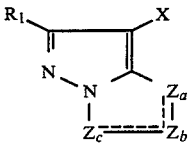

(A)

In this formula, $R_1$ represents a hydrogen atom or a substituent group, and preferably an alkyl group (for example, a methyl group, an ethyl group, a butyl group, etc.), a branched alkyl group (for example, an isopropyl group, an isobutyl group, a tert-butyl group, etc.), a substituted alkyl group (including branched groups), an alkoxy group (for example, a methoxy group, an ethoxy group, a butoxy group, etc.), a substituted alkoxy group (an ethoxyethoxy group, a phenoxyethoxy group), an aryloxy group (for example, a phenoxy group, etc.), a ureido group, etc. Most preferably, it is a branched alkyl group or an alkoxy group. X represents a hydrogen atom or a group which can be eliminated by a coupling reaction with the oxidized form of the primary aromatic amine color developing agent. Groups of this type include halogen atoms (for example, a chlorine atom, a bromine atom, etc.), arylthio groups (for example, a 2-butoxy-5-tert-octylphenylthio group or a 2-propoxy-5-tert-hexylphenylthio group, etc.), a nitrogen-containing heterocyclic group (for example, an imidazole group or a 4-chloroimidazole group, etc.), an aryloxy group (for example, a p-methylphenoxy group, a 2,4-dimethylphenoxy group or a 2,4-dimethyl-tert-phenoxy group, etc.). Of these groups, the halogen atoms and arylthio groups are preferred. $Z_a$, $Z_b$ and $Z_c$ represent methine, substituted methine, or =N— or —NH— groups, and one of the $Z_a$–$Z_b$ and $Z_b$–$Z_c$ bonds is a double bond and the other is a single bond. In cases where $Z_a$–$Z_b$ is a carbon-carbon double bond, this may form part of an aromatic ring. Moreover, cases in which oligomers consisting of dimers or groups as set forth above are formed via $R_1$ or X are also included. Furthermore, when $Z_a$, $Z_b$ or $Z_c$ is a substituted methine group, those cases in which an oligomer consisting of a dimer or groups set forth above is formed with the substituted methine group are also included. When $Z_a$, $Z_b$ or $Z_c$ is a substituted methine group, the substituent group is preferably a substituted alkyl group, especially a branched substituted alkyl group (for example, a substituted isopropyl group, a substituted tertiary butyl group, etc.), etc.

The oil protected type acylacetamido based couplers are typical of the yellow couplers which can be used in the invention. Actual examples of these couplers are disclosed in U.S. Pat. Nos. 2,407,210, 2,875,057 and 3,265,506. The use of 2-equivalent yellow couplers is preferred in this invention, and typical examples of these include the yellow couplers of the oxygen atom eliminating type disclosed in U.S. Pat. Nos. 3,408,194, 3,447,928, 3,933,501 and 4,022,620, and the nitrogen atom eliminating type yellow couplers disclosed in Japanese Patent Publication No. 10739/83, U.S. Pat. Nos. 4,401,752 and 4,326,024, *Research Disclosure*, RD No. 18053 (April, 1979), British Patent No. 1,425,020 and West German Patent Application (OLS) Nos. 2,219,917, 2,261,361, 2,329,587 and 2,433,812, etc., and α-pivaloylacetanilide based couplers such the colored dye has excellent fastness, especially light fastness, while high color densities can be obtained with the α-benzoylacetanilide based couplers.

The proportion by weight of coupler with respect to the polymer in this invention is preferably from 1.0/0.05 to 1/20, and most preferably from 1.0/0.1 to 1.0/10.

Furthermore, the couplers which are used in the invention are normally contained in the range of 0.005 to 4 mil, and preferably in the range of 0.05 to 2 mol, per mol of silver halide in the usual silver halide emulsion layers. Moreover, the amount coated onto the support is preferably from $2\times10^{-5}$ mol/m$^2$ to $1\times10^{-2}$ mol/m$^2$, and most preferably from $4\times10^{-5}$ mol/m$^2$ to $5\times10^{-3}$ mol/m2.

Actual preferred examples of the cyan couplers used in the invention are listed below but the invention is understood not to be limited to these examples.

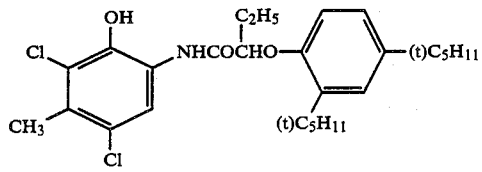

(C-1)

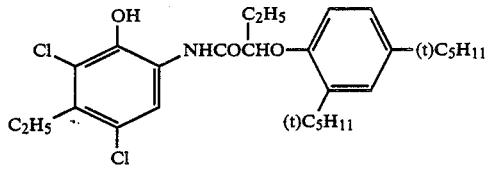

(C-2)

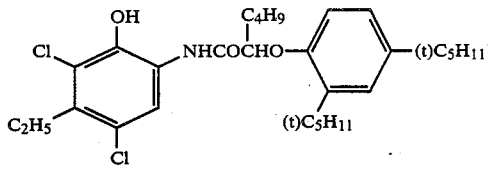

(C-3)

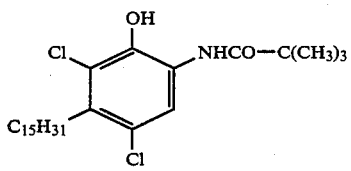

(C-4)

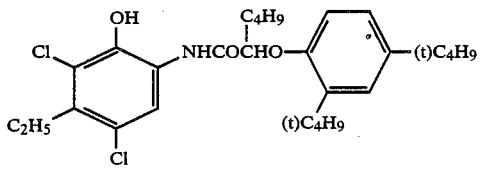

(C-5)

-continued
(C-6)
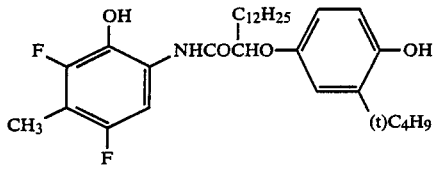
(C-7)
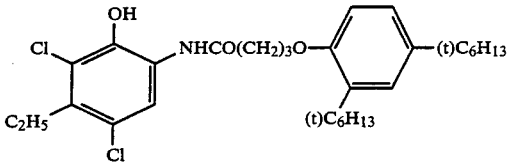
(C-8)
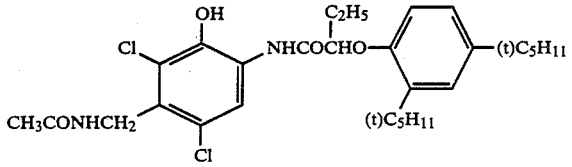
(C-9)
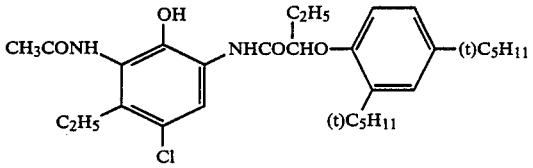
(C-10)
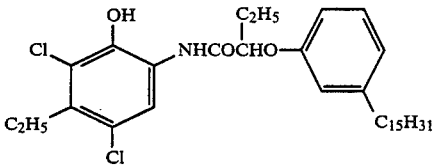
(C-11)
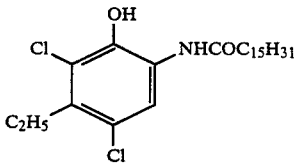
(C-12)
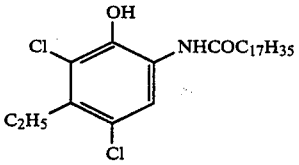
(C-13)
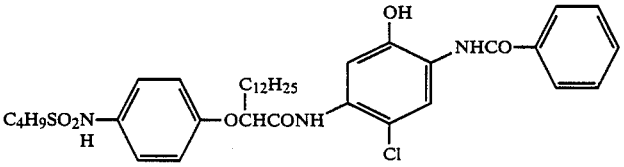

-continued
(C-14)
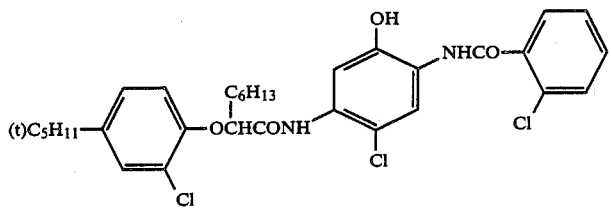
(C-15)
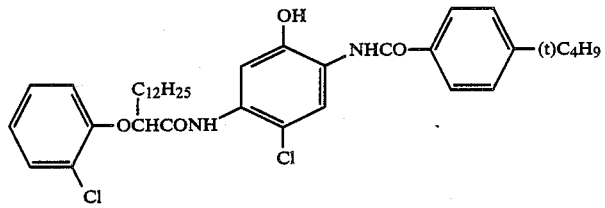
(C-16)
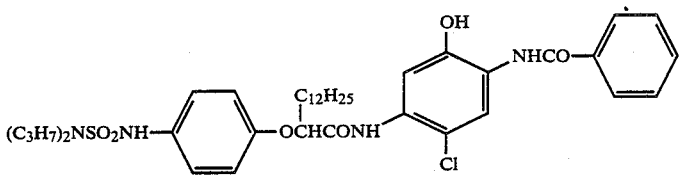
(C-17)
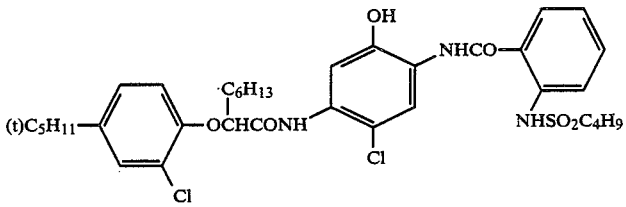
(C-18)
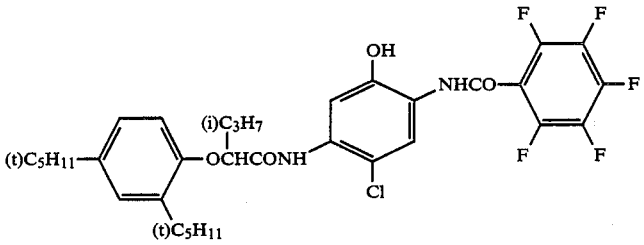
(C-19)
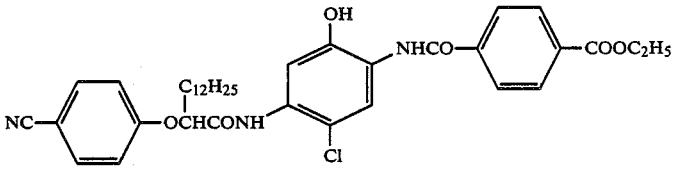
(C-20)
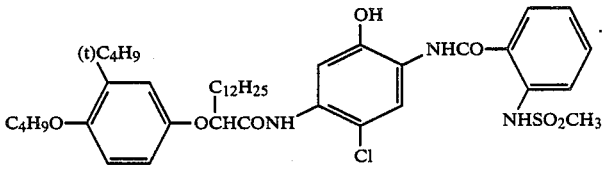

-continued
(C-21)
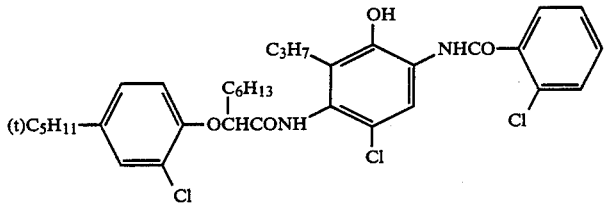
(C-22)
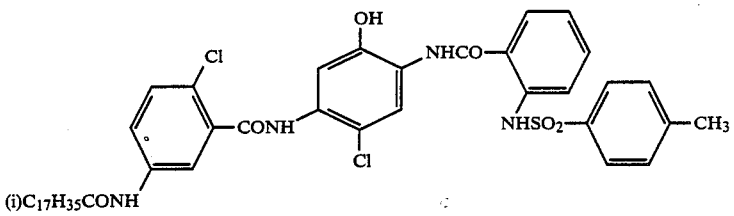
(C-23)
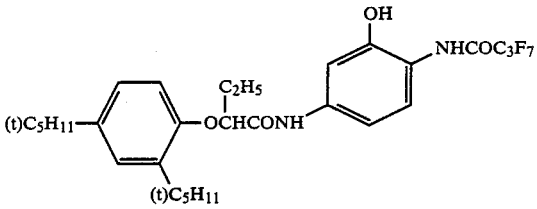
(C-24)
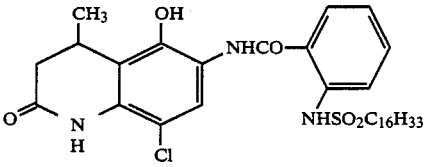
(C-25)
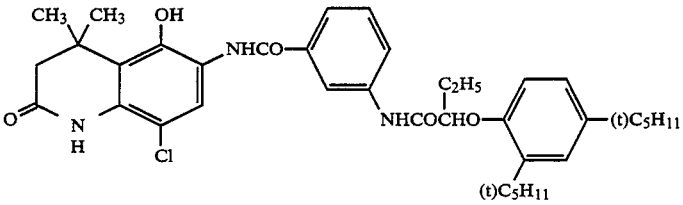
(C-26)
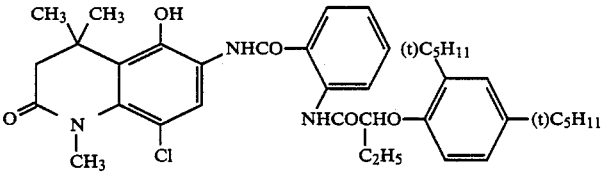
(C-27)
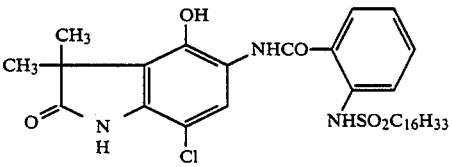

-continued
(C-28)
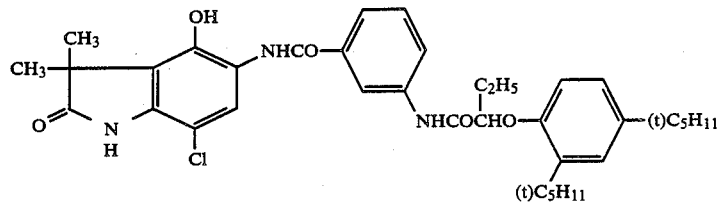
(C-29)
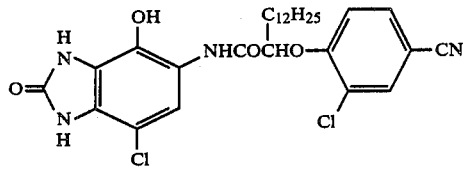
(C-30)
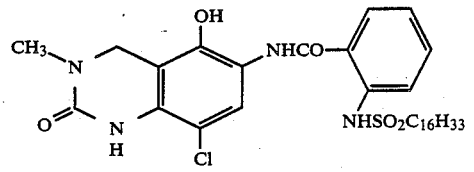
(C-31)
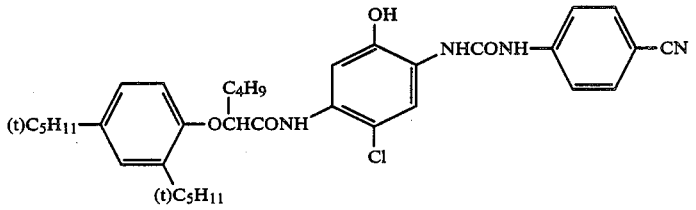
(C-32)
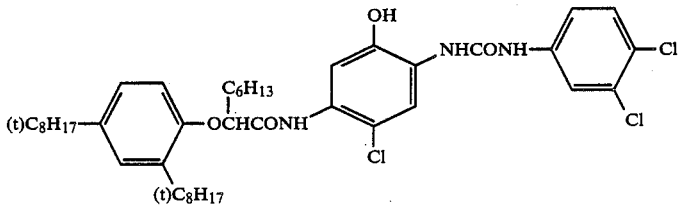
(C-33)
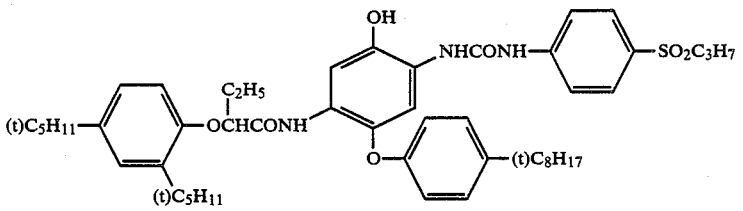
(C-34)
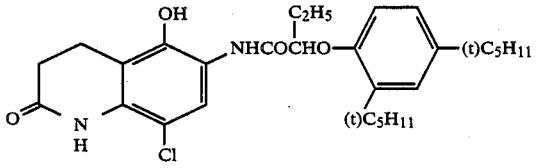

-continued
(C-35)
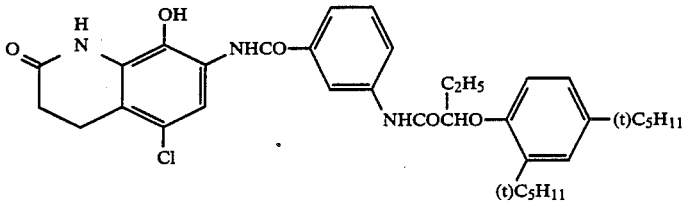
(C-36)
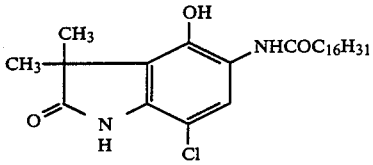
(C-37)
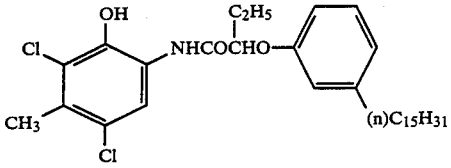
The ratios of x, y and z indicated below are all ratios by weight.
(C-38)
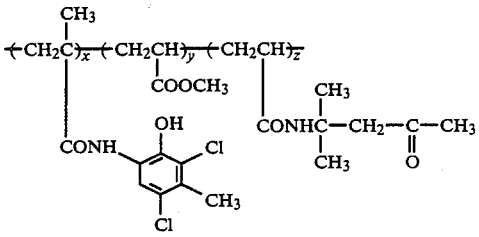
x/y/z = 50/20/30
(C-39)
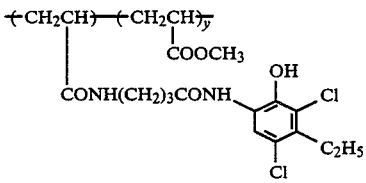
x/y = 55/45
(C-40)
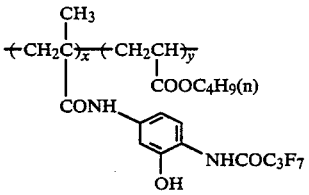
x/y = 60/40
(C-41)
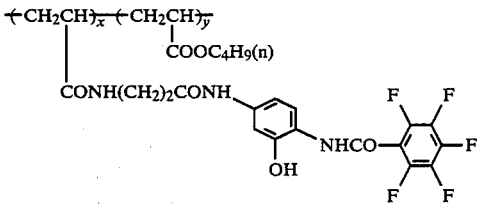
x/y = 50/50
-continued
(C-42)
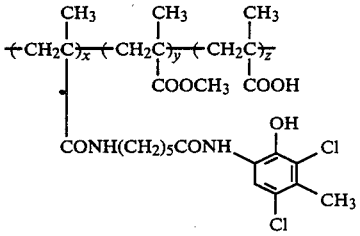
x/y/z = 55/40/5
(C-43)
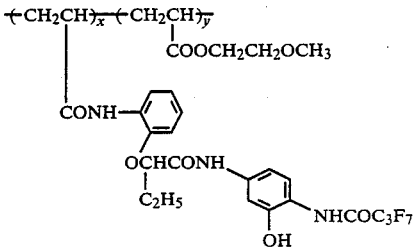
x/y = 60/40
(C-44)
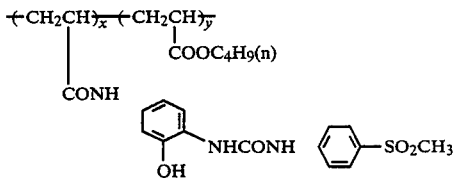
x/y = 50/50
(C-45)
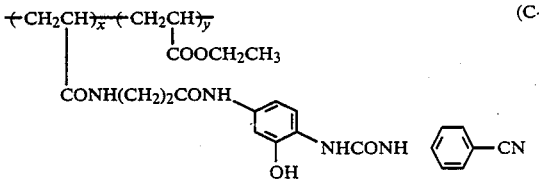
x/y = 45/55

-continued (C-46)

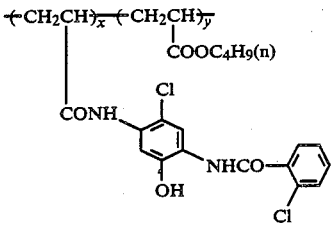

x/y = 50/50

In this invention not only the cyan couplers but also the magenta couplers and yellow couplers can be used as emulsified dispersions with high boiling point solvents and polymers of this invention. The use of 5-pyrazolone based couplers and pyrazoloazole based couplers is preferred for the magenta coupler.

Actual examples of the magenta couplers which are preferably used in the invention are listed below.

(M-1)

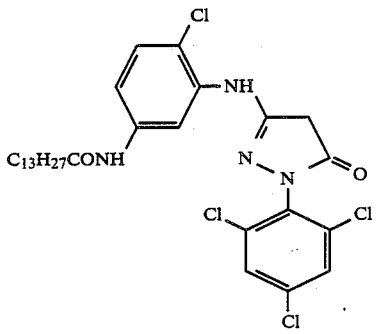

(M-2)

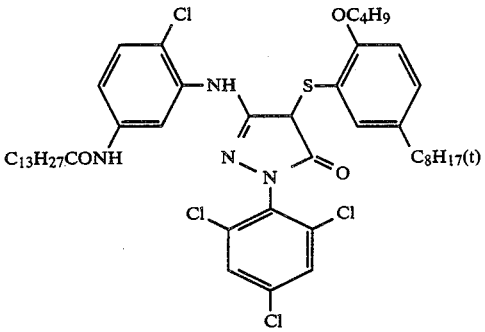

(M-3)

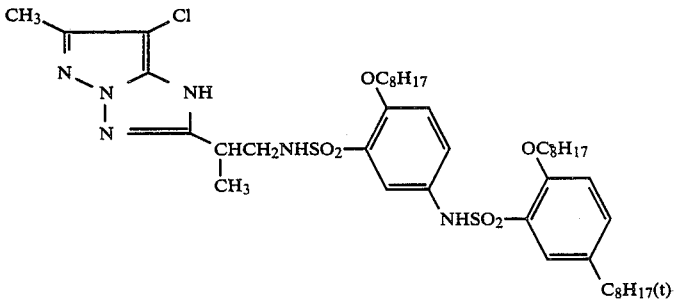

(M-4)

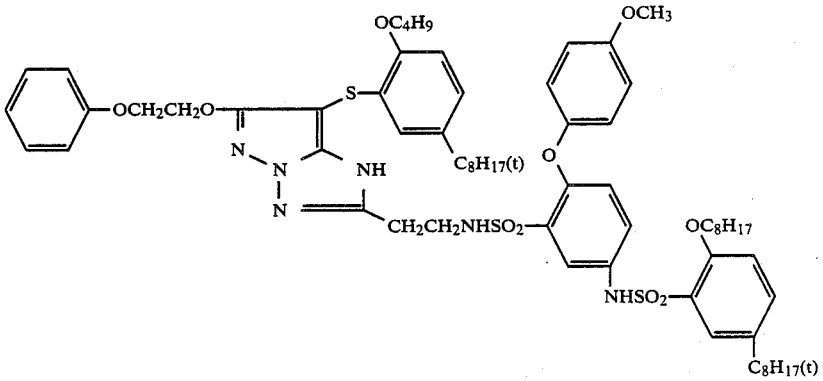

-continued
(M-5)
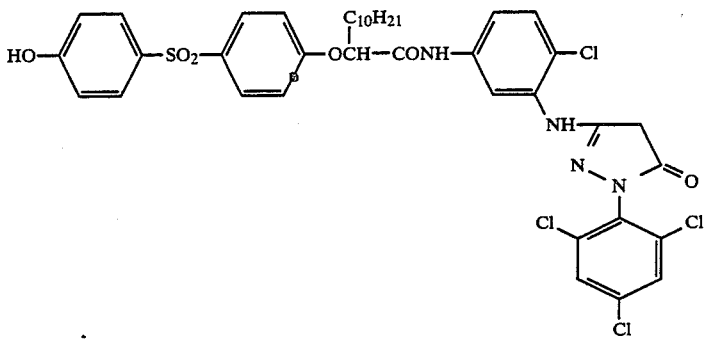
(M-6)
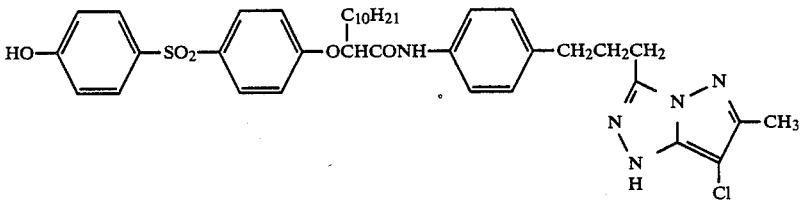
(M-7)
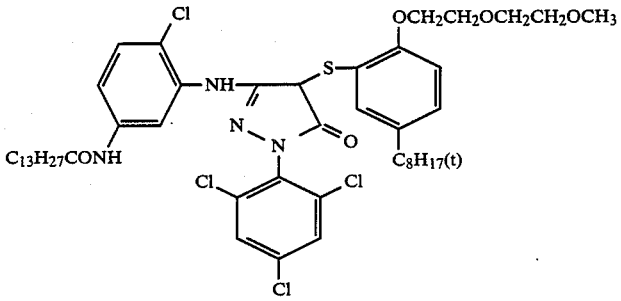
(M-8)
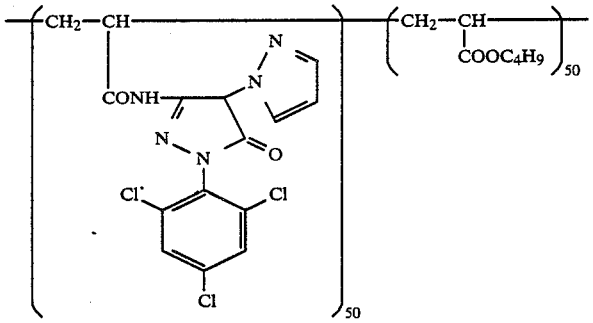
(M-9)
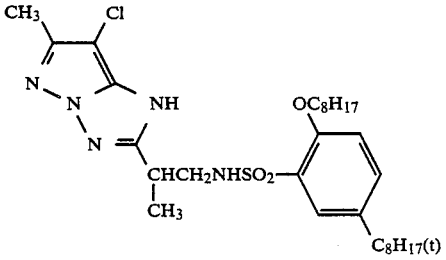

-continued
(M-10)
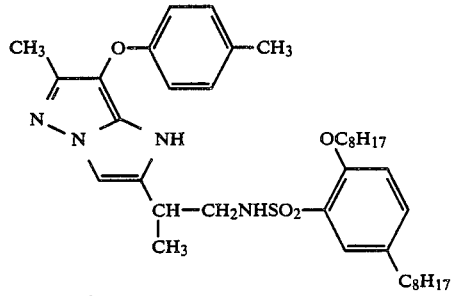
(M-11)
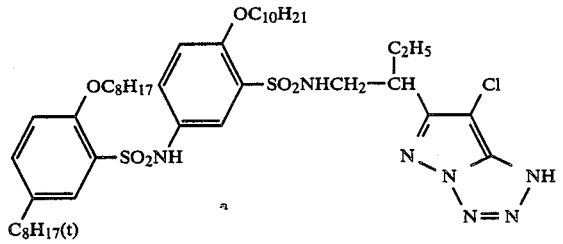
(M-12)
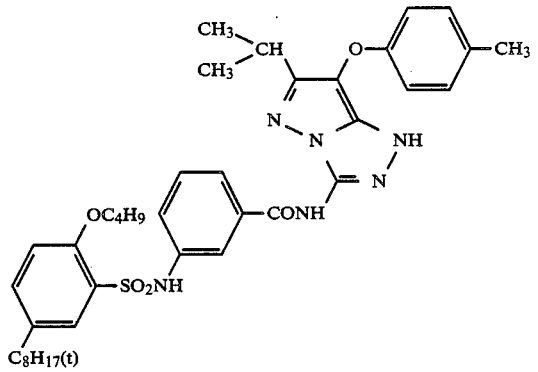
(M-13)
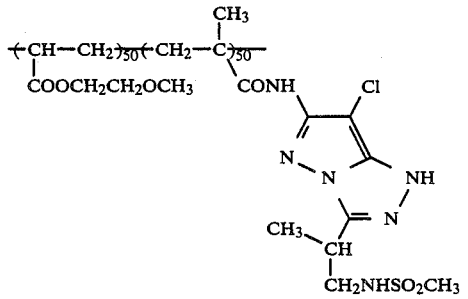
(M-14)
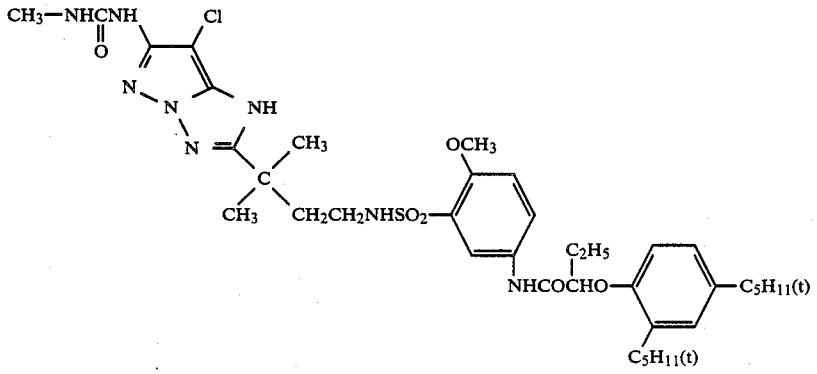

-continued
(M-15)
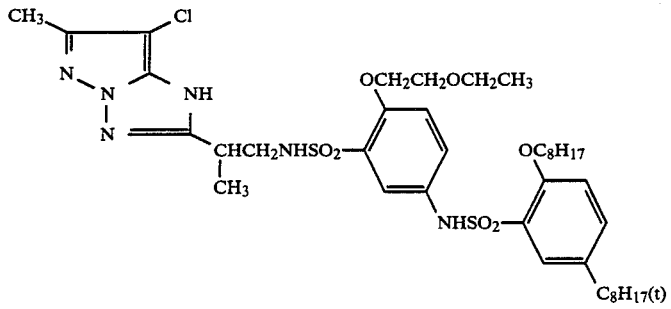
(M-16)
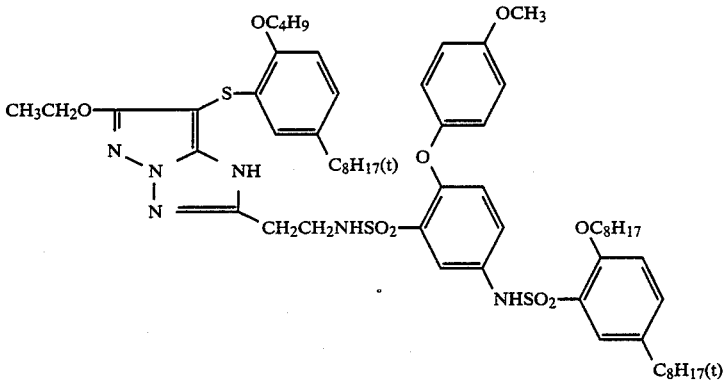
(M-17)
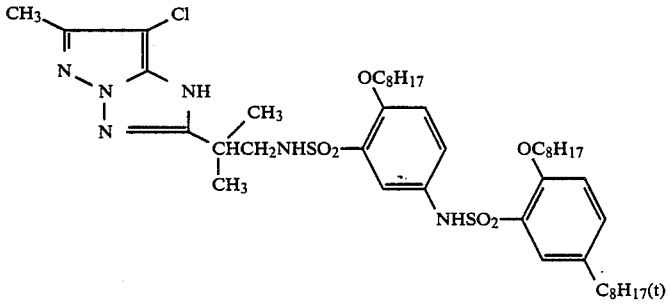
(M-18)
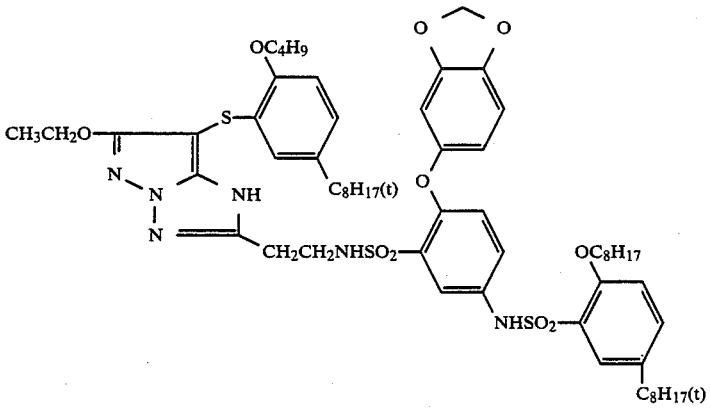

-continued (M-19)

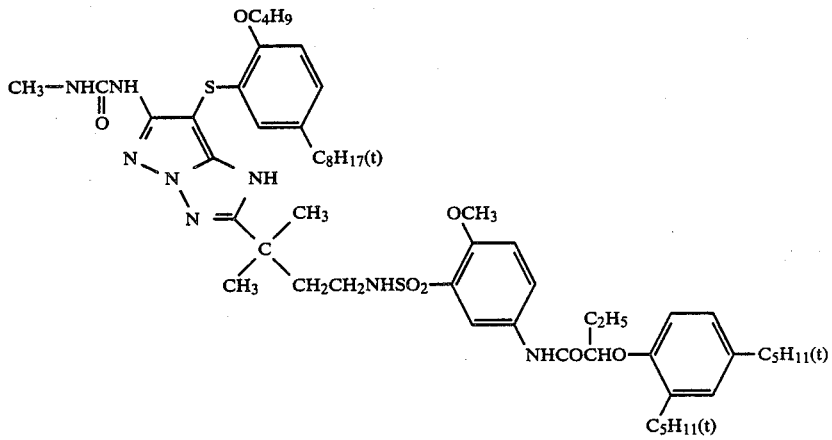

(M-20)

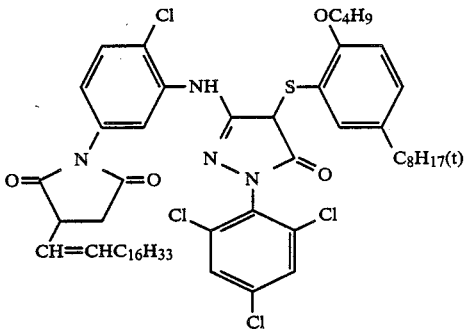

Similarly, the α-pivaloylacetanilide based couplers are preferred from the point of view of the balance of the fastness of the colored images, etc., for the yellow couplers which can be used in the form of an emulsified dispersion together with a high boiling point organic solvent and a polymer of this invention. Actual examples of the yellow couplers preferably used in the invention are listed below.

(Y-1)

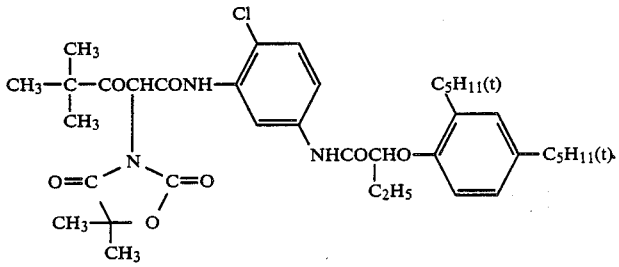

(Y-2)

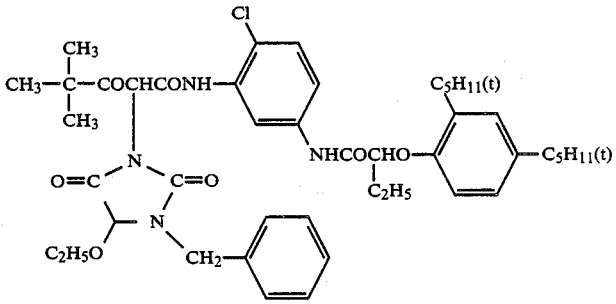

-continued
(Y-3)
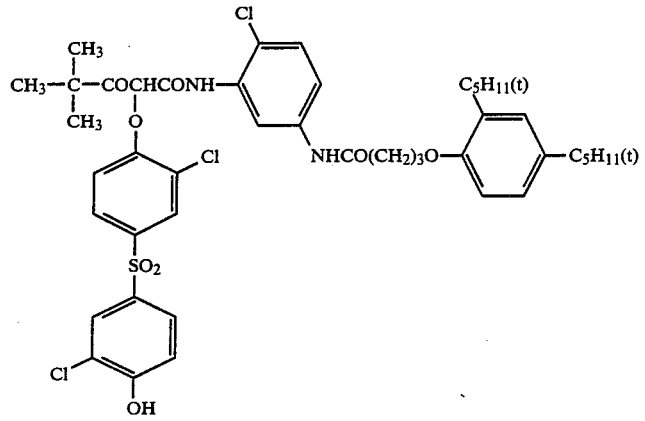
(Y-4)
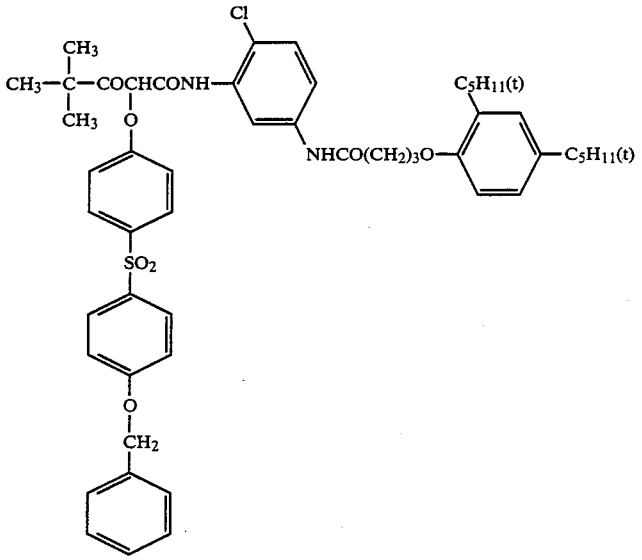
(Y-5)
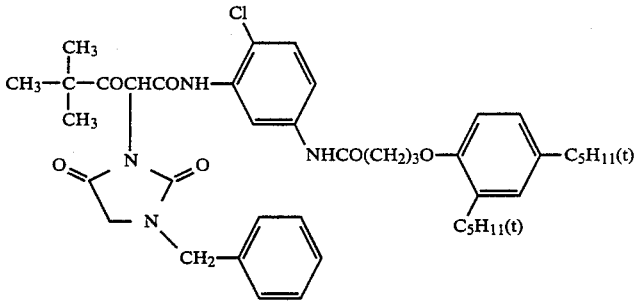
(Y-6)
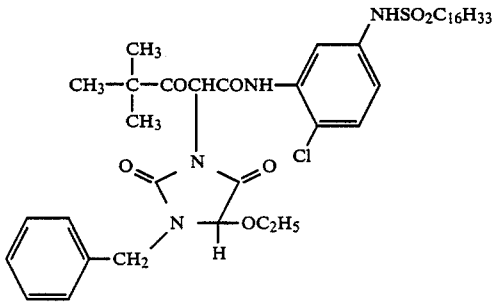

-continued (Y-7)

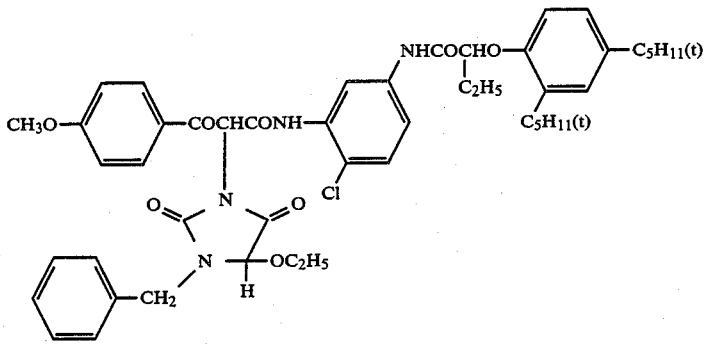

(Y-8)

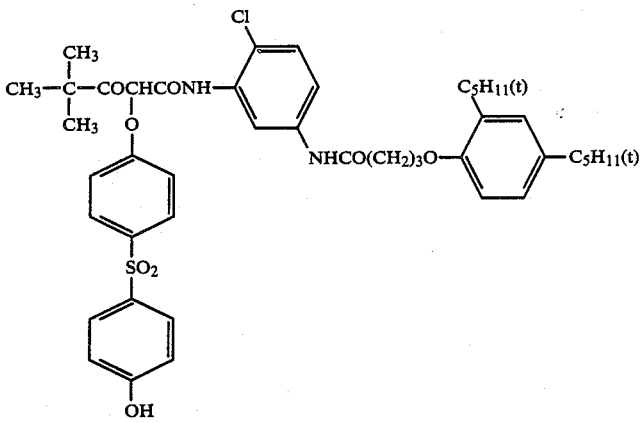

Compounds such as those indicated below can be used together with these couplers, for example, together with the pyrazoloazole couplers in this invention.

Thus, the simultaneous or independent use of compounds (A), which bind chemically with the aromatic amine based developers which are left behind after the color developing process and form compounds which are chemically inert and which are essentially colorless, and/or compounds (B), which bind chemically with the oxidized forms of the aromatic amine based color developers which are left behind after the color developing process and form compounds which are chemically inert and which are essentially colorless, are preferred for preventing, for example, the occurrence of staining by colored dye formation due to reaction between the couplers and the color developer or the oxidized form of the color developer which remains in the film on storing the film after processing, and other side reactions.

Preferred compounds (A) are those compound which react with p-anisidine with a second order reaction rate constant $k_2$ (in trioctylsulfate at 80° C.) within the range of from 1.0 l/mol.sec to $1\times10^{-5}$ l/mol·sec.

In cases where $k_2$ is larger than the values within this range the compound is itself unstable and it will inevitably react with the gelatin or water and decompose. On the other hand, if the value of $k_2$ lies below this range, reaction with the residual aromatic amine based developing agent will be slow. Therefore, it is not possible to suppress the side reactions of the residual aromatic amine based developing agents, which is one of the aims of the invention.

The preferred compounds (A) can be represented by formulae (AI) and (AII) indicated below.

$$R_1-(A)_n-X \qquad \text{(AI)}$$

$$R_2-\underset{\underset{B}{|}}{C}=Y \qquad \text{(AII)}$$

In these formulae $R_1$ and $R_2$ represent, respectively, aliphatic groups, aromatic groups or heterocyclic groups, and n is 1 or 0. B represents a hydrogen atom, an aliphatic group, an aromatic group, a heterocyclic group, an acyl group or a sulfonyl group and Y is a group which promotes the addition of the aromatic amine based developing agent to a compound of formula (AII). Here $R_1$ and X, and Y and $R_2$ or B can be joined together to form ring structures.

Substitution reactions and addition reactions are typical of the means of chemical bonding with the residual aromatic amine based developing agent.

Each of the groups of the compounds represented by formulae (AI) and (AII) are described in detail below.

The aliphatic groups represented by $R_1$, $R_2$ and B are linear chain, branched chain or cyclic alkyl groups, alkenyl groups or alkynyl groups, which may be substituted with substituent groups. The aromatic groups represented by $R_1$, $R_2$ and B may be carbocyclic aromatic groups (for example, phenyl groups, naphthyl groups, etc.) or heterocyclic aromatic groups (for example, furyl groups, thienyl groups, pyrazolyl groups, pyridyl groups, indolyl groups, etc.), which may take the form of single ring systems or condensed ring systems (for example, benzofuryl groups, phenanthridinyl groups, etc.). Moreover, these aromatic rings may have substituent groups.

The heterocyclic groups represented by $R_1$, $R_2$ and B are preferably groups which have a 3- to 10-membered ring structure and which are constructed from carbon atoms, oxygen atoms, nitrogen atoms, sulfur atoms or hydrogen atoms. The heterocyclic ring itself may be a saturated ring, and moreover, it may be substituted with substituent groups. (For example, coumanyl groups, pyrrolidyl groups, pyrrolinyl groups, morpholinyl groups, etc.)

X represents a group which is eliminated on reaction with the aromatic amine based developing agent, and it is preferably a group which is bonded to A via an oxygen atom, a sulfur atom or a nitrogen atom (for example, a 3-pyrazolyloxy group, a 3H-1,2,4-oxadiazoline-5-oxy group, an aryloxy group, an alkoxy group, an alkylthio group, an arylthio group or a substituted N-oxy group, etc.) or a halogen atom.

A represents a group which reacts and forms chemical bonds with the aromatic amine based developing agent. A also represents a group which contains a group which includes an atom of low electron density, for example, an $$-L-\underset{\underset{Y}{\|}}{C}- \text{ group, an } -L-\underset{\underset{Y}{\|}}{S}- \text{ group, an}$$

$$-L-\overset{\overset{Y}{\|}}{\underset{\underset{Y'}{\|}}{S}}- \text{ group, an } -L-\overset{\overset{Y}{\|}}{\underset{\underset{Y'}{\|}}{P}}- \text{ group or an } -L-\overset{\overset{R'}{|}}{\underset{\underset{R''}{|}}{Si}}- \text{ group.}$$

Moreover, n=0 when X is a halogen atom. Here L represents a single bond, an alkylene group, an —O— group, an —S— group, an $$-\overset{\overset{R'''}{\|}}{N}-$$

group, an $$-L'-\overset{\overset{Y}{\|}}{C}-L''-$$

group, an $$-L'-\overset{\overset{Y}{\|}}{S}-L''-$$

group or an $$-L'-\overset{\overset{Y}{\|}}{\underset{\underset{Y}{\|}}{S}}-L''-$$

group (for example, a carbonyl group, a sulfonyl group, a sulfinyl group, an oxycarbonyl group, a phosphonyl group, a thiocarbonyl group, an aminocarbonyl group, a silyloxy group, etc.).

Y has the same significance as Y in formula (AII) and Y' has the same significance as Y.

R' and R'' may be the same or different representing respectively —L'''—$R_0$.

$R_0$ has the same significance as $R_1$. R''' represents a hydrogen atom, an aliphatic group (for example, a methyl group, an isobutyl group, a tert-butyl group, a vinyl group, a benzyl group, an octadecyl group, a cyclohexyl group, etc.), an aromatic group (for example, a phenyl group, a pyridyl group, a naphthyl group, etc.), a heterocyclic group (for example, a piperidinyl group, a pyranyl group, a furanyl group, a chromanyl group, etc.), an acyl group (for example, an acetyl group, a benzoyl group, etc.) or a sulfonyl group (for example, a methanesulfonyl group, a benzenesulfonyl group, etc.).

L', L'' and L''' represent an —O— group, an —S— group or an $$-\overset{\overset{R'''}{\|}}{N}-$$

group. Of these groups, A is preferably a divalent group which can be represented by $$-O-\overset{\overset{O}{\|}}{C}-,\ -S-\overset{\overset{O}{\|}}{C}- \text{ or } -(\text{alkylene})-\overset{\overset{O}{\|}}{C}-.$$

Y in formula (AII) is preferably an oxygen atom, a sulfur atom, an =N—$R_4$ group or a $$=\overset{\overset{R_5}{|}}{C}-R_6$$

group.

Here, $R_4$, $R_5$ and $R_6$ represent hydrogen atom, aliphatic groups (for example, methyl groups, isopropyl groups, tert-butyl groups, vinyl groups, benzyl groups, octadecyl groups, cyclohexyl groups, etc.), aromatic groups (for example, phenyl groups, pyridyl groups, naphthyl groups, etc.), heterocyclic groups (for example, piperidyl groups, pyranyl groups, furanyl groups, chromanyl groups, etc.), acyl groups (for example, acetyl groups, benzoyl groups, etc.) or sulfonyl groups (for example, methanesulfonyl groups, benzenesulfonyl groups, etc.) and $R_5$ and $R_6$ may be joined together to form a ring structure.

Compounds which have nucleophilic group derived from a nucleophilic functional group of which the Pearson nucleophilicity *n* CH3I value (R. G. Pearson et al., *J. Am. Chem. Soc.*, 90, 319 (1968)) is 5 or more are preferred for the compounds (B) which bond chemically with the oxidized forms of the aromatic amine based developing agents after the color development process and form an essentially colorless compound.

The most preferred (B) compounds of this type are represented by formula (B') as set forth below.

$$R_7-Z\cdot M \qquad (B')$$

In this formula, $R_7$ represents an aliphatic group, an aromatic group or a heterocyclic group. Z represents a nucleophilic group. M represents a hydrogen atom, a metal cation, an ammonium cation or a protecting group.

Each of the groups in the compounds represented by formula (B') are described in more detail below.

The aliphatic group represented by $R_7$ is a linear chain or cyclic alkyl group, alkenyl group or alkynyl group, and may be substituted with substituent groups.

The aromatic groups represented by $R_7$ may be a carbocyclic aromatic group (for example, a phenyl group, a naphthyl group, etc.) or a heterocyclic aromatic group (for example, a furyl group, a thienyl group, a pyrazolyl group, a pyridyl group, an indolyl group, etc.) and it may take the form of a single ring system or a condensed ring system (for example, a benzofuryl group, a phenanthridinyl group, etc.). Moreover, these aromatic rings may have substituent groups.

The heterocyclic groups represented by $R_7$ are preferably groups which have a 3- to 10-membered ring structure and which are constructed from carbon atoms, oxygen atoms, nitrogen atom, sulfur atoms or hydrogen atoms. The heterocyclic ring itself may be saturated or unsaturated, and moreover, it may be substituted by substituent groups (for example, coumanyl groups, pyrrolidyl groups, pyrrolinyl groups, morpholinyl groups, etc.).

Z represents a nucleophilic group and includes nucleophilic groups in which the atom bonds chemically directly with the oxidized form of the aromatic amine based developing agent, which is, for example, an oxygen atom, a sulfur atom or a nitrogen atom (for example, amine compounds, azide compounds, hydrazine compounds, mercapto compounds, sulfide compounds, sulfinic acid compounds, cyano compounds, thiocyano compounds, thiosulfuric acid compounds, seleno compounds, halide compounds, carbxyl compounds, hydroxamic acid compounds, active methylene compounds, phenol compounds, nitrogen heterocyclic compounds, etc.).

M is a hydrogen atom, a metal cation, an ammonium cation or a protecting group.

Compounds which can be represented by formula (B') undergo a nucleophilic reaction (typically a coupling reaction) with the oxidized forms of aromatic amine based developing agents.

The most preferred of the compounds represented by formula (B') are those which can be represented by formula (B'') indicated below.

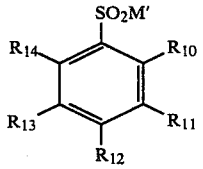

(B''')

In this formula, M' represents an atom or atomic group which forms an inorganic (for example, lithium, sodium, potassium, calcium, magnesium, etc.) or an organic (for example, triethylamine, methylamine, ammonia, etc.) salt, or an

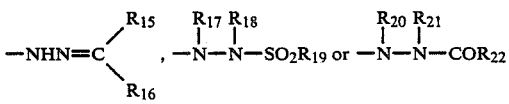

group. Here $R_{15}$ and $R_{16}$ may be the same or different, and may represent hydrogen atoms or aliphatic groups, aromatic groups or heterocyclic groups of the same significance as $R_1$. $R_{15}$ and $R_{16}$ may also be joined together to form a 5- to 7-membered ring. $R_{17}$, $R_{18}$, $R_{20}$ and $R_{21}$ may be the same or different, each representing a hydrogen atom or an alkyl group, an aromatic group or a heterocyclic group of the same significance as $R_7$, $R_{17}$, $R_{18}$, $R_{20}$ and $R_{21}$ represent, moreover, acyl groups, alkoxycarbonyl groups, sulfonyl groups, ureido groups or urethane groups. However, at least one of $R_{17}$ and $R_{18}$ and at least one of $R_{20}$ and $R_{21}$ is a hydrogen atom. $R_{19}$ and $R_{22}$ represent hydrogen atoms or aliphatic groups, aromatic groups or heterocyclic groups the same as for $R_7$. Moreover, $R_{22}$ represents an alkylamino group, an arylamino group, an alkoxy group, an aryloxy group, an acyl group, an alkoxycarbonyl group or an aryloxycarbonyl group, etc. At least two of the groups $R_{17}$, $R_{18}$ and $R_{19}$ may be joined together to form 5- to 7-membered rings, and furthermore, at least two of the groups $R_{20}$, $R_{21}$ and $R_{22}$ may be joined together to form 5- to 7-membered rings.

$R_{10}$, $R_{11}$, $R_{12}$, $R_{13}$ and $R_{14}$ may be the same or different, each representing a hydrogen atom, an aliphatic group (for example, a methyl group, an isopropyl group, a tert-butyl group, a vinyl group, a benzyl group, an octadecyl group, a cyclohexyl group, etc.), an aromtic group (for example, a phenyl group, a pyridyl group, a naphthyl group, etc.), a heterocyclic group (for example, a piperidyl group, a pyranyl group, a furanyl group, a chromanyl group, etc.), a halogen atom (for example, a chlorine atom, a bromine atom, etc.), an —$SR_8$ group, an —$OR_8$ group, an

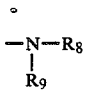

group, an acyl group (for example, an acetyl group, a benzoyl group, etc.), an alkoxycarbonyl group (for example, a methoxycarbonyl group, a butoxycarbonyl group, a cyclohexylcarbonyl group, an octyloxycarbonyl group, etc.), an aryloxycarbonyl group (for example, a phenyloxycarbonyl group, a naphthyloxycarbonyl group, etc.), a sulfonyl group (for example, a methanesulfonyl group, a benzenesulfonyl group, etc.), a sulfonamido group (for example, a methanesulfonamido group, a benzenesulfonamido group, etc.), a sulfamoyl group, a ureido group, a urethane group, a carbamoyl group, a sulfo group, a carboxyl group, a nitro group, a cyano group, an alkoxalyl group (for example, a methoxyxalyl group, an isobutoxyxalyl group, an octyloxyxalyl group, a benzoyloxyxalyl group, etc.), an arylxalyl group (for example, a phenoxyxalyl group, a naphthoxyxalyl group, etc.), a sulfonyloxy group (for example, a methanesulfonyloxy group, a benzenesulfonyloxy group, etc.), —$P(R_8)_3$,

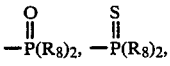

—$P(OR_8)_3$ or a formyl group. Here $R_8$ and $R_9$ represent hydrogen atoms or aliphatic groups, alkoxy groups or aromatic groups. Of these, those compounds of which the sum of the Hammet values for —$SO_2M'$ is 0.5 or above are particularly effective in this invention.

Typical examples of the compounds represented by formulae (AI) (AII) and (B') are indicated below.

(A-1)
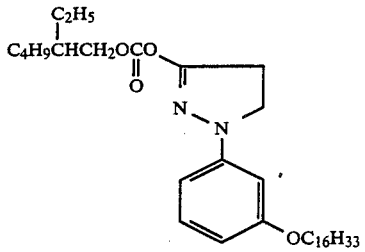
(A-2)
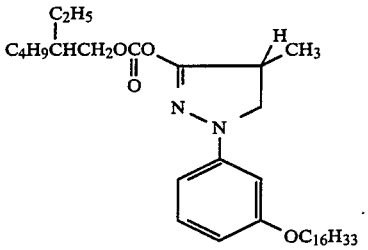
(A-3)
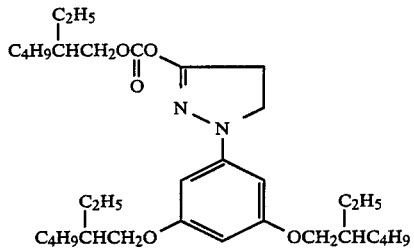
(A-4)
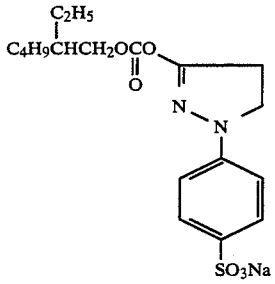
(A-5)
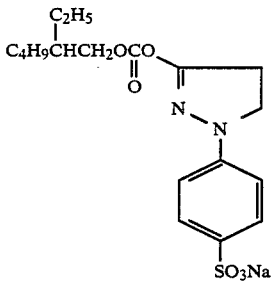
(A-6)
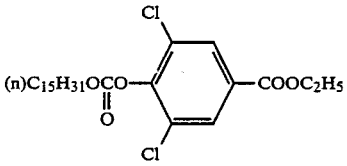
(A-7)
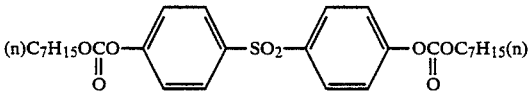

-continued
(A-8)
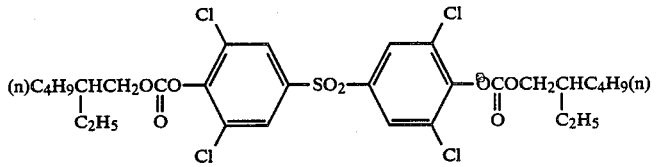
(A-9)
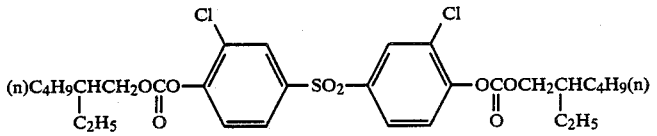
(A-10)
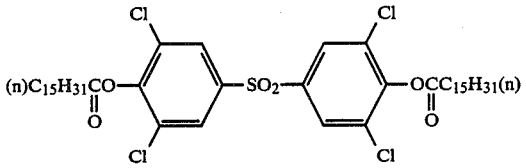
(A-11)
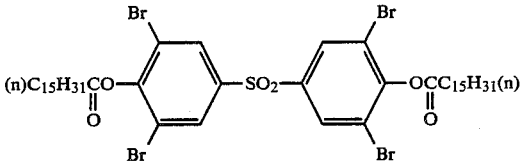
(A-12)
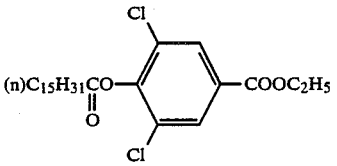
(A-13)
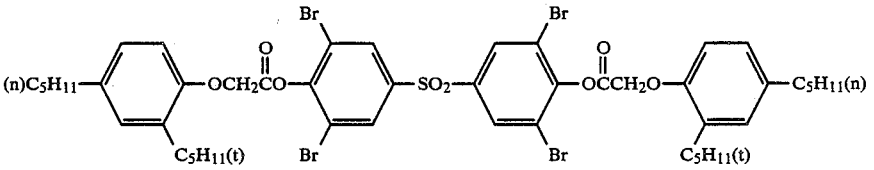
(A-14)
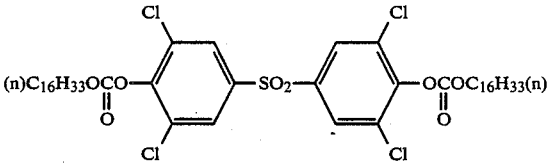
(A-15)
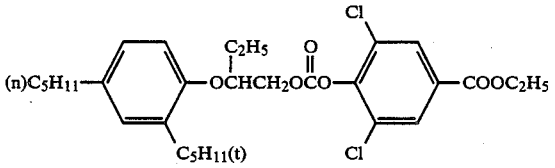
(A-16)
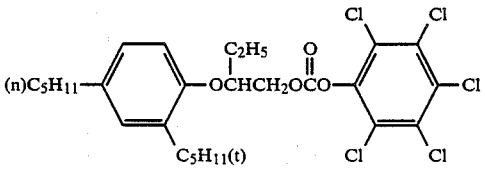

-continued
(A-17)
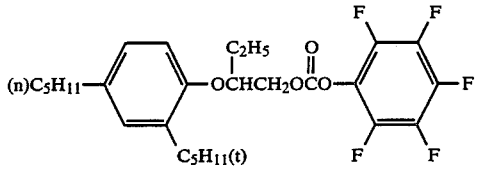
(A-18)
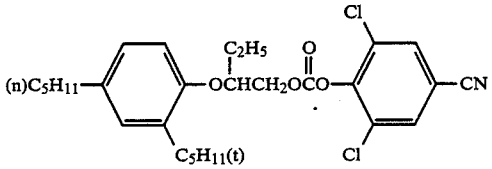
(A-19)
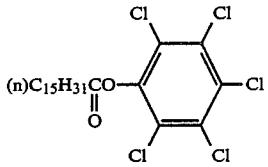
(A-20)
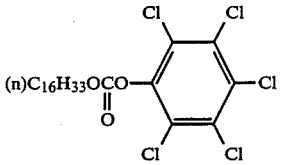
(A-21)
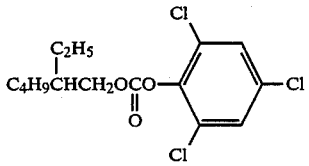
(A-22)
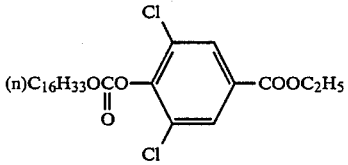
(A-23)
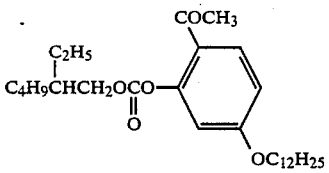
(A-24)
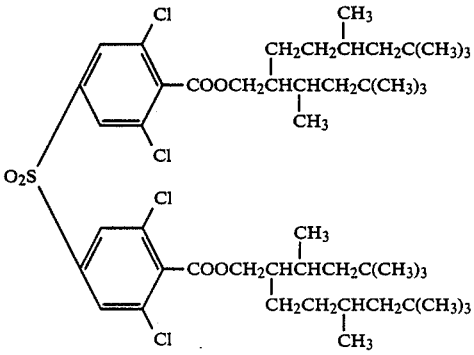

-continued
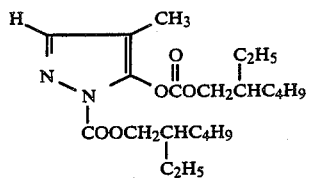
(A-25)
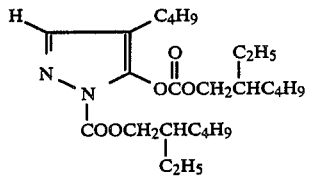
(A-26)
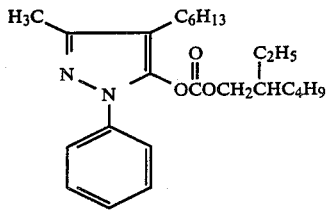
(A-27)
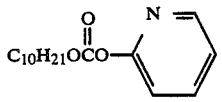
(A-28)
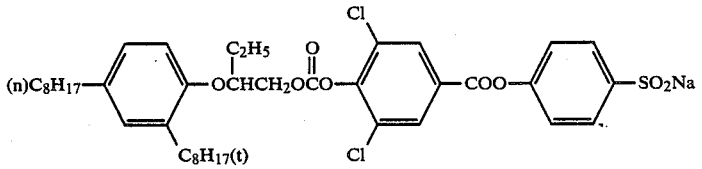
(A-29)
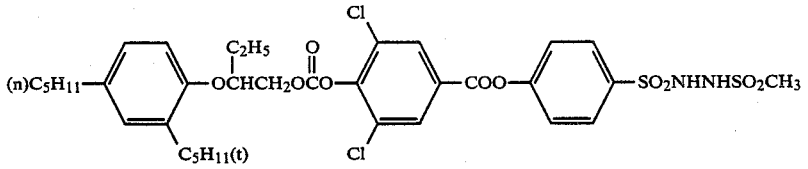
(A-30)
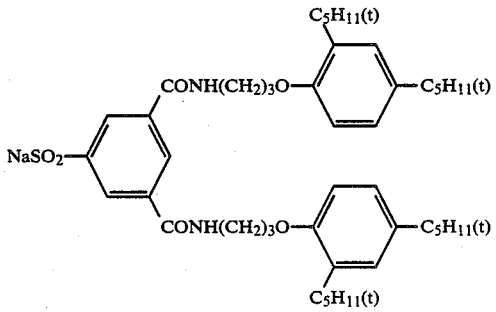
(B-1)

-continued
(B-2)
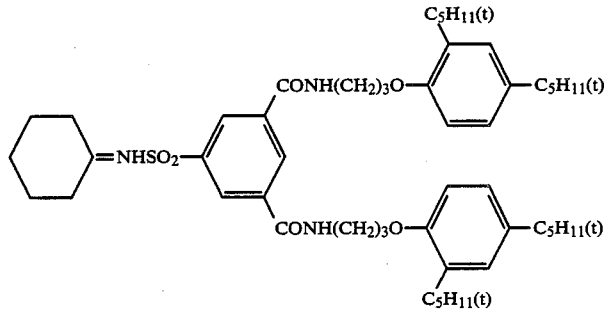
(B-3)
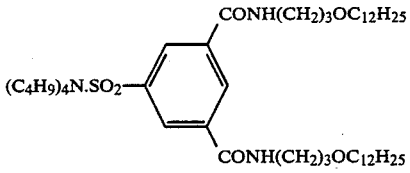
(B-4)
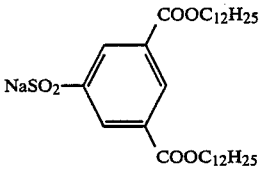
(B-5)
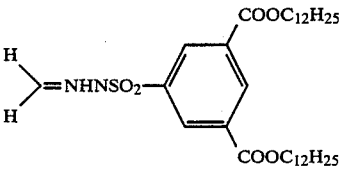
(B-6)
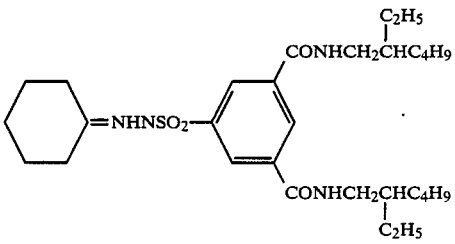
(B-7)
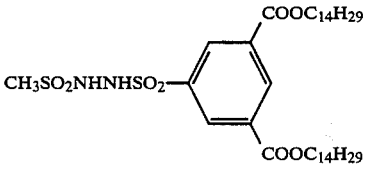
(B-8)
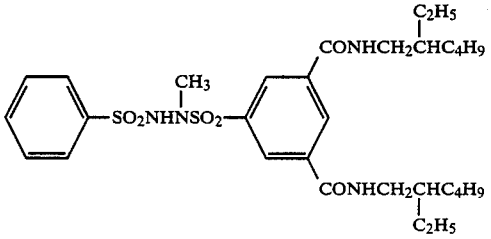

-continued
(B-9)
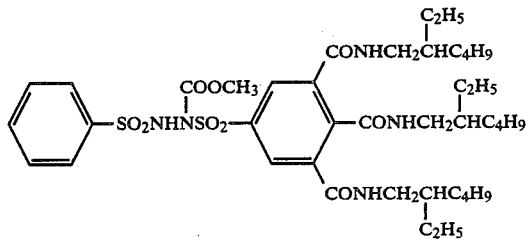
(B-10)
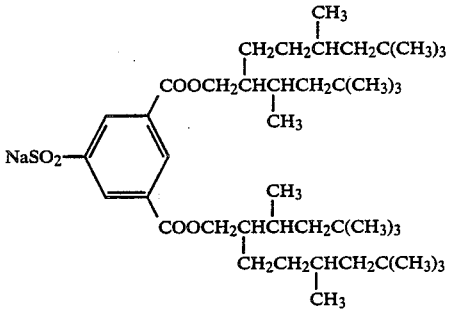
(B-11)
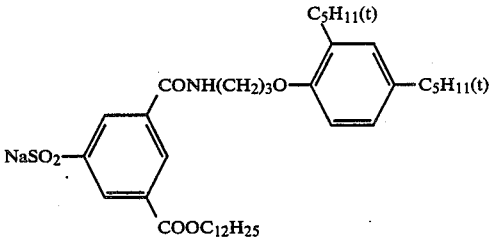
(B-12)
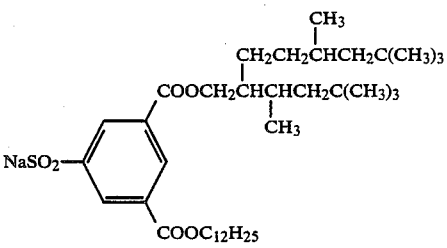
(B-13)
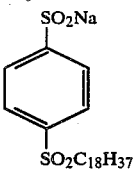
(B-14)
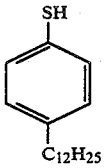
(B-15)
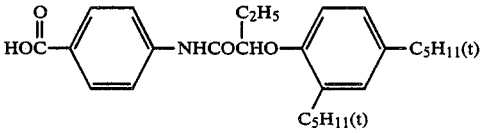

-continued (B-16)

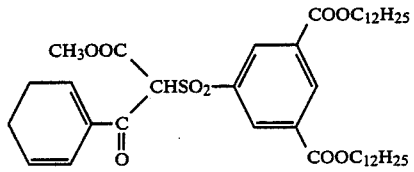

The high boiling point organic solvents which can be used in the invention are described in detail below.

The high boiling point organic solvents of this invention have a boiling point of at least 140° C. The use of compounds of melting point below 100° C. and boiling point above 140° C., which are immiscible with water as well as having formulae (III) to (VIII), is preferred, provided that they are solvents for the coupler and the polymer. The melting point of the high boiling point organic solvent is preferably below 80° C. The boiling point of the high boiling point organic solvent is preferably above 160° C., and more preferably above 170° C.

If the melting point of the high boiling point solvent exceeds about 100° C., then crystallization of the coupler is liable to occur, and the improvement in color forming properties is adversely affected.

Furthermore, if the boiling point of the high boiling point organic solvent is less than about 140° C., it is liable to evaporate during the coating an drying of the photographic emulsion. This means that it becomes more difficult for the couplers and the polymers of this invention to coexist as oil droplets in the photographic emulsion layers and, consequently, it is difficult to realize the effect of the invention.

Furthermore, if the high boiling point organic solvent which is used is miscible with water, then the couplers may migrate into other photographic layers or they may be leached out into the processing solutions during the coating of the photographic emulsion layers or during photographic processing of the sensitive material obtained by coating and drying. This can result in color mixing, fogging and in a lowering of the maximum color density.

The preferred amount of high boiling point organic solvent for use in this invention varies over a wide range, depending on the type and amount of coupler and polymer being used, but the ratio by weight of the high boiling point organic solvent and the coupler is preferably within the range from 0.05 to 20, and more preferably within the range from 0.1 to 10. Moreover, the high boiling point organic solvent/polymer ratio is preferably within the range from 0.02 to 100, and most desirably within the range from 0.05 to 50. Furthermore, the high boiling point organic solvents can be used individually or in the form of mixtures.

Of the compounds which can be represented by formulae (III) to (VIII), those represented by formulae (III), (IV) and (VIII) are preferred.

The groups shown in formulae (I) and (II) may be used as actual examples of the substituted or unsubstituted alkyl groups, cycloalkyl groups, alkenyl groups, aryl groups or heterocyclic groups, which can be represented by $W_1$ to $W_6$ in formulae (III) to (VIII). Furthermore, epoxy groups may also be bonded to the alkyl groups.

Actual examples of high boiling point coupler solvents which can be used in the invention are indicated below but the invention is understood not to be limited to these solvents.

$O{=}P(OC_4H_9{-}n)_3$ (S-1)

$O{=}P(OCH_2CH_2CH(CH_3)_2)_3$ (S-2)

$O{=}P(OC_6H_{13}{-}n)_3$ (S-3)

(S-4)

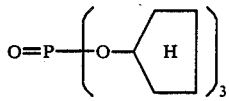

(S-5)

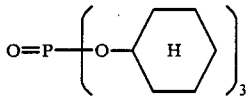

$O{=}P(OC_8H_{17}{-}n)_3$ (S-6)

(S-7)

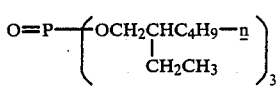

(S-8)

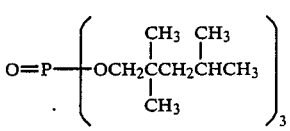

(S-9)

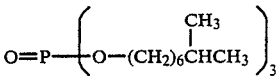

$O{=}P(OC_9H_{19}{-}n)_3$ (S-10)

(S-11)

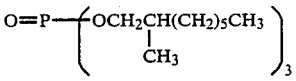

$O{=}P(OC_{10}H_{21}{-}n)_3$ (S-12)

(S-13)

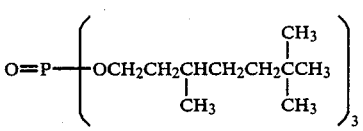

(S-14)

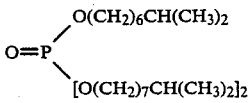

(S-15)

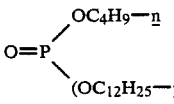

-continued
(S-16)
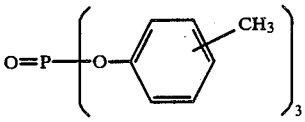
(S-17)
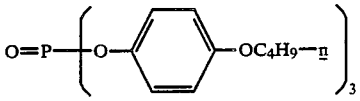
(S-18)
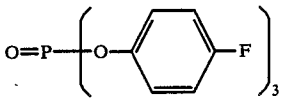
(S-19)
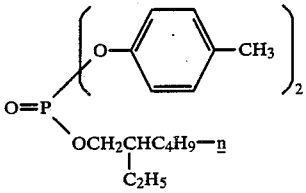
(S-20)
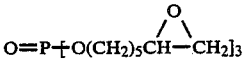
(S-21)
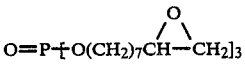
(S-22)
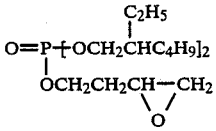
(S-23)
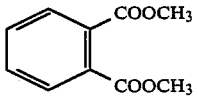
(S-24)
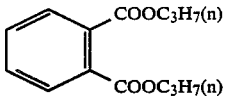
(S-25)
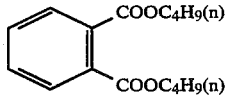
(S-26)
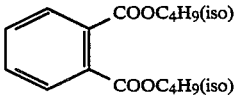
(S-27)
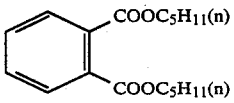
-continued
(S-28)
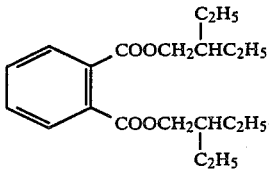
(S-29)
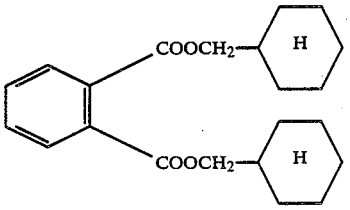
(S-30)
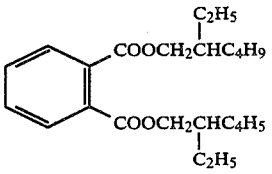
(S-31)
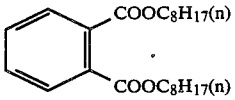
(S-32)
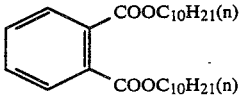
(S-33)
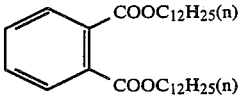
(S-34)
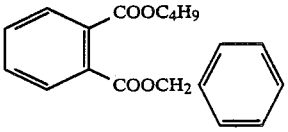
(S-35)
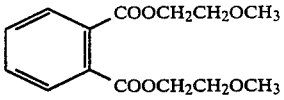
(S-36)
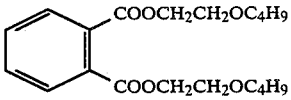
(S-37)
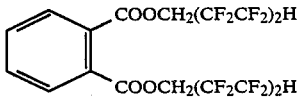
(S-38)
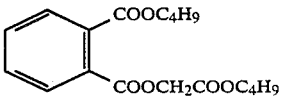

-continued
(S-39)
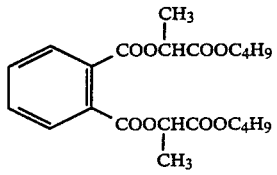
(S-40)
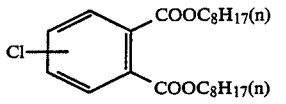
(S-41)
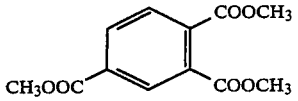
(S-42)
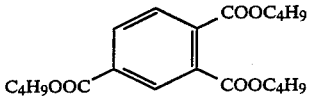
(S-43)
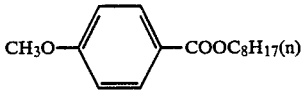
(S-44)
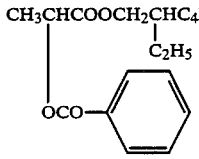
(S-45)
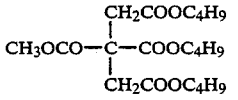
(S-46)
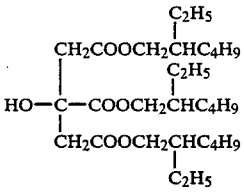
(S-47)
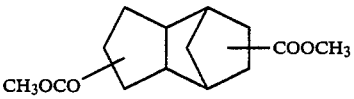
(S-48)
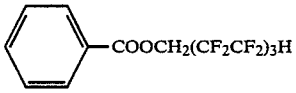
(S-49)
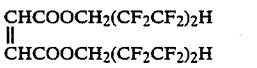
-continued
(S-50)
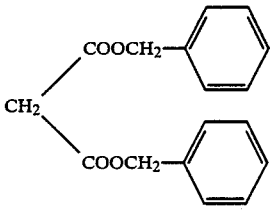
(S-51)
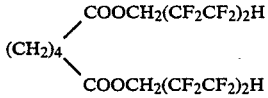
(S-52)
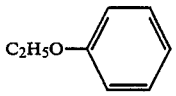
(S-53)
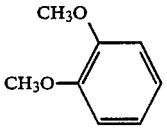
(S-54)
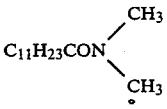
(S-55) $C_{12}H_{25}OH$
(S-56) $C_{16}H_{33}OH$
(S-57) $C_{18}H_{37}OH$
(S-58) $C_{10}H_{21}O(CH_2)_5O(CH_2)_2OH$
(S-59)
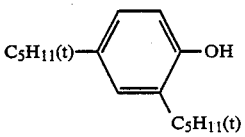
(S-60)
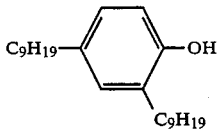
(S-61) $CH_3(CH_2)_{17}Cl$
(S-62) $CH_3(CH_2)_{15}Br$
(S-63)
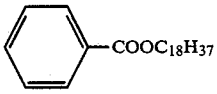
(S-64)
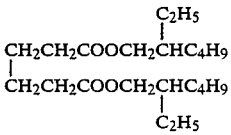

-continued

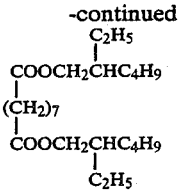

(S-65)

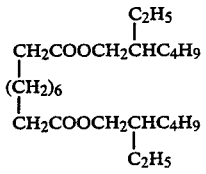

(S-66)

The emulsified dispersions of fine lipophilic particles comprised of the couplers, high boiling point organic solvents and polymers of this invention can be prepared in the following way.

A polymer of this invention, a so-called linear polymer (which is not crosslinked and which has been synthesized by means of a liquid polymerization method, by emulsion polymerization or by suspension polymerization), a high boiling point organic solvent and a coupler are dissolved in an auxiliary organic solvent. Then the solution is dispersed into very fine particles in water or, preferably, in a hydrophilic colloid solution, or more preferably in an aqueous gelatin solution using a dispersant either ultrasonically, with a colloid mill or by using some other mechanical method of dispersion.

Alternatively, water or an aqueous solution of a hydrophilic colloid, such as gelatin, may be added to an auxiliary organic solvent which contains a dispersion promotor such as a surfactant, a polymer of this invention, a high boiling point organic solvent and a coupler, to form an oil droplet in water dispersion with phase inversion. The auxiliary organic solvent may be removed from dispersions prepared in this way using methods such as evaporation, noodle washing or ultrafiltration. The auxiliary organic solvent here is an organic solvent which is useful during the emulsification and dispersion process and which ultimately is essentially eliminated from the photosensitive material during the drying process at the time of coating or by using the methods mentioned above. Thus, the auxiliary organic solvent is an organic solvent of low boiling point which can be eliminated by evaporation, or a solvent which can be eliminated by washing with water, etc. Such auxiliary organic solvents include acetates (such as ethyl acetate and butyl acetate), butylcarbitol acetate, ethyl propionate, secondary butyl alcohol, methyl ethyl ketone, methyl isobutyl ketone, β-ethoxyethyl acetate, methyl cellosolve acetate and cyclohexanone, etc.

Moreover, these auxiliary solvents can be used together with organic solvents which are completely miscible with water, for example, methyl alcohol, ethyl alcohol, acetone or tetrahydrofuran.

Furthermore, these organic solvents can be used in combinations of two or more types.

The average particle size of the fine lipophilic particles obtained in this way is preferably at least 0.03 μm and at most 2 μm, and more preferably at least 0.05 μm and at most 0.4 μm. The average particle size of the fine lipophilic particles can be measured using apparatus such as the Nanosizer made by the Coater Co., for example. Various substances which are useful photographically can be included in the auxiliary organic solvent of the lipophilic fine particles. Examples of such substances which are useful photographically include color couplers, colorless couplers, developing agents, developing agent precursors, development suppressing agent precursors, ultraviolet absorbers, development accelerators, hydroquinones, quinones, dyes, dye releasing agents, antioxidants, fluorescent whiteners, fading inhibitors and color formation accelerators, etc. The concurrent use of these materials with the present invention is often desirable.

Furthermore, the compounds of formulae (A) to (C), as indicated below, are useful for improving the fastness of the colored images and for increasing the effect of the improvement in color in this invention. They can be included as substances which are useful photographically in the fine lipophilic particles of this invention which consist of coupler, high boiling point organic solvent and polymer.

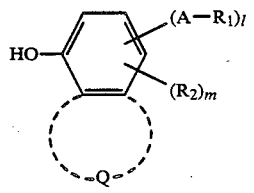

(A)

Here, A represents a divalent electron withdrawing group and $R_1$ represents a substituted or unsubstituted alkyl group, a substituted or unsubstituted aryl group, a substituted or unsubstituted alkoxy group, a substituted or unsubstituted aryloxy group, a substituted or unsubstituted alkylamino group, a substituted or unsubstituted anilino group or a substituted or unsubstituted heterocyclic group. Here, l is an integer of value 1 or 2. $R_2$ represents a substituted or unsubstituted alkyl group, a substituted or unsubstituted alkoxy group, a hydroxyl group or halogen, and m is an integer of value 0 to 4. Q represents a benzene or heterocyclic ring which is condensed with the phenol ring.

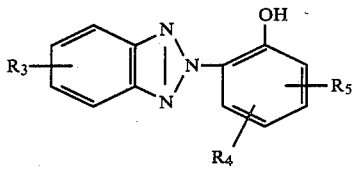

(B)

In formula (B), $R_3$, $R_4$ and $R_5$ are each hydrogen atoms, halogen atoms, nitro groups, hydroxyl groups, or substituted or unsubstituted alkyl groups, alkoxy groups, aryl groups, aryloxy groups or acylamino groups.

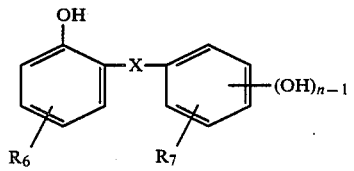

(C)

In formula (C), $R_6$ and $R_7$ are each hydrogen atoms or substituted or unsubstituted alkyl groups, alkoxy groups or acyl groups, X is a —CO— group or a —COO— group, and n is an integer of value 1 to 4.

Actual examples of compounds which can be represented by formulae (A) to (C) are indicated below, but the invention is understood not to be limited to these examples.

(X-1)

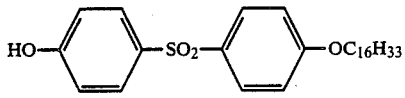

(X-2)

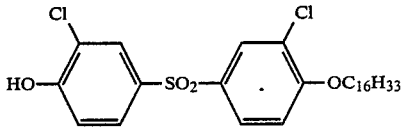

(X-3)

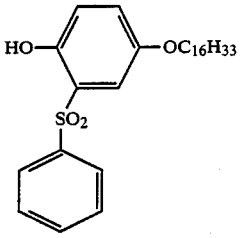

(X-4)

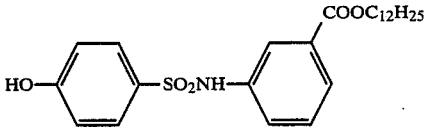

(X-5)

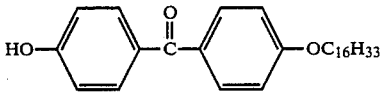

(X-6)

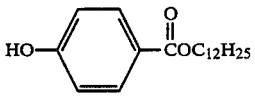

(X-7)

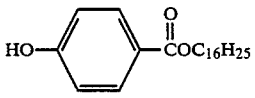

(X-8)

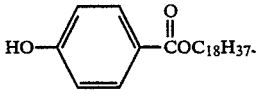

(X-9)

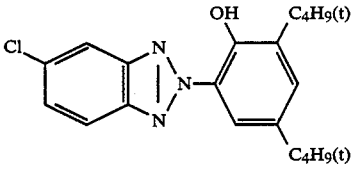

(X-10)

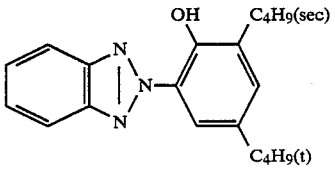

-continued (X-11)

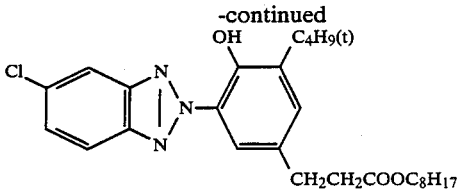

(X-12)

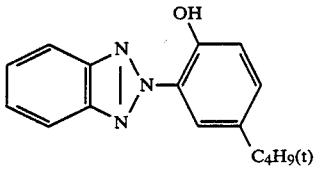

(X-13)

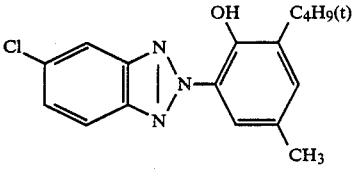

(X-14)

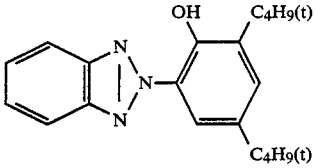

(X-15)

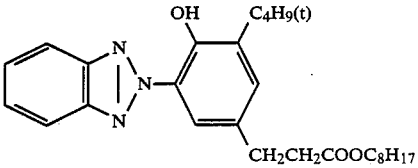

(X-16)

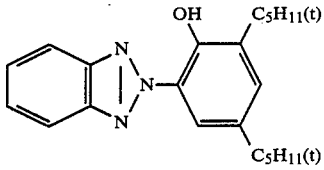

(X-17)

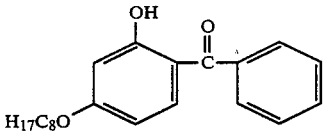

(X-18)

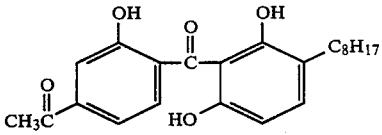

(X-19)

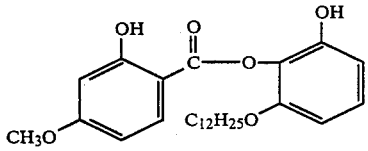

The silver halide emulsions used in the present invention are silver chlorobromide emulsions, which are essentially free of silver iodide, and which consist of silver chloride, silver bromide or mixed crystals of silver chloride and silver bromide, of which, in the main, the (100) plane is enclosed. Being "essentially free of silver iodide" means that the silver iodide content with respect to the total silver halide is not more than 3 mol % and preferably not more than 1 mol %. More preferably the emulsions have a silver iodide content of not more than 0.5 mol %, and most preferably the emulsions do not contain any silver iodide at all. The inclusion of silver iodide may increase light absorbance with respect to light sensitivity, and it may assist the adsorption of spectral sensitizing dyes, or it may lessen the extent of desensitization caused by the use of spectral sensitizing dyes. It has often been found to be useful in these respects in the past, but the inclusion of silver iodide is extremely disadvantageous in systems where the technique of this invention is employed in that when rapid development is to be carried out in a short period of time, it has a slow development rate and thus slows down the development rate of the silver halide grains as a whole. The inclusion of not more than 0.4 mol % of silver iodide is useful for promoting the adsorption of spectral sensitizing dyes, etc., but in this invention the use of silver halide emulsions which are essentially silver iodide free is preferred.

The silver chlorobromide which is used in the invention can have any composition ratio and it may consist of pure silver chloride, pure silver bromide or it may have an intermediate composition. It may also contain trace amounts of silver iodide as described above.

The preferred silver halide for use in the invention is a silver chlorobromide which has a silver bromide content of at least 10 mol %. A silver bromide content of at least 30 mol % is preferred for providing emulsions which have adequate sensitivity without increased fogging, but the use of at most 20 mol % or at most 10 mol % is preferred in cases where speed is required.

In cases where speed is of particular importance in systems where the technique of this invention is being used, the use of an essentially silver bromide free silver chloride, which has a silver bromide content of at most 3 mol %, and preferably of at most 1 mol %, is especially preferred.

Not only is the speed of development improved when the silver bromide content is low, but the developing speed of the developer itself is also increased. The developing speed is increased because the equilibrium bromide ion concentration which accumulates in the developer and which is determined in connection with the replenishment rate when running photosensitive material containing silver bromide through the processing solutions is lower. This is desirable.

An emulsion with a higher silver bromide content is desirable for obtaining photosensitive materials which are not liable to ogging, and which have a stable gradation. A silver bromide content of at least 50 mol % is preferred in such a case. Moreover, very stable emulsions are obtained when the silver bromide content is not less than 65 mol %. This is desirable. The developing speed is somewhat reduced when the silver bromide content exceeds 95 mol %, but if development accelerators, for example, 3-pyrazolidones, thioethers, hydrazines, etc., are concurrently used, the developing speed can be restored. High speed photosensitive materials which are stable on storage and in processing can be obtained in this way.

The developing properties of silver halide grains are determined not only by the halogen composition of the grain as a whole, but also to a large extent by the way in which the halogens are distributed within the grain. Hence, in this invention the silver halide emulsion can have grains in which there is a distribution or structure to the halogen composition. The double structure or core-shell type grains, in which the interior and the surface of the grain have different compositions, provide typical examples of such structures. In grains of this type, the form of the core and the form of the whole with the shell affixed may be the same or different. Typically, the core part has a cubic form and the form of the grains to which the shell has been attached is also cubic, or the core part is octagonal and the shell grains have a cubic form. Furthermore, although the core part consists of precise regular grains, the form of the grains with an attached shell is somewhat irregular. Furthermore, it is possible to achieve not just simple double layer structures but also triple layer structures and multilayer structures, and to attach thin layers of silver halides of different compositions to the surface of grains which have such a core-shell double structure.

As well as grains which have enveloped structures of the type described above, grains which have a so-called cemented structure can also be prepared in order to provide a structure within the grains. Cemented crystals have a composition which differs from that of the crystals which form the host, and they can be formed on the edges and corner parts, or on the surface parts, of the host crystals. Cemented crystals of this type can be formed on host crystals which have a uniform halogen composition or on host crystals which have a core-shell type structure. Host grains which have these structures may, in the case of a core-shell type, for example, have a core part which has a high silver bromide content and a shell part which has a low silver bromide content, or this can be reversed. Similarly, grains which themselves have a cemented structure may be such that the host crystal has a high silver bromide content and the cemented crystal has a relatively low silver bromide content, or again, this can be reversed. The detailed description about the cemented crystals as stated above is included in, for example, the specifications of Japanese Patent Application (OPI) Nos. 7040/80 and 89949/87.

Furthermore, the boundary region where the halogen composition changes in grains which have structures of this type may be a distinct boundary, or an indistinct boundary with the formation of mixed crystals due to the difference in composition or, alternatively, the structure may undergo a positive and continuous change.

In this invention the use of emulsions consisting of core-shell grains or cemented grains of the type described above which have a structure of some kind is preferable to the use of grains which have a uniform internal composition with respect to the halogen composition. The use of grains which have a halogen structure in which the silver bromide content is lower at the grain surface than within the grain is particularly preferred. Typical emulsions are those of the core-shell type in which the core part has a silver bromide content which is higher than that of the shell. The mol ratio of the core and shell parts of the structure can take any value between 0/100 and 100/0, but to ensure a clear distinction from grains of uniform structure, the value of this ratio is preferably between 3/97 and 98/2. In cases where the formation of the shell part is carried out by so-called halogen exchange, making use of the difference in solubility due to the type of halogen of the silver halide, and especially in the case of the halogen exchange of silver chloride using a bromine-containing compound, a ratio of not more than 98/2 is most preferred. A ratio of less than 99/1 is particularly desirable. Obviously, it is difficult in practice to cover the grain surfaces uniformly by means of halogen exchange, and irregular attachment takes place at the corner and edge parts. Halogen exchanged grains of this type can be provided with a uniform halogen distribution by, for example, Ostwald ripening, but both grains in which the distribution has been rendered uniform in this way and grains in which the form obtained immediately after halogen exchange has been retained can be used for the emulsion of this invention provided that they are, in the main, enclosed on the (100) plane.

When silver halide grains of the core-shell type are used in systems in which the technique of this invention is being employed, the preferred core and shell ratio is between 5/95 and 95/5, and more preferably between 7/93 and 90/10. The most preferable ratio is between 15/85 and 80/20. The difference between the silver bromide content of the core and shell parts differs according to the mol ratio of the core and shell part structure. However, it is preferably at least 3 mol % and at most 95 mol %. More preferably, it is at least 5 mol % and at most 80 mol %, and most preferably it is at least 10 mol % and at most 70 mol %. If the silver bromide content of the core and shell parts are not much different, the situation is much the same as that of grains which have a uniform structure. If the difference in composition is too great, difficulties are liable to arise with respect to pressure resistance and other aspects of performance, which are not desirable. The appropriate composition difference depends on the composition ratio of the core and shell parts. A large composition difference is preferred as the structure ratio approaches 0/100 or 100/0, and a smaller composition difference is preferred as the structure ratio approaches 50/50.

The form of the silver chlorobromide which is used in the invention may be cubic, rectangular parallelepipedal, tetradecahedral of some other shape provided that, in the main, it is enclosed on the (100) plane. In the case of grains of the cemented type, in particular, the cemented crystals are formed uniformly on the corner and edges, or on the surfaces of the host crystal. However, even in case such as this, the crystal grains can be enclosed principally on the (100) plane. In this invention the use of cubic and tetradecahedral grains, or again the use of cemented type grains approaching these forms, is preferred. The use of cubic grains is particularly preferred.

The average size (i.e., the average of the diameters of the volumes calculated as the corresponding spheres) of the grains in the silver halide emulsions used in the present invention is preferably at most 2 μm and at least 0.1 μm. Most desirably the particle size is at most 1.4 μm and at least 0.15 μm.

A narrow grain size distribution is preferred and, therefore, a monodispersed emulsion is most desirable. Monodispersed emulsions which have a regular form are particularly preferred in this invention. Emulsions in which at least 85% and preferably at least 90%, in terms of grain numbers or weight, of all the grains are within ±20% of the average grain size are preferred. Even in the case of monodispersed emulsions of this type, emulsions consisting of silver halide grains which have some sort of structure as described above are particularly preferred. Moreover, the use of two or more monodispersed emulsions of this type, especially cubic and tetradecahedral monodispersed emulsions, in the form of mixtures or by coating as laminates provides the preferred results. When mixtures of two or more types of monodispersed emulsion are used, the mixture preferably has a mixing ratio calculated in terms of silver such that the proportion of each component is at least 5% and at most 95%. The average grain sizes of the emulsions to be mixed should be such that in terms of volume the difference is at least 1/1.1 and at most 1/8, and preferably the difference should be at least 1/1.2 and at most 1/6. When mixtures of two types of monodispersed emulsion are used, the mixing ratio in terms of silver content is preferably between 0 05/0.95 and 0.95/0.05, as mentioned above, and the most preferred range is from 0.1/0.9 to 0.9/0.1.

The silver chlorobromide emulsions used in the invention can be prepared using methods such as those disclosed in *Chemie et Physique Photographique*, P. Glafkides (1976), *Photographic Emulsion Chemistry*, G. F. Duffin (1966) and *Making and Coating Photographic Emulsion*, V. L. Zelikman et al. (1964). That is to say, the emulsions can be prepared using acidic methods, neutral methods and ammonia methods, etc., but the use of the acidic method is preferred. Furthermore, single jet mixing methods and simultaneous mixing methods can be used for reacting the soluble silver salts with the soluble halogen salts. Any combination of these methods can also be used. The simultaneous mixing method is preferred for obtaining the monodispersed grains of this invention. Methods in which the grains are formed under conditions of excess silver ion (the so-called reverse mixing methods) can also be used. The method in which the silver ion concentration of the liquid phase in which the silver halide is being formed is held constant (the so-called controlled double jet method) can be used as one form of simultaneous mixing method. It is possible to obtain the monodispersed silver halide emulsions which are suitable for use in this invention and which have a narrow grain size distribution and a regular crystal form by means of this method. Grains of the type mentioned, which are used for preference in the invention, are preferably prepared on the basis of a simultaneous mixing method.

Cadmium salt, zinc salts, lead salts, thallium salts, iridium salts or complexes thereof, rhodium salts or complexes thereof, iron salts or complexes thereof, etc., may be present during the processes in which the silver halide grains are formed or physically ripened.

The iridium salts or complexes thereof are used at concentration of $10^{-9}$ to $10^{-4}$ mol, and preferably at the concentration of $10^{-8}$ to $10^{-5}$ mol, per mol of silver halide. This is especially effective for providing rapid development properties and stability relative to that of an emulsion prepared without the use of an iridium salt or complex thereof when exposures are made at high and low brightness levels outside the appropriate range of illumination.

Monodispersed silver halide emulsions which have a regular crystalline form and a narrow grain size distribution are obtained when physical ripening is carried out in the presence of a known silver halide solvent (for example, ammonia, potassium thiocyanate or the thioethers and thione compounds disclosed in U.S. Pat. No. 3,271,157, Japanese Patent Application (OPI) Nos. 12360/76, 82408/78, 144319/78, 100717/79 and 155828/79, etc.) are preferred.

Noodle washing, flocculation sedimentation method, ultrafiltration, etc., can be used to remove the soluble salts from the emulsion after physical ripening.

The silver halide emulsions used in the invention can be chemically sensitized by sulfur sensitization, or selenium sensitization, reduction sensitization, precious metal sensitization, etc. These methods of sensitization can be used independently or in combination. That is to say, sulfur sensitization methods in which compounds which contain sulfur which is able to react with silver ions (for example, thiosulfates, thiourea compounds, mercapto compounds, rhodanine compounds, etc.) are used, reduction sensitization methods in which reducing substance (for example, stannous chloride, amines, hydrazine derivatives, formamidine sulfinic acid, silane compounds, etc.) are used and precious metal sensitization methods in which metal compounds (for example, gold complexes and complexes of metals of group VIII of the Periodic Table, namely, platinum, iridium, palladium, rhodium, iron, etc.) are used to chemically sensitize the silver halide emulsion and may be used independently or in combination. The use of sulfur sensitization or selenium sensitization is preferred for the monodispersed silver chlorobromide emulsions of this invention, and the sensitization is preferably carried out in the presence of hydroxyazaindene compounds.

The use of spectral sensitizing dyes is of importance in this invention. Cyanine dyes, merocyanine dyes and complex merocyanine dyes, etc., can be used as spectral sensitizing dyes in the invention. Complex cyanine dyes, holopolar cyanine dyes, hemicyanine dyes, styryl dyes and hemioxonol dyes can also be used. Simple cyanine dyes, carbocyanine dyes and dicarbocyanine dyes are preferred. These cyanine dyes can be represented by formula (I) indicated below.

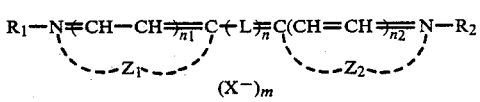

(I)

In this formula, L represents a methine group or a substituted methine group, $R_1$ and $R_2$ each represents an alkyl group or a substituted alkyl group, $Z_1$ and $Z_2$ each represents atomic groups which form a 5 -or 6-membered nitrogen-containing heterocyclic ring and X represents an anion. Moreover, n has a value of 1, 3 or 5, $n_1$ and $n_2$ are each 0 or 1, when n=5 both $n_1$ and $n_2$ are 0 and when n=3 then either one or both of $n_1$ or $n_2$ is 0. Moreover, m represents 0 or 1, being 0 when an intramolecular salt is formed. Furthermore, when n=5 the L groups may be linked to form a substituted or unsubstituted 5 - or 6-membered ring.

Cyanine dyes which can be represented by formula (I) are described in detail below.

The substituent groups of the substituted methine groups which are represented by L may be lower alkyl groups (for example, methyl groups, ethyl groups, etc.) or aralkyl groups (for example, benzyl groups, phenethyl groups, etc.).

The alkyl group residues represented by $R_1$ and $R_2$ may be linear or branched or, alternatively, they may be cyclic groups. No limitation is imposed on the number of carbon atoms in these groups, but a group of 1 to 8 carbon atoms is preferred, and groups having from 1 to 4 carbon atoms are most preferred. The substituent groups of the substituted alkyl groups can be, for example, sulfonic acid groups, carboxylic acid groups, hydroxyl groups, alkoxy groups, acyloxy groups, or aryl groups (for example, phenyl groups, substituted phenyl groups, etc.). These groups may be bonded to the alkyl groups individually or in combinations of two or more. Furthermore, the sulfonic acid and carboxylic acid groups may be in the form of salts with alkali metal ions or quaternary salts of organic amines. When two or more groups are involved, they may each be bonded to the alkyl group individually, or they may be linked together and then bonded to the alkyl group. Cases of the latter type include, for example, sulfoalkoxyalkyl groups, sulfoalkoxyalkoxyalkyl groups, carboxyalkoxyalkyl groups and sulfophenylalkyl groups, etc.

Actual examples of $R_1$ and $R_2$ include methyl groups, ethyl groups, n-propyl groups, n-butyl groups, vinylmethyl groups, 2-hydroxyethyl groups, 4-hydroxybutyl groups, 2-acetoxyethyl groups, 3-acetoxypropyl groups, 2-methoxyethyl groups, 4-methoxybutyl groups, 2-carboxyethyl groups, 3-carboxypropyl groups, 2-(2-carboxyethoxy)ethyl groups, 2-sulfoethyl groups, 3-sulfopropyl groups, 3-sulfobutyl groups, 4-sulfobutyl groups, 2-hydroxy-3-sulfopropyl groups, 2-(3-sulfopropoxy)ethyl groups, 2-acetoxy-3-sulfopropyl groups, 3-methoxy-2-(3-sulfopropoxy)propyl groups, 2-[2-(3-sulfopropoxy)ethoxy]-ethyl groups and 2-hydroxy-3-(3'-sulfopropoxy)propyl groups, etc.

Actual examples of the nitrogen-containing heterocyclic rings which are formed by $Z_1$ and $Z_2$ include the oxazole nucleus, the thiazole nucleus, the selenazole nucleus, the imidazole nucleus, the pyridine nucleus, the oxazoline nucleus, the thiazoline nucleus, the selenazoline nucleus, the imidazoline nucleus and systems in which these nuclei are condensed with a benzene ring, a naphthalene ring or some other saturated or unsaturated carbon ring. Furthermore, these nitrogen-containing heterocyclic rings may be bonded with substituent groups (for example, alkyl groups, trifluoromethyl groups, alkoxycarbonyl groups, cyano groups, carboxylic acid groups, carbamoyl groups, alkoxy groups, aryl groups, acyl groups, hydroxyl groups, halogen atoms, etc.).

The anion which is represented by X may be $Cl^-$, $Br^-$, $I^-$, $SO_4^-$, $NO_3^-$, $ClO_4^-$, etc.

Actual examples of cyanine dyes which can be represented by formula (I) are indicated below.

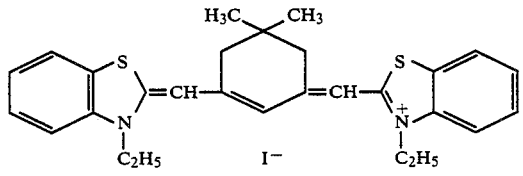

(V-1)

-continued
(V-2)
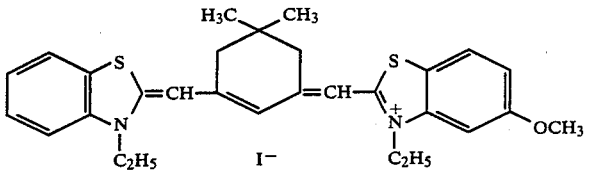
(V-3)
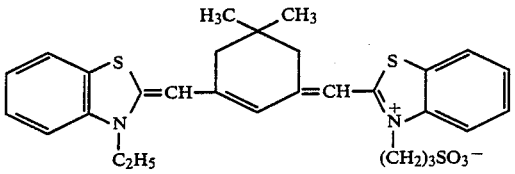
(V-4)
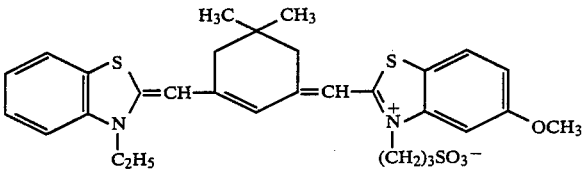
(V-5)
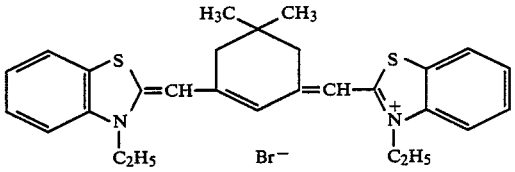
(V-6)
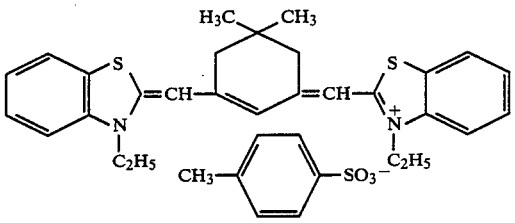
(V-7)
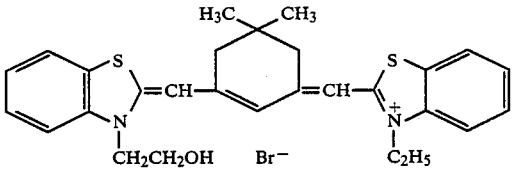
(V-8)
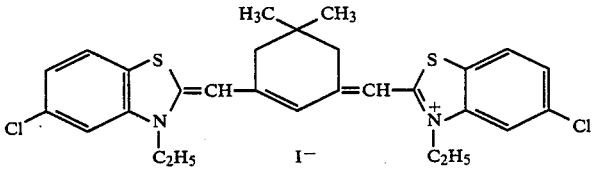
(V-9)
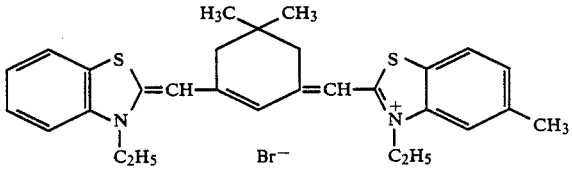

-continued
(V-10)
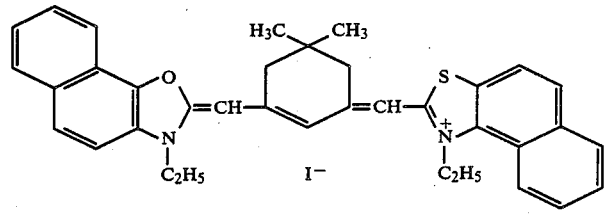
(V-11)
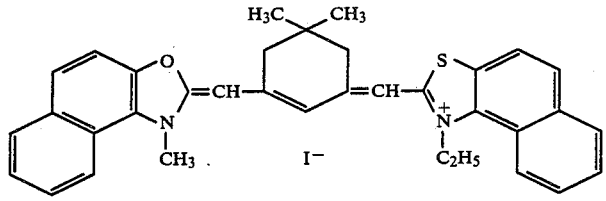
(V-12)
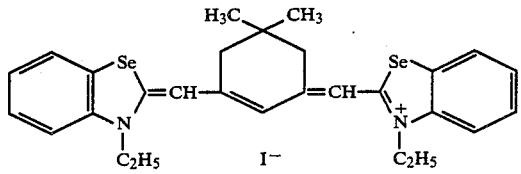
(V-13)
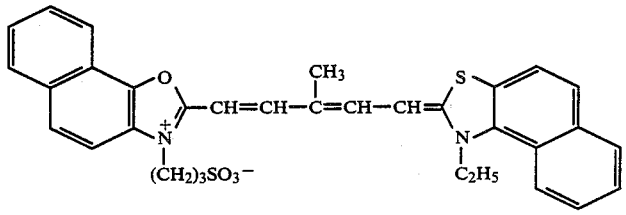
(V-14)
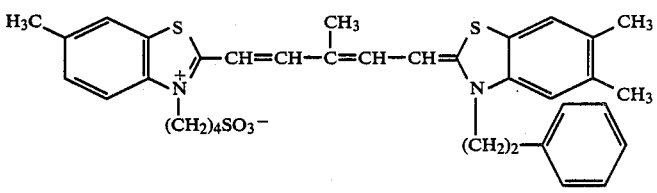
(V-15)
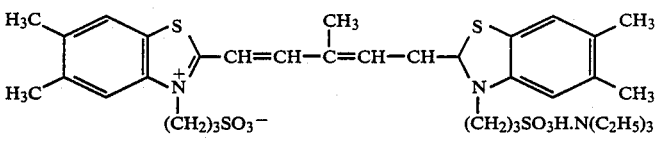
(V-16)
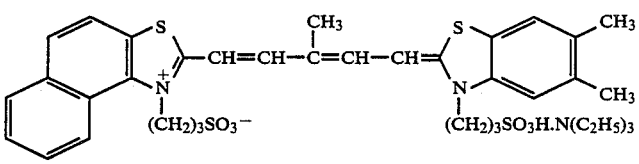
(V-17)
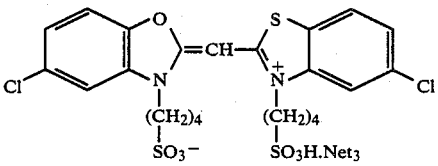

-continued
(V-18)
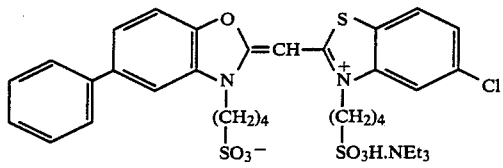
(V-19)
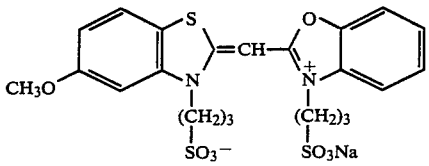
(V-20)
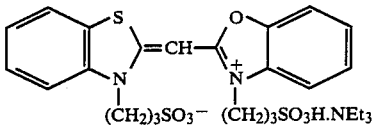
(V-21)
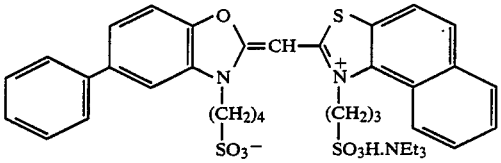
(V-22)
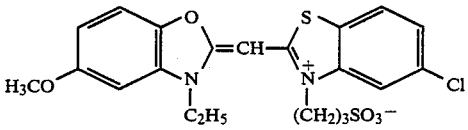
(V-23)
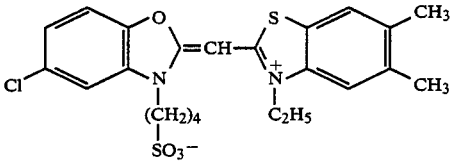
(V-24)
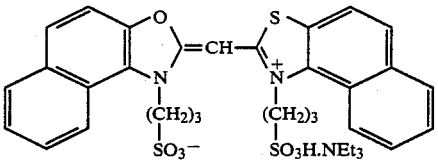
(V-25)
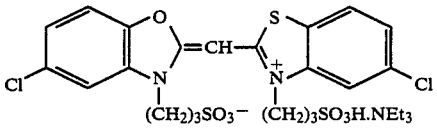
(V-26)
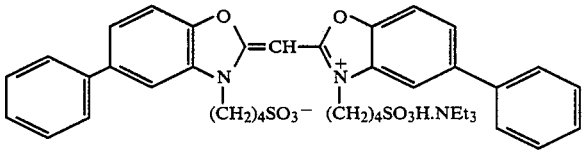

-continued
(V-27)
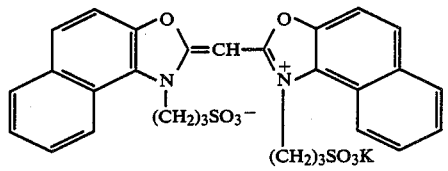
(V-28)
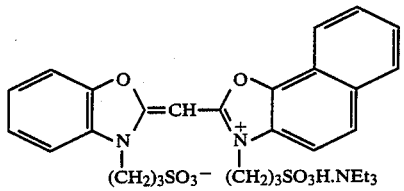
(V-29)
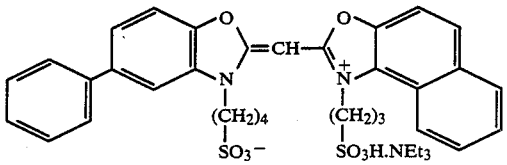
(V-30)
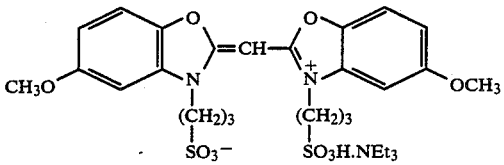
(V-31)
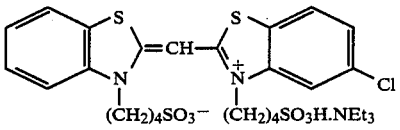
(V-32)
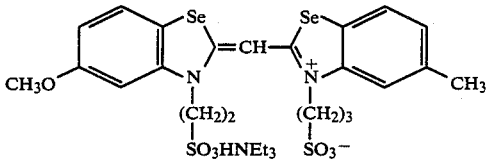
(V-33)
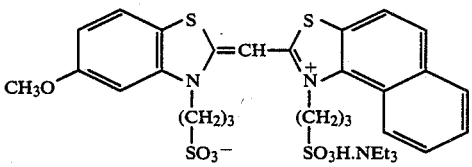
(V-34)
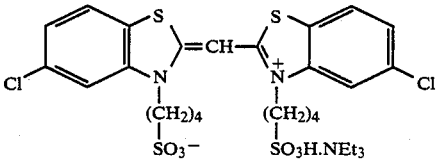

-continued
(V-35)
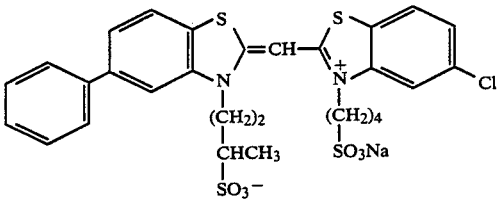
(V-36)
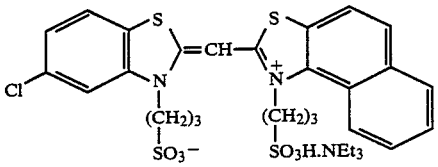
(V-37)
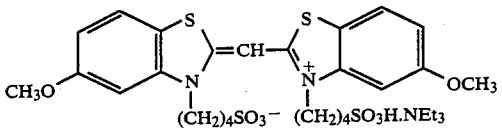
(V-38)
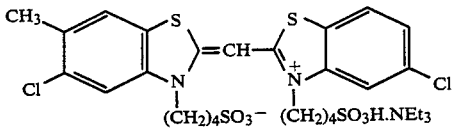
(V-39)
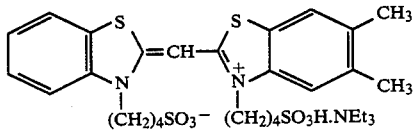
(V-40)
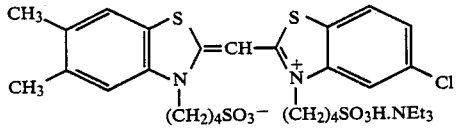
(V-41)
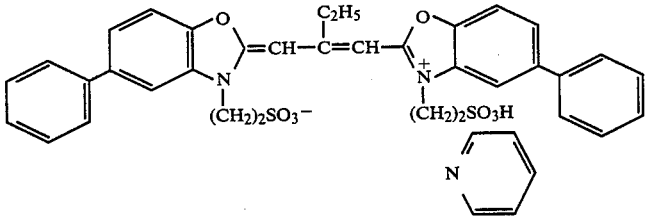
(V-42)
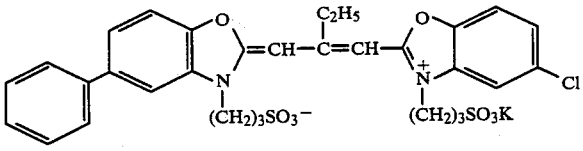
(V-43)
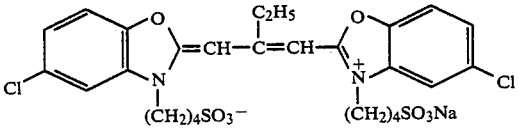

-continued
(V-44)
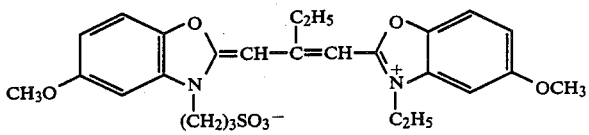
(V-45)
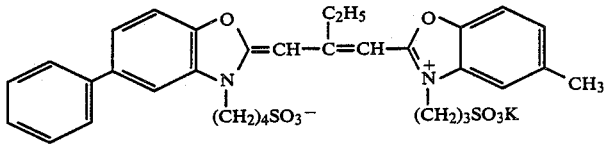
(V-46)
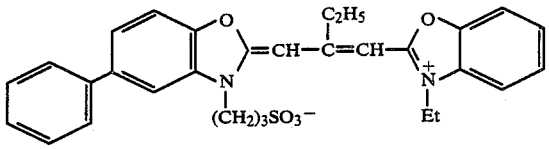
(V-47)
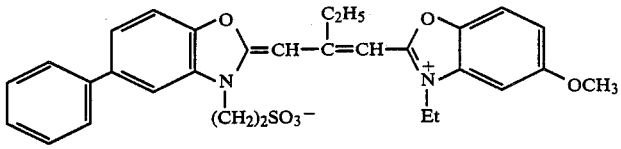
(V-48)
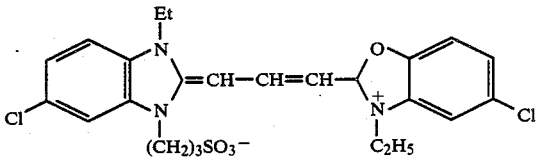
(V-49)
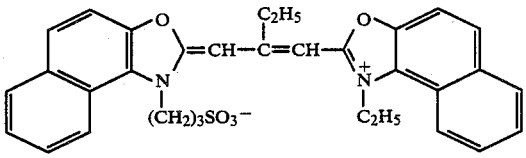
(V-50)
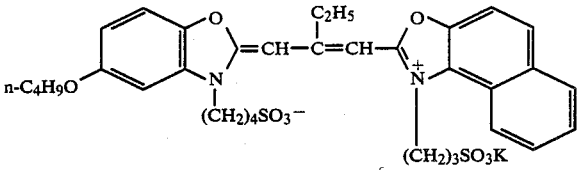
(V-51)
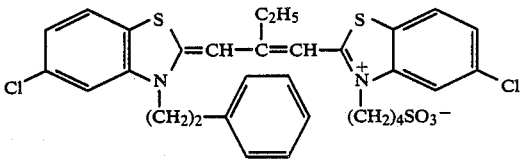
(V-52)
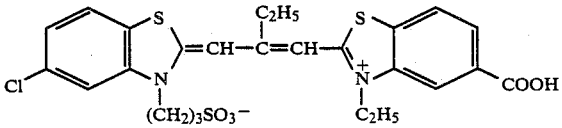

-continued (V-53)

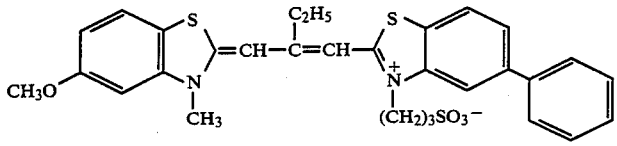

(V-54)

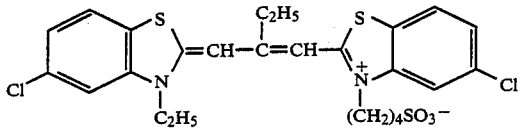

(V-55)

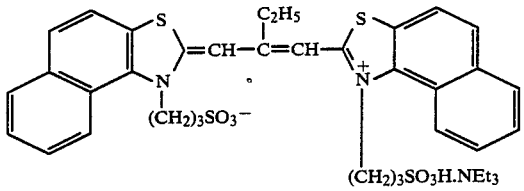

(V-56)

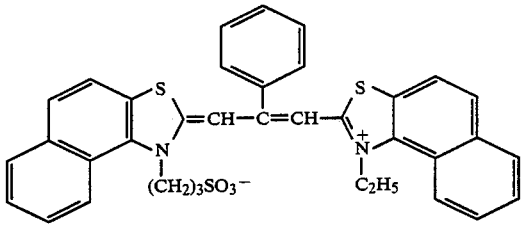

A 5- or 6-membered nucleus, such as a pyrazoline-5-one nucleus, a thiohydantoin nucleus, a 2-thiooxazolidine-2,4-dione nucleus, a thiazolidine-2,4-dione nucleus, a rhodanine nucleus or a thiobarbituric acid nucleus, etc., can be incorporated as the nucleus which has a ketomethylene structure in the merocyanine dyes or complex merocyanine dyes.

Spectral sensitizing dyes other than those described above, which incorporate a pyrroline nucleus, an oxazoline nucleus, a thiazoline nucleus, a pyrrole nucleus, a thiazole nucleus, an oxazole nucleus, a selenazole nucleus, an imidazole nucleus, a tetrazole nucleus or a pyridine nucleus or a nucleus in which these rings are fused with an alicyclic hydrocarbon ring or an aromatic hydrocarbon ring, can also be used in the invention.

Useful spectral sensitizing dyes are disclosed, for example, in German Patent No. 929,080, U.S. Pat. No. 2,231,658, 2,493,748, 2,503,776, 2,519,001, 2,912,329, 3,656,959, 3,672,897, 3,694,217, 4,025,349 and 4,046,572, British Patent No. 1,242,588 and Japanese Patent Publication Nos. 14030/69 and 24844/77.

Of the dyes referred to above, the use of those which have a benzothiazole nucleus or a benzoxazole nucleus are preferred in this invention. The use of simple cyanine dyes which have a benzothiazole nucleus, carbocyanine dyes which have a benzoxazole nucleus and dicarbocyanine dyes which have a benzothiazole nucleus is more preferred.

Normally, methods in which the spectral sensitizing dye is adsorbed on the surface of the grains after the grains have been formed completely are used to achieve the spectral sensitization of silver halide emulsions. On the other hand, methods in which a merocyanine dye is added during the precipitation and formation of the silver halide grains is disclosed in U.S. Pat. No. 2,735,766. This enables the amount of unadsorbed dye to be reduced. Furthermore, a method in which the spectral sensitizing dye is added and adsorbed during the addition of the aqueous silver salt solution and the aqueous halide solution, which are used to form the silver halide crystal grains, is disclosed in Japanese Patent Application (OPI) No. 26589/80. Thus, the addition of the spectral sensitizing dye can be made during the formation of the silver halide crystal grains after the formation of the crystal grains has been completed or before forming the crystal grains. In practice, there are methods in which the spectral sensitizing dye is introduced into the reaction vessel before starting the reaction in which the silver halide crystals are formed in the case of addition before formation of the crystal grains. Also, there exist methods, such as those disclosed in the aforementioned patent specifications, wherein addition during grain formation, and addition after grain formation, the dyes are added and adsorbed after the grain formation has been essentially completed. The silver halide emulsions of this invention are chemically sensitized after grain formation has been completed, and the addition of the spectral sensitizing dyes after grain formation has been completed may take place before the start of chemical sensitization, during the chemical sensitization or after the chemical sensitization as been completed. Moreover, it can also be carried out when the emulsion is being coated. In this invention, the addition of spectral sensitizing dyes of the type described above is preferably achieved by adding and adsorbing the dye in at least one process at any stage after the process in which the formation of the silver halide grains has been essentially completed. The dyes may be together or divided and added in two or more processes. Even when added during a single process, the addition can be intensive over a short time or continuous over a longer period of time. Moreover, combinations of these methods of addition can be used.

The spectral sensitizing dyes may be added as untreated crystals or as powders, but they are preferably added using some method of dissolution or dispersion. Water-soluble solvents such as alcohols with from 1 to 3 carbon atoms, acetone, pyridine and methyl cellosolve or mixtures of these solvents can be used for dissolution. Moreover, surfactants can be used to form micelle dispersions or other types of dispersion.

The amount of spectral sensitizing dye added is determined in accordance with the intended purpose of the spectral sensitization and the silver halide emulsion content, but it is normally from $1\times10^{-6}$ to $1\times10^{-2}$ mol/mol of silver halide, and preferably from $1\times10^{-5}$ to $5\times10^{-3}$ mol/mol of silver halide.

The spectral sensitizing dyes used in the invention can be used individually or in combinations of two or more. Dyes which do not by themselves have any spectral sensitizing action, or strong color sensitizers of the type which have essentially no absorption in the visible region but which reinforce the sensitizing action of the spectral sensitizing dyes, may be included together with the spectral sensitizing dyes.

In this invention, the aminostilbene based compounds which are substituted with nitrogen-containing heterocyclic groups (for example, those disclosed in U.S. Pat. Nos. 2,933,390 or 3,635,721) are effective for reducing the residual color of the aforementioned carbocyanine dyes having an oxazole nucleus, and for improving the color sensitization properties of the dicarbocyanine dyes which have a benzothiazole nucleus or a benzoxazole nucleus. Therefore, the concurrent use of these compounds is preferred. Furthermore, azaindene compounds, especially hydroxyazaindene compounds, are also preferably used for improving color sensitization.

Thus, 4,4-bis(s-triazinylamino)stilbene-2,2'-disulfonic acid or 4,4'-bis(pyrimidenylamino)stilbene-2,2'-disulfonic acid or the alkali metal salts of these acids are preferred aminostilbene compounds for use in the invention. In these compounds, the s-triazine ring or the pyrimidine ring is more preferably substituted in the 1- or 2-position with a substituted or unsubstituted arylamino group, a substituted or unsubstituted alkylamino group, a substituted or unsubstituted aryloxy group, a substituted or unsubstituted alkyloxy group or a hydroxyl group or an amino group, etc. Substitution of these parts with substituent groups having a high water solubility is preferred with respect to reducing residual coloration. Substituent groups which have a high water solubility are those which contain, for example, a sulfonic acid group or a hydroxyl group.

These compounds can be represented by formula (F) indicated below.

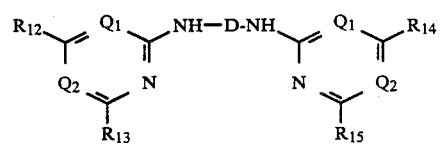

(F)

In this formula, D represents a divalent aromatic residual group and $R_{12}$, $R_{13}$, $R_{14}$ and $R_{15}$ each represents a hydrogen atom, a hydroxyl group, an alkoxy group, an aryloxy group, a halogen atom, a heterocyclic group, a mercapto group, an alkylthio group, an arylthio group, a heterocyclylthio group, an amino group, an alkylamino group, a cyclohexylamino group, an arylamino group, a heterocyclylamino group, an aralkylamino group or an aryl group.

$Q_1$ and $Q_2$ each represents an —N= group, or a —C= group. However, at least one of $Q_1$ and $Q_2$ is an —N= group.

Examples of particularly preferred compounds for use in the invention are indicated below.

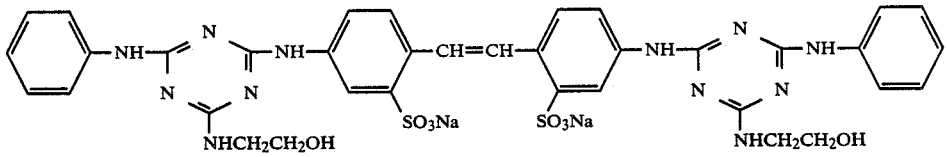

(F-1)

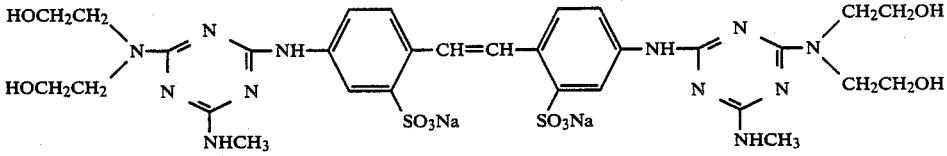

(F-2)

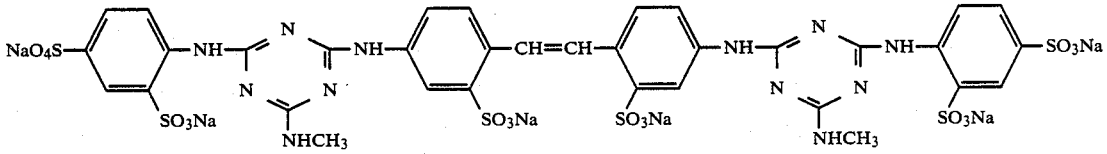

(F-3)

-continued
(F-4)
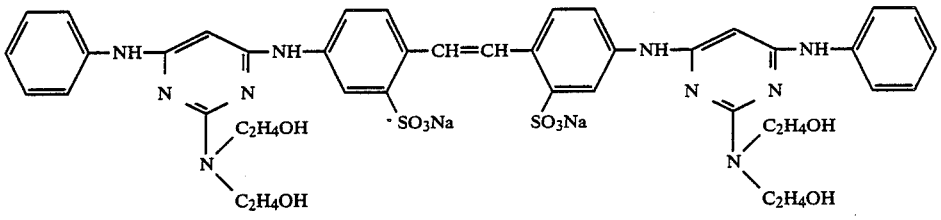
(F-5)
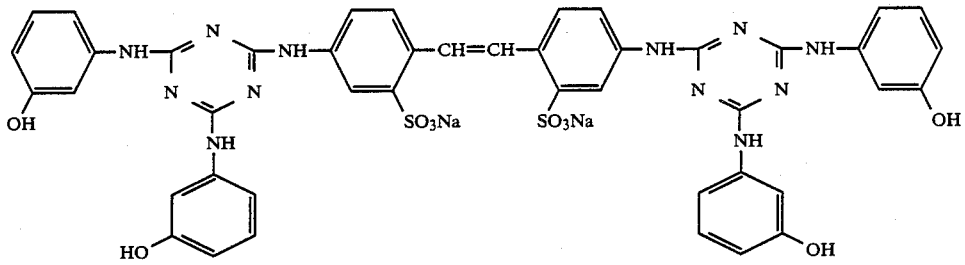
(F-6)
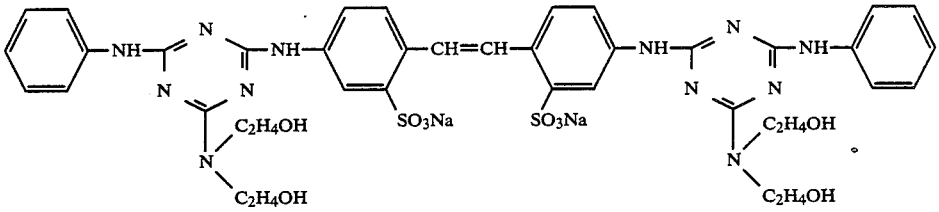
(F-7)
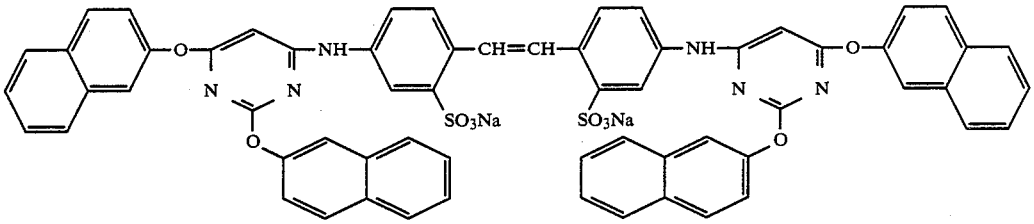
(F-8)
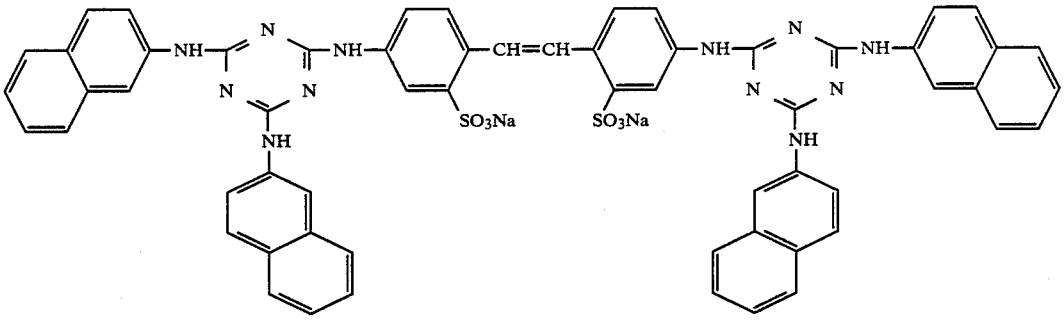
(F-9)
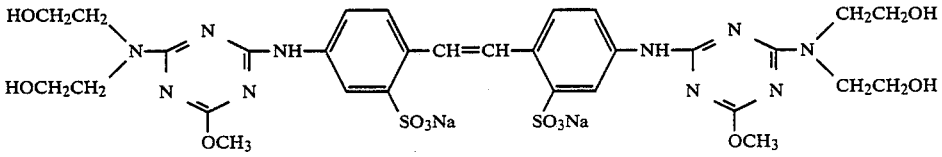

-continued
(F-10)
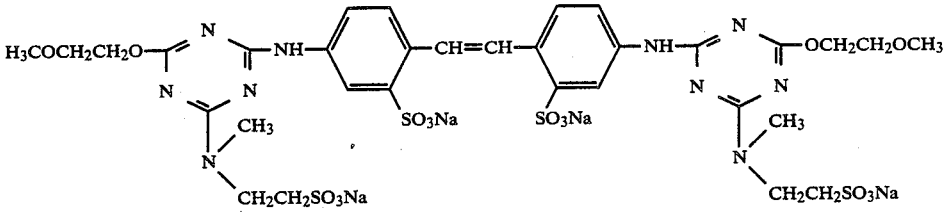
(F-11)
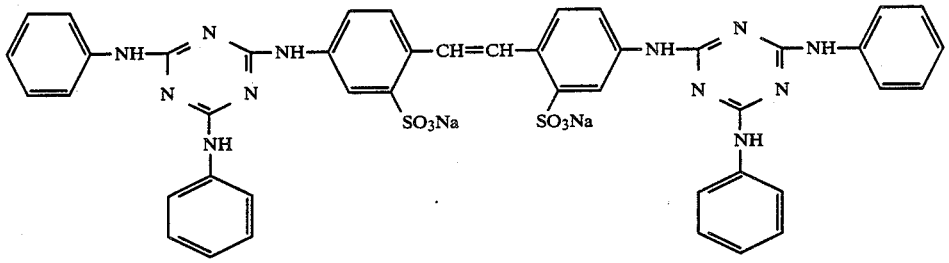
(F-12)
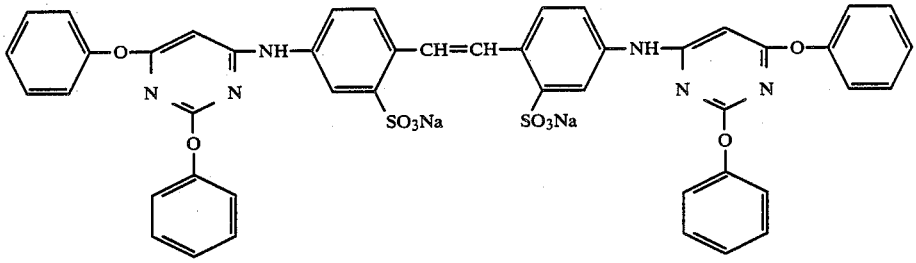
(F-13)
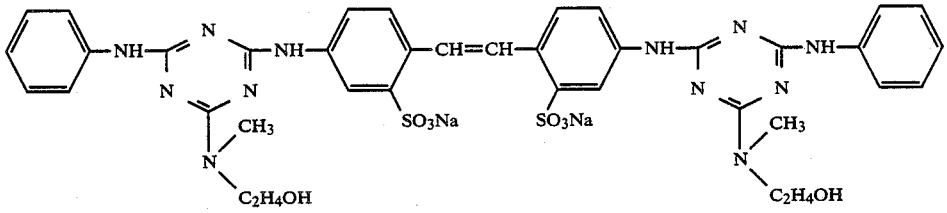
(F-14)
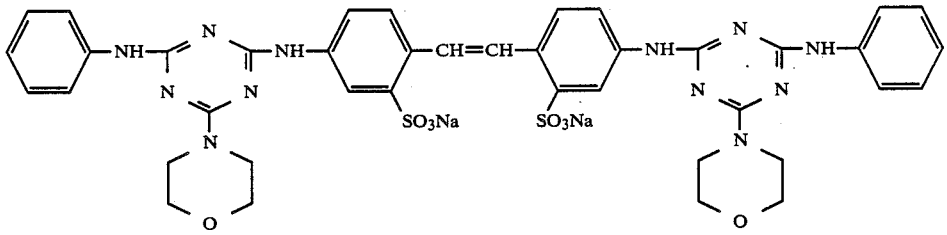
(F-15)
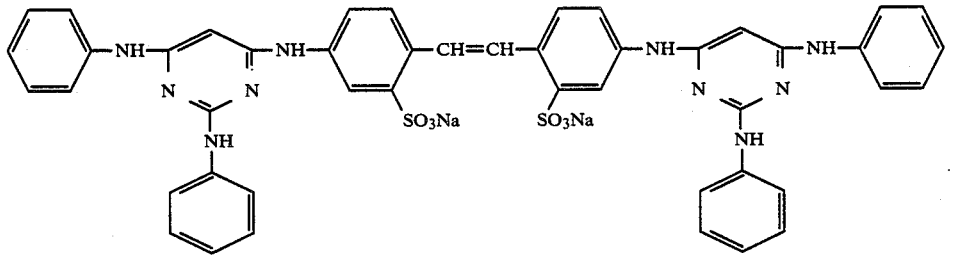

-continued
(F-16)
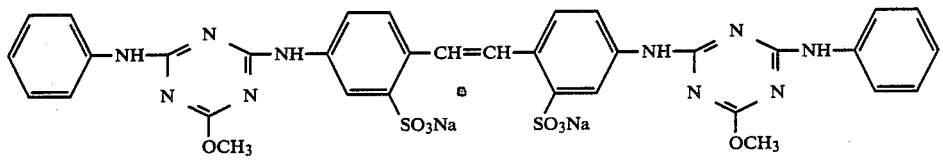
(F-17)
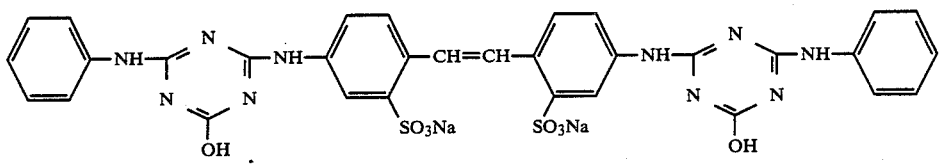
(F-18)
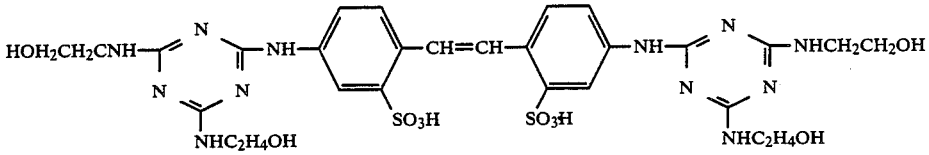
(F-19)
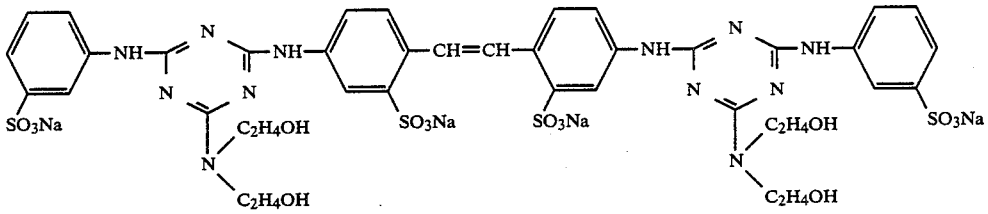
(F-20)
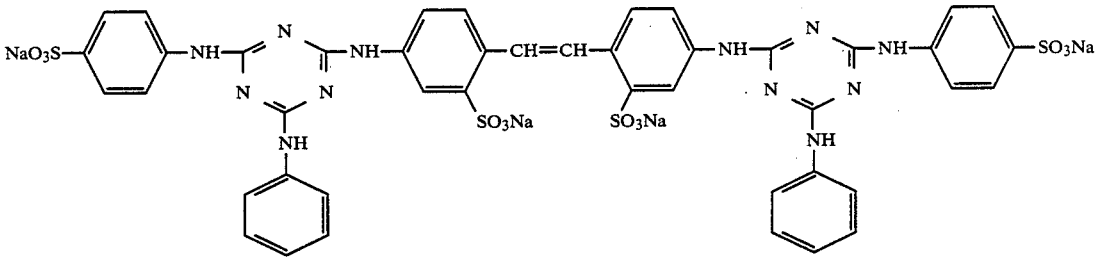
(F-21)
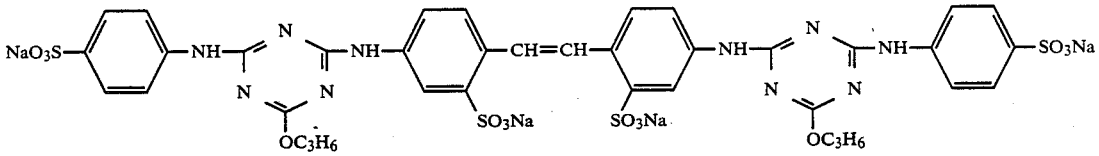
(F-22)
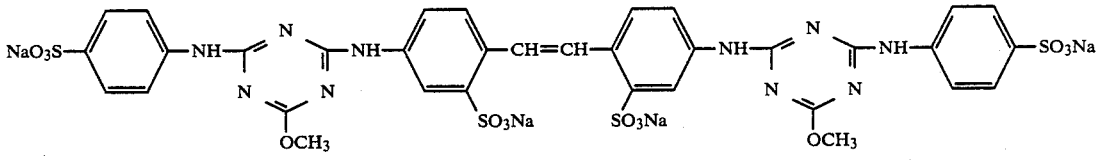
(F-23)
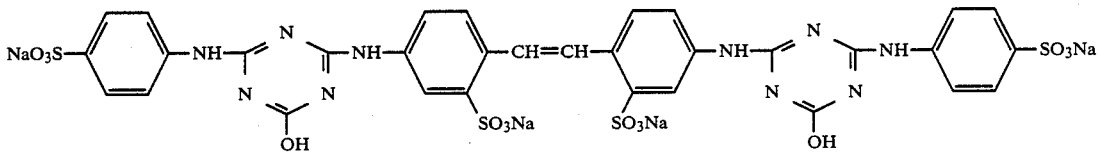

-continued (F-24)

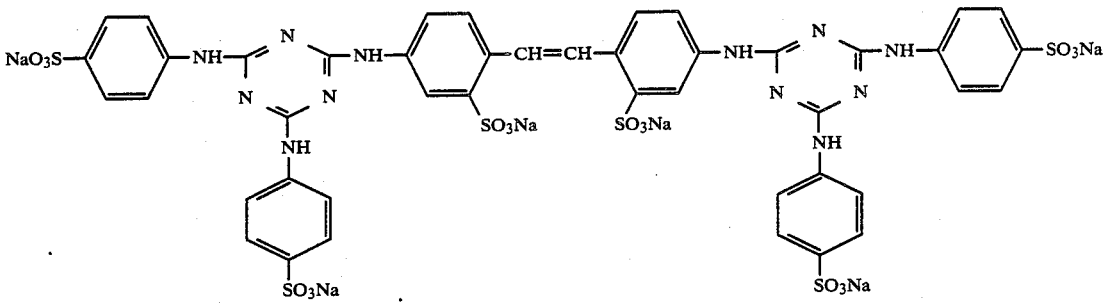

The following compounds may be added to, and included in, the silver halide emulsion of this invention during the manufacture of the photographic photosensitive material, to prevent the occurrence of fogging during the storage of the material prior to development or during the development process, and to raise the stability of the photographic characteristics of the material. Thus, initially there are the heterocyclic mercapto compounds (for example, the mercaptothiadiazoles, mercaptotetrazoles, mercaptobenzimidazoles, mercaptobenzothiazoles, mercaptopyrimidines and the mercaptothiazoles, etc.); secondly, there are the heterocyclic mercapto compounds mentioned above, which have water-soluble groups such as carboxyl groups and sulfone groups, etc.; thirdly, there are the azoles (for example, the benzothiazolium salts, nitroindazoles, triazoles, benzotriazoles and the benzimidazoles (especially those with nitro substituents and halogen substituents)); fourthly, there are the thioketo compounds (for example, oxazolidinethione, etc.); and fifthly, there are the azaindenes (for example, the tetraazaindenes, etc., and moreover, the benzenethiosulfinic acids and benzenesulfinic acids, etc.). The use of the heterocyclic mercapto compounds and the azaindenes is particularly preferred in this invention. The preferred azaindenes can be selected from among the compounds represented by formulae (IIIa) and (IIIb) indicated below.

(IIIa)

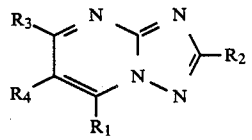

In this formula $R_1$, $R_2$, $R_3$ and $R_4$ may be the same or different, and may represent hydroxyl groups, alkyl groups, alkenyl groups, aryl groups, cyano groups, ureido groups, amino groups, halogen atoms or hydrogen atoms. However, one or two hydroxyl groups must be included.

The above-mentioned alkyl groups, alkenyl groups, aryl groups, ureido groups and amino groups are the same as those in formula (Ia), which is described later. The preferred substituents of the alkyl groups are aryl groups, alkoxycarbonyl groups, carbamoyl groups, cyano groups, amino groups and sulfonamido groups, etc.

Furthermore, $R_3$ and $R_4$ can be joined together to form a 5- or 6-membered saturated or unsaturated ring.

(IIIb)

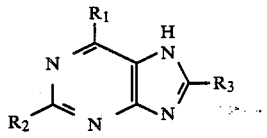

In this formula, $R_1$, $R_2$ and $R_3$ are the same as $R_1$ and $R_2$ in formula (IIIa), but it is not necessary for at least one of these groups to be a hydroxyl group as in formula (IIIa).

Actual examples of these compounds are indicated below.

(m-1)

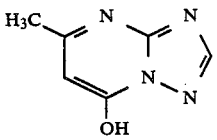

(m-2)

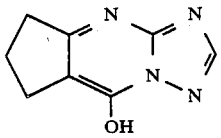

(m-3)

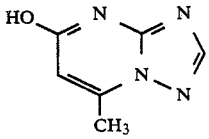

(m-4)

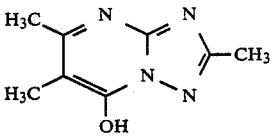

(m-5)

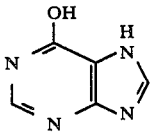

(m-6)

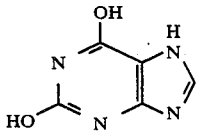

-continued (m-7)

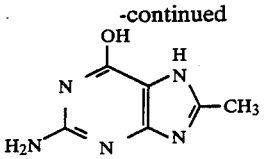

(m-8)

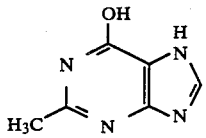

(m-9)

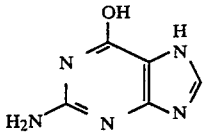

(m-10)

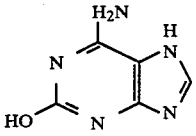

(m-11)

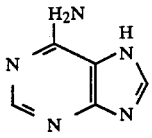

The preferred mercaptotetrazole based compounds can be selected from among the compounds represented by formula (Ia).

(Ia)

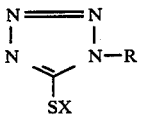

In this formula, R represents an alkyl group, an alkenyl group or an aryl group. X represents a hydrogen atom, an alkali metal atom or an ammonium group or a precursor. The alkali metal atom is, for example, a sodium atom or a potassium atom, and the ammonium group is, for example, a trimethylammonium chloride group, a dimethylbenzylammonium chloride group, etc. Furthermore, precursors are groups which change to a hydrogen atom or alkali metal under alkaline conditions, for example, acetyl groups, cyanoethyl groups, methanesulfonylethyl groups, etc.

The alkyl and alkenyl groups included in the aforementioned R groups may be unsubstituted or substituted, and moreover, they include alicyclic groups. The substituent groups of the substituted alkyl groups may be halogen atom, alkoxy groups, aryl groups, acylamino groups, alkoxycarbonylamino groups, ureido groups, hydroxyl groups, amino groups, heterocyclic groups, acyl groups, sulfamoyl groups, sulfonamido groups, thioureido groups, carbamoyl groups, and also carboxylic acid groups, sulfonic acid groups and salts thereof, etc.

The above-mentioned ureido groups, thioureido groups, sulfamoyl groups, carbamoyl groups and amino groups include the unsubstituted groups and the N-alkyl and N-aryl substituted groups. Phenyl groups and substituted phenyl groups are examples of aryl groups, and these can be substituted with alkyl groups or substituted alkyl groups as indicated above.

Furthermore, the preferred mercaptothiadiazole compounds can be selected from among the compounds represented by formula (IIa) below.

(IIa)

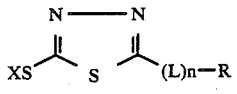

In this formula, L represents a divalent linking group and R represents a hydrogen atom, an alkyl group, an alkenyl group or an aryl group. The alkyl groups and alkenyl groups represented by R, and X, are the same as those in the case of formula (Ia).

Examples of the above-mentioned divalent linking groups which are represented by L include

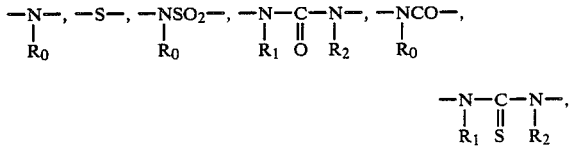

etc. Here, n is 0 or 1, and $R_0$, $R_1$ and $R_2$ each represents a hydrogen atom, an alkyl group or an aralkyl group. Actual examples of these compounds are indicated below.

(I-1)

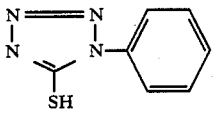

(I-2)

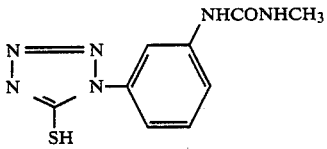

(I-3)

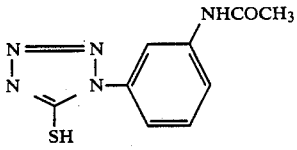

(I-4)

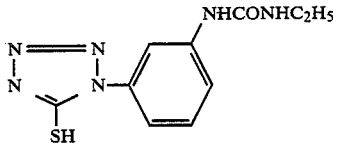

(I-5)

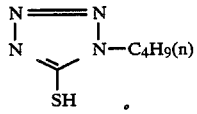

(I-6)

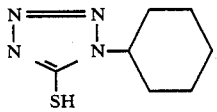

-continued (I-7)

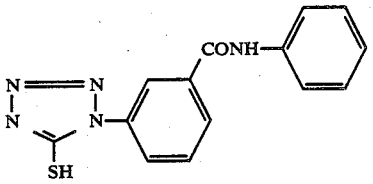

(I-8)

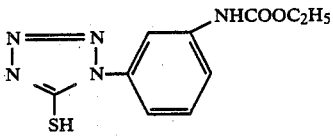

(I-9)

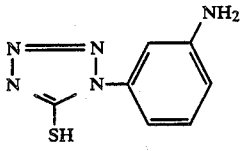

(I-10)

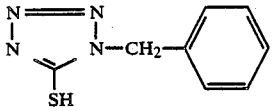

(I-11)

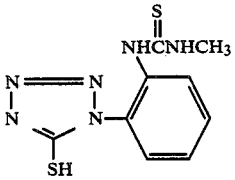

(I-12)

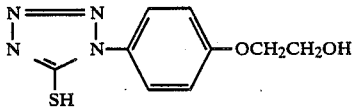

(II-1)

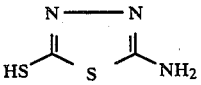

(II-2)

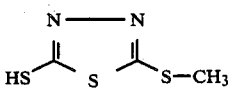

(II-3)

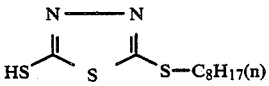

(II-4)

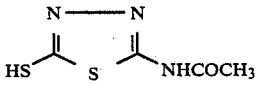

(II-5)

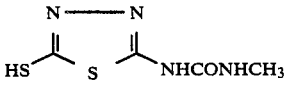

-continued (II-6)

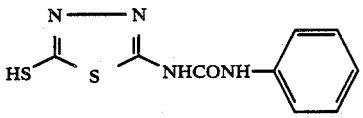

The use of dyes of the type indicated below, in such a way that there is no loss of sensitivity, no worsening of the latent image stability, no adverse effect on the other photographic characteristics of the material and no lowering of the quality due to residual color after processing, is preferred in this invention for raising the stability with respect to so-called safelight, and preventing irradiation during exposure or printing.

Other dyes such as anthraquinone based dyes can also be used as well as these pyrazoloneoxazole dyes.

The preferred pyrazoloneoxazole dyes are compounds which can be represented by formula (D) below.

(D)

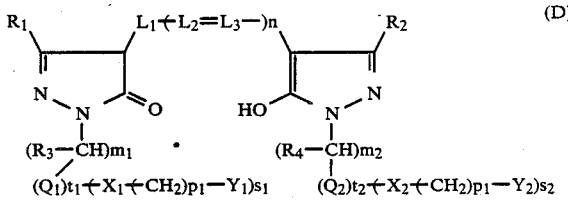

In this formula, $R_1$ and $R_2$ each represents a $-COOR_5$ group or a $$-\underset{\underset{R_6}{|}}{CON}-R_5$$

group. $R_3$ and $R_4$ each represents a hydrogen atom, an alkyl group or a substituted alkyl group (for example, a methyl group, an ethyl group, a butyl group, or a hydroxyethyl group, etc.), and $R_5$ and $R_6$ each represents a hydrogen atom, an alkyl group or a substituted alkyl group (for example, a methyl group, an ethyl group, a butyl group, a hydroxyethyl group or a phenethyl group, etc.), an aryl group or a substituted aryl group (for example, a phenyl group or a hydroxyphenyl group, etc.). $Q_1$ and $Q_2$ each represents an aryl group (for example, a phenyl group or a naphthyl group, etc.). $X_1$ and $X_2$ represent bonds or divalent linking groups, and $Y_1$ and $Y_2$ each represents a sulfo group or a carboxyl group. $L_1$, $L_2$ and $L_3$ each represents a methine group. Here, $m_1$ and $m_2$ have values of 0, 1 or 2; n has a value of 0, 1 or 2; $p_1$ and $p_2$ each has values of 0, 1, 2, 3 or 4; $s_1$ and $s_2$ each has values of 1 or 2 and $t_1$ and $t_2$ each has values of 0 or 1. However, $m_1$, $p_1$ and $t_1$, or $m_2$, $p_2$ and $t_2$ may not all have a value of zero at the same time.

Actual examples of these compounds are indicated below.

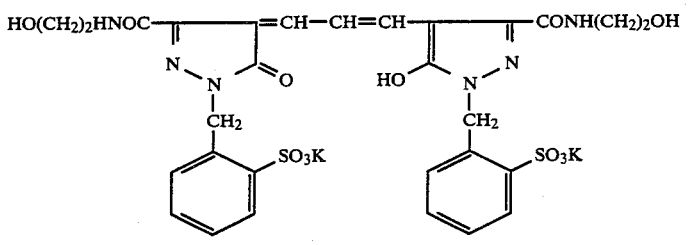
(D-1)
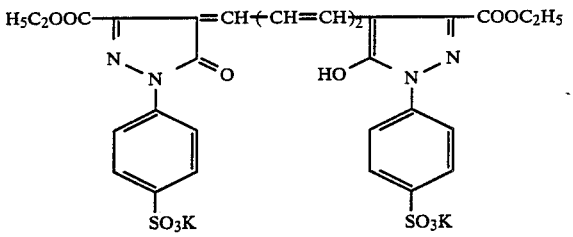
(D-2)
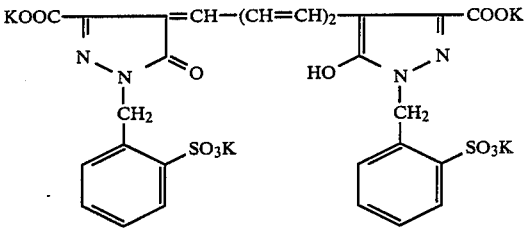
(D-3)
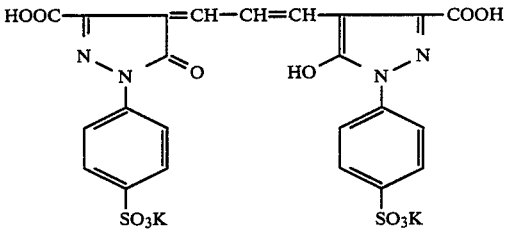
(D-4)
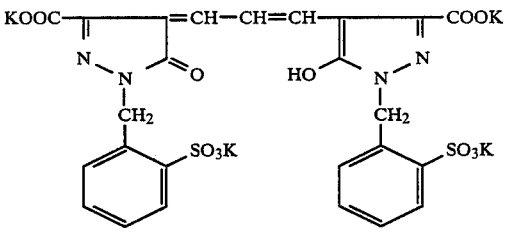
(D-5)
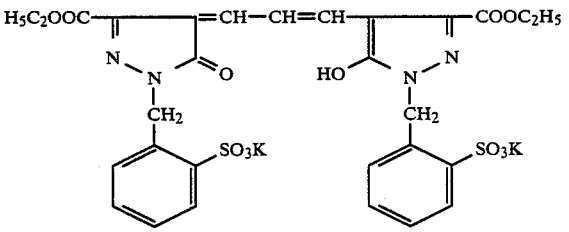
(D-6)

-continued (D-7)

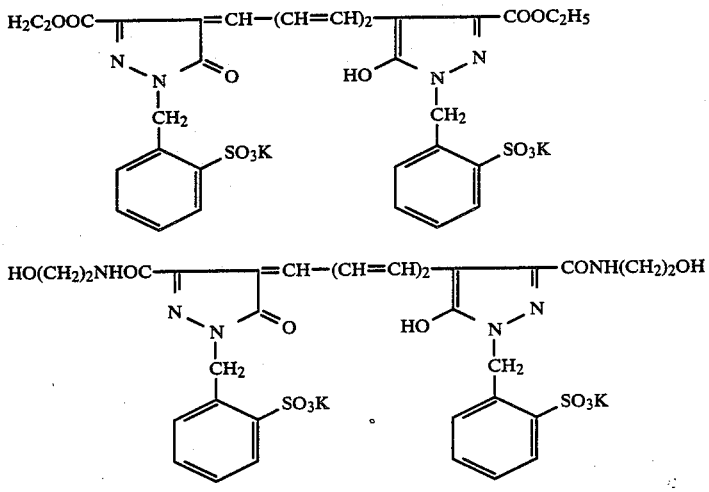

The photosensitive materials of this invention preferably have auxiliary layers, such as a protective layer, intermediate layers, filter layers, antihalation layers, backing layers, etc., established appropriately, as well as the silver halide emulsion layers.

Binding agents (binders) or protective colloids in which gelatin is used can be used in the emulsion layers and intermediate layers of the photosensitive materials of this invention. However, other hydrophilic colloids can also be used.

For example, it is possible to use gelatin derivatives, graft polymers of gelatin and other macromolecular polymers, and proteins such as albumin, casein, etc.; cellulose derivatives, such as hydroxyethyl cellulose, carboxymethyl cellulose, cellulose sulfate esters, etc.; sodium alginate; sugar derivatives, such as starch derivatives, etc.; and a variety of hydrophilic polymeric materials, such as a poly(vinylpyrrolidone), polyacrylic acid, polymethacrylic acid, polyacrylamide, polyvinylimidazole, polyvinylpyrazole, etc., either individually or in the form of copolymers.

Acid-treated gelatin and enzyme-treated gelatin as disclosed on page 30 of *Bull. Soc. Sci. Phot. Japan*, No. 16 (1966) may be used instead of lime-treated gelatin. Gelatin hydrolyzates and enzyme degradation products of gelatin can also be used.

Various other additives for photographic purposes can also be included in the emulsion layers and auxiliary layers of the photosensitive materials of this invention. For example, appropriate use can be made of the antifoggants, dye image anti-fading agents, anti-color staining agents, fluorescent whiteners, antistatic agents, film hardening agents, surface active agents, plasticizers, wetting agents, ultraviolet absorbers, etc., disclosed in *Research Disclosure*, RD No. 17643.

The silver halide photographic photosensitive materials of this invention can be prepared by coating, as required, the various structural layers such as the emulsion layers and auxiliary layers in which the aforementioned various additives for photographic purposes have been included onto a support which has been subjected to a corona discharge treatment, flame treatment or an ultraviolet irradiation treatment, with the use of appropriate bottom layers and intermediate layers. Supports which might beneficially be used include, for example, baryta paper, polyethylene protected paper, polypropylene synthetic paper, materials which also function as a reflective layer, or transparent supports which can be used with a reflecting layer, such as, for example, glass plates, polyester films (such as cellulose acetate, cellulose nitrate or polyethylene terephthalate films), polyamide films, polycarbonate films, polystyrene films, etc. The appropriate support is selected in accordance with the intended purpose of the photosensitive material.

The emulsion layers and other structural layers used in this invention can be established by using various coating methods, such as dip coating, air doctor coating, curtain coating, hopper coating, etc.

Furthermore, the simultaneous coating of two or more layers can be achieved using the methods disclosed in U.S. Pat. Nos. 2,761,791 and 2,941,898.

The positions in which each of the emulsion layers is coated can be determined arbitrarily in this invention, and, for example, the layers can be arranged in the order (from the support side) blue-sensitive emulsion layer, green-sensitive emulsion layer, red-sensitive emulsion layer or in the order (from the support side) red-sensitive emulsion layer, green-sensitive emulsion layer, blue-sensitive emulsion layer.

An ultraviolet absorbing layer can be established on the layer adjacent on the support side to the emulsion layer furthest away from the support, and ultraviolet absorbing layers can be established on the reverse side of the support as required. In the latter case, in particular, it is desirable that a protective layer consisting essentially only of gelatin should be established as the uppermost layer.

When the invention is applied to color sensitive materials for prints, the photosensitive material can be subjected to a color development process after exposure through a negative photosensitive material which has a colored image consisting of the products of coupling.

The color development process can be carried out using the normal method of color development.

All the known methods and processing solutions, such as those disclosed on pages 28 to 30 of *Research Disclosure*, RD No. 17643, for example, can be used in the photographic processing of the photosensitive materials obtained using the techniques of this invention. The photographic processes required for the ultimate realization of a colored image may involve photographic processes in which a silver image is formed or photographic processes in which a dye image is formed directly. The normal processing temperature is normally preferably between 18° and 50° C., but temperatures below 18° C. or above 50° C. can also be used.

No particular limitation is imposed upon the color photographic processing method and various methods can be used. For example, a typical process involves carrying out color development and bleach-fixing processes after exposure, and then carrying out water washing and stabilizing processes as required. In another system, the exposed material is subjected to color development and separate bleaching and fixing processes and then to water washing and stabilizing processes as required. In another system, the exposed material is developed in a developer which contains a black-and-white developing agent, after which the material is uniformly exposed to light and then subjected to color development and bleach-fixing processes and finally to water washing and stabilization treatments as required. In yet another system, the exposed material is developed in a developer which contains a black-and-white developing agent, then color developed using a color developer, which contains a fogging agent (for example, sodium borohydride) and then subjected to a bleach-fixing process and finally to water washing and stabilizing processes as required.

The primary aromatic amine color developing agents which can be used in the color developers of this invention include the known materials which are widely used in a variety of color photographic processes. These developing agents include aminophenol based and p-phenylenediamine based derivatives. The use of p-phenylenediamine derivatives is preferred, and some typical examples are indicated below. However, the invention is understood not to be limited by these examples.

D- 1: N,N-Diethyl-p-phenylenediamine
D- 2: 2-Amino-5-diethylaminotoluene
D- 3: 2-Amino-5-(N-ethyl-N-laurylamino)toluene
D- 4: 4-[N-Ethyl-N-(β-hydroxyethyl)amino]aniline
D- 5: 2-Methyl-4-[N-ethyl-N-(β-hydroxyethyl)amino] aniline
D- 6: N-Ethyl-N-(β-methanesulfonamidoethyl)-3-methyl-4-aminoaniline
D- 7: N-(2-Amino-5-diethylaminophenylethyl)-methanesulfonamide-methanesulfonamide
D- 8: N,N-Dimethyl-p-phenylenediamine
D- 9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline Furthermore, these p-phenylenediamine derivatives may be used in the form of salts such as their sulfates, hydrochlorides, sulfites, p-toluenesulfates, etc. The above-mentioned compounds are disclosed in U.S. Pat. Nos. 2,193,015, 2,552,241, 2,566,271, 2,592,364, 3,656,950 and 3,698,525. The primary aromatic amine color developing agents are used at a concentration of some 0.1 to 20 g per liter of developer. The preferred concentration is some 0.5 to 10 g per liter of developer.

The well known hydroxylamines can be included in the color developers which are used in this invention.

The hydroxylamines can be used in the form of the free amine in the color developer, but they are more generally used in the form of their water-soluble acid salts. Examples of such salts include the sulfates, oxalates, chlorides, phosphates, carbonates, acetates, etc. The hydroxylamine may be substituted or unsubstituted, and the nitrogen atom of the hydroxylamine may be substituted with an alkyl group.

The amount of hydroxylamine added is preferably less than 10 g per liter of color developer and more preferably less than 5 g per liter of color developer. Provided that the stability of the color developer is assured, the addition of the smallest possible amount of hydroxylamine is preferred.

A sulfite such as sodium sulfite, potassium sulfite, sodium bisulfite, potassium bisulfite, sodium metasulfite or potassium metasulfite, or carbonylsulfite adducts are preferably included as preservatives. The amount of these materials to be added is preferably not more than 20 g, and most preferably not more than 5 g, per liter of color developer. Provided that the stability of the color developer is assured, the smallest possible amount of these preservatives is preferred.

Other preservatives include the aromatic polyhydroxy compounds disclosed in Japanese Patent Application (OPI) Nos. 49828/77, 47038/81, 32140/81 and 160142/84 and in U.S. Pat. No. 3,746,544; the hydroxyacetones disclosed in U.S. Pat. No. 3,615,503 and British Patent 1,306,176; the α-aminocarbonyl compounds disclosed in Japanese Patent Application (OPI) Nos. 143020/77 and 89425/78; the various metals disclosed in Japanese Patent Application (OPI) Nos. 44148/82 and 53749/82; the various sugars disclosed in Japanese Patent Application (OPI) No. 102727/77; the hydroxamic acids disclosed in Japanese Patent Application (OPI) No. 102727/77; the hydroxamic acids disclosed in Japanese Patent Application (OPI) No. 27638/77; the α,α'-dicarbonyl compounds disclosed in Japanese Patent Application (OPI) No. 160141/84; the salicylic acids disclosed in Japanese Patent Application (OPI) No. 180588/84; the alkanolamines disclosed in Japanese Patent Application (OPI) No. 3532/79; the poly(alkylenimines) disclosed in Japanese Patent Application (OPI) No. 94349/81 and the gluconic acid derivatives disclosed in Japanese Patent Application (OPI) No. 75647/81. Two or more of these preservatives may be used concurrently as required. The addition of 4,5-dihydroxy-m-benzenesulfonic acid, poly(ethylenimine) and triethanolamine, etc., is particularly desired.

The pH of the color developer used in the invention is preferably 9 to 12 and most desirably 9 to 11. Other known developer component compounds can be included in the color developer.

The use of various buffers is preferred for maintaining the above-mentioned pH level. Buffers based on carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3- propanediol salts, paline salts, proline salts, trishydroxyaminomethane salts, and lysine salts, etc., can be used for this purpose. Carbonates, phosphates, tetraborates and hydroxy benzoates have excellent solubility and buffering capacities in the high pH range above pH 9.0. They also have the advantages of not having any adverse (fogging) effect on the photographic processing performance when added to a color developer and of being cheap. Therefore, the use of these buffers is especially desirable.

Actual examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, the employable buffers are not limited to these compounds.

The amount of the buffer added to the color developer is preferably not less than 0.1 mol/liter, and most desirably between 0.1 and 0.4 mol/liter.

The use of various chelating agents in the color developers is also preferred for preventing the precipitation of calcium and magnesium, etc., and for improving the stability of the color developer.

The preferred chelating agents are organic acid compounds including, for example, the aminopolycarboxylic acid disclosed in Japanese Patent Publication Nos. 30496/73 and 30232/69; the organophosphonic acid disclosed in Japanese Patent Application (OPI) No. 97347/81, Japanese Patent Publication No. 39359/81 and West German Patent 2,227,639; the phosphonocarboxylic acids disclosed in Japanese Patent Application (OPI) Nos. 102726/77, 42730/78, 121127/79, 126241/80 and 65956/80; and the compounds disclosed in Japanese Patent Application (OPI) Nos. 195845/83 and 203440/83 and Japanese Patent Publication No. 40900/78. Actual examples are given below but the chelating agents are not limited to these examples.

Nitronetriacetic acid
Diethyleneaminepentaacetic acid
Ethylenediaminetetraacetic acid
Triethylenetetraminehexaacetic acid
N,N,N-Trimethylenephosphonic acid
Ethylenediamine-N,N,N',N'-tetramethylenephosphonic acid
1,3-Diamino-2-propanoltetraacetic acid
Trans-cyclohexanediaminetetraacetic acid
Nitrilotripropionic acid
1,2-Diaminopropanetetraacetic acid
Hydroxyethyliminodiacetic acid
Glycol ether diaminetetraacetic acid
Hydroxyethylenediaminetriacetic acid
Ethylenediamine-ortho-hydroxyphenylacetic acid
2-Phosphonobutane-1,2,4-tricarboxylic acid
1-Hydroxyethane-1,1-diphosphonic acid
N,N'-Bis(2-hydroxybenzyl)ethylenediamine-N,N'diacetic acid Two or more of these chelating agents can be used concurrently as required. The amount of chelating agent added should be sufficient to chelate the metal ions which are present in the color developer. For example, the chelating agent may be used at a concentration of 0.1 to 10 g/liter.

Development accelerators can be added to the color developers as required.

Apart from benzyl alcohol, the thioether based compounds disclosed in Japanese Patent Publication Nos. 16088/62, 5987/62, 7826/63, 12380/69 and 9019/70 and U.S. Pat. No. 3,813,247; the p-phenylenediamine based compounds disclosed in Japanese Patent Application (OPI) Nos. 49829/77 and 15554/75; the quaternary ammonium salts disclosed in Japanese Patent Application (OPI) No. 137726/75, Japanese Patent Publication No. 30074/69, Japanese Patent Application (OPI) Nos. 156826/81 and 43429/79; the p-aminophenols disclosed in U.S. Pat. Nos. 2,610,122 and 4,119,462; the amine based compounds disclosed in U.S. Pat. Nos. 2,494,903, 3,128,182, 4,230,796 and 3,253,919, Japanese Patent Publication No. 11431/66, U.S. Pat. Nos. 2,482,546, 2,569,926 and 3,582,346; the polyalkylene oxides disclosed in Japanese Patent Publication Nos. 16088/62 and 25201/67, U.S. Pat. No. 3,128,183, Japanese Patent Publication Nos. 11431/66 and 23883/67 and U.S. Patent 3,532,501; and also 1-phenyl-3-pyrazolidones, hydrazines, methione type compounds, thione type compounds and imidazoles, etc., can be added as required as development accelerators. The use of thioether based compounds and the 1-phenyl-3-pyrazolidones is preferred.

Antifoggants can be added to the color developer as required in this invention. Alkali metal halides such as potassium bromide, sodium bromide, potassium iodide, etc., and organic antifoggants can be used for this purpose. Nitrogen-containing heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethylbenzimidazole, and hydroxyazaindolizine, and mercapto substituted heterocyclic compounds such as 1-phenyl-5-mercaptotetrazole, 2-mercaptobenzimidazole and 2-mercaptobenzothiazole, and adenine and mercapto substituted aromatic compounds, such as thiosalicylic acid, can be used as organic antifoggants. These antifoggants may dissolve out from the silver halide color photographic material during processing and accumulate in the color developer, but the extent of any such accumulation is preferably as small as possible from the point of view of reducing the amount discharged.

The color developers of this invention preferably contain a fluorescent whitener. The 4,4'-diamino-2,2'-disulfostilbene based compounds are preferred fluorescent whiteners. These are added at a concentration of 0 to 5 g/liter, and preferably at a concentration of 0.1 to 2 g/liter.

Various surfactants such as alkylphosphonic acids, arylphosphonic acids, aliphatic carboxylic acids, aromatic carboxylic acids, etc., may be added as required.

The processing temperature of the color developer in this invention is preferably 30° to 50° C. and most desirably 33° to 42° C. The replenishment rate is 30 to 1,500 cc, and preferably 30 to 600 cc, per square meter of photosensitive material. The most desirable replenishment rate is 30 to 300 cc per square meter of photosensitive material. As small a replenishment rate as possible is preferred from the point of view of reducing the amount of waste liquid.

The bleaching agents used in the bleach or bleach-fix baths used in this invention are generally complex salts or iron(III). Complexes of iron(III) and a chelating agent such as aminopolycarboxylic acids, aminopolyphosphonic acids or their salts are preferred as the complex salts of iron. The aminopolycarboxylic acid salts or aminopolyphosphonic acid salts are preferably the alkali metal salts, ammonium salts or water-soluble amine salts of these acids. The alkali metal is sodium, potassium, lithium, etc. The water-soluble amines include alkylamines, such as methylamine, diethylamine, triethylamine and butylamine; alicyclic amines, such as cyclohexylamine; aryl amines, such as aniline and m-toluidine; and heterocyclic amines, such as pyridine, morpholine and piperidine.

Typical examples of these aminopolycarboxylic acid and aminopolyphosphonic acid chelating agents and their salts are indicated below, but the chelating agents are understood not to be limited to these examples.

Ethylenediaminetetraacetic acid
Ethylenediaminetetraacetic acid disodium salt
Ethylenediaminetetraacetic acid diammonium salt
Ethylenediaminetetraacetic acid tetra(trimethylammonium) salt
Ethylenediaminetetraacetic acid tetrapotassium
Ethylenediaminetetraacetic acid tetrasodium salt
Ethylenediaminetetraacetic acid trisodium salt
Diethylenetriaminepentaacetic acid
Diethylenetriaminepentaacetic acid pentasodium salt
Ethylenediamine-N-(β-oxyethyl)-N,N',N'-triacetic acid
Ethylenediamine-N-(β-oxyethyl)-N,N',N'-triacetic acid trisodium salt
Ethylenediamine-N-(β-oxyethyl)-N,N',N'-triacetic acid triammonium salt
Propylenediaminetetraacetic acid
Propylenediaminetetraacetic acid disodium salt
Nitrilotriacetic acid
Nitrilotriacetic acid trisodium salt
Cyclohexanediaminetetraacetic acid
Cyclohexanediaminetetraacetic acid disodium salt
Iminodiacetic acid
Dihydroxyethyleneglycine
Ethyl ether diaminetetraacetic acid
Glycol ether diaminetetraacetic acid
Ethylenediaminetetrapropionic acid
Phenylenediaminetetraacetic acid
1,3-Diaminopropanol-N,N,N',N'-tetramethylenephosphonic acid
Ethylenediamine-N,N,N',N'-tetramethylenephosphonic acid
1,3-Propylenediamine-N,N,N',N'-tetramethylenephosphonic acid The iron(III) complex salt may be used in the form of a complex salt, and iron(III) complex salts can be formed in solution using ferric sulfate, ferric chloride, ferric nitrate, ferric ammonium sulfate, ferric phosphate, etc., and a chelating agent, such as an aminopolycarboxylic acid, an aminopolyphosphonic acid or a phosphonocarboxylic acid, etc. When used in the form of a complex salt, a single type of complex salt can be used or combinations of two or more types of complex salt may be used. On the other hand, when a complex salt is formed in solution using an iron(III) salt and a chelating agent, either one or two or more types of iron(III) salt may be used. Moreover, one or two or more chelating agents may be used. Furthermore, in either case the chelating agent may be used in an amount in excess of that required to form the iron(III) complex. Of these iron complexes, the use of aminopolycarboxylic acid iron complex salts is preferred. These are added in amounts to provide a concentration of 0.01 to 1.0 mol/liter, and preferably of 0.05 to 0.50 mol/liter.

Bleaching accelerators can be used as required in the bleach and bleach-fix baths. Actual examples of useful bleaching accelerators include the compounds which have a mercapto group or a disulfide group as disclosed in U.S. Pat. Nos. 3,893,858, West German Patents 1,290,812 and 2,059,988, Japanese Patent Application (OPI) Nos. 32736/78, 57831/78, 37418/78, 65732/78, 72623/78, 95630/78, 95631/78, 104232/78, 124424/78, 141623/78 and 28426/78, and *Research Disclosure*, RD No. 17129; the thiazolidine derivatives disclosed in Japanese Patent Application (OPI) No. 140129/75; the thiourea derivatives disclosed in Japanese Patent Publication No. 8506/70, Japanese Patent Application (OPI) Nos. 20832/77 and 32735/78 and U.S. Pat. No. 3,706,561; the iodides disclosed in West German Patent 1,127,715 and Japanese Patent Application (OPI) No. 16235/83; the polyethylene oxides disclosed in West German Patents 966,410 and 2,748,430; the polyamine compounds disclosed in Japanese Patent Publication No. 8836/70 and the other compounds disclosed in Japanese Patent Application (OPI) Nos. 42434/74, 59644/74, 94927/78, 35727/79, 26506/80 and 16394/83 and iodine and bromine ions, etc. The compounds which have a mercapto group or a disulfide group are preferred in view of their large accelerating effect. The compounds disclosed in U.S. Pat. No. 3,893,858, West German Patent 1,290,812 and Japanese Patent Application (OPI) No. 95630/78 are most preferred.

The inclusion of bromides (for example, potassium bromide, sodium bromide, ammonium bromide) or chlorides (for example, potassium chloride, sodium chloride, ammonium chloride) or iodides (for example, ammonium iodide) in the bleach and bleach-fix baths of this invention as rehalogenating agents is preferred. Moreover, one or more types of organic acid or inorganic acid and their alkali metal or ammonium salts which has a pH buffering capacity, such as boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc., and corrosion inhibitors such as ammonium nitrate, guanidine, etc., may be added as required.

The fixing agent used in the bleach-fix or fixing baths of this invention is a known fixing agent. That is, a water-soluble silver halide dissolving agent, such as a thiosulfate, for example, sodium thiosulfate or ammonium thiosulfate, etc.; a thiocyanate, for example, sodium thiocyanate or ammonium thiocyanate, etc.; a thioether compound, for example, ethylenebisthioglycolic acid or 3,6-dithia-1,8-octadiol, etc.; or a thiourea. These may be used individually or in the form of mixtures of two or more types. Furthermore, special bleach-fix baths consisting of a combination of the fixing agent disclosed in Japanese Patent Application (OPI) No. 155354/80 and large amounts of halogen compounds, such as potassium iodide, etc., can also be used. In this invention, the use of a thiosulfate; especially ammonium thiosulfate, is preferred.

The fixing agent is preferably used at a concentration of 0.3 to 2 mol/liter and most desirably at a concentration of 0.5 to 1.0 mol/liter.

The pH of the bleach or bleach-fix bath in this invention is preferably between 3 and 10, and most preferably between 4 and 9. If the pH is below this range, there is an improvement in the silver removing properties of the bath, but the storage properties of the bath deteriorate and the leucoization of the cyan dye during processing is accelerated. Conversely, if the pH is above this range, silver removal is retarded and staining is liable to occur.

Hydrochloric acid, sulfuric acid, nitric acid, acetic acid (glacial), bicarbonates, ammonia, potassium hydroxide, sodium hydroxide, sodium carbonate, potassium carbonate, etc., can be added as required to adjust the pH.

Furthermore, various other items such as fluorescent whiteners, antifoaming agents, surfactants, polyvinylpyrrolidone, and organic solvents, such as methanol, etc., can be included in the bleach-fix bath.

Compounds which release sulfite ions, such as sulfites (for example, sodium sulfite, potassium sulfite, ammonium sulfite, etc.), bisulfites (for example, ammonium bisulfite, sodium bisulfite, potassium bisulfite, etc.), metabisulfites (for example, potassium metabisulfite, sodium metabisulfite, ammonium metabisulfite, etc.) are included as preservatives in the bleach-fix and fixing baths of this invention. These compounds are preferably included at a concentration calculated as sulfite ion of some 0.02 to 0.5 mol/liter, and more preferably from 0.04 to 0.40 mol/liter.

Sulfites are generally added as preservatives, but ascorbic acid and carbonyl bisulfite addition compounds or carbonyl compounds may also be added.

Moreover, buffers, fluorescent whiteners, chelating agents, biocides, etc., may be added as required.

The washing process of this invention is described below. In this invention a simple processing method in which there is no real water washing process, just a so-called "stabilization process" can be used in place of a normal "washing process". The term "washing process" as used in connection with the invention is used in the broader sense as indicated above.

It is difficult to specify the amount of wash water to be used in the invention, since it differs according to the number of baths used in multistage counter-flow washing and the extent of carrying over of components from earlier baths by the photosensitive material. However, in this invention, the concentration in the final wash bath of the prebath components which have a bleach-fixing capacity is preferably not more than $5\times10^{-2}$, and most preferably not more than $2\times10^{-2}$. For example, in the case of three tank counter flow washing system, the use of at least about 1,000 cc per square meter of photosensitive material is preferred. Furthermore, in the case of a water-economizing wash, the use of at least 1,000 cc per square meter of photosensitive material is preferred.

The wash temperature is between 15° C. and 45° C., and preferably between 20° C. and 40° C.

A variety of known compounds can be added during the washing process with a view to preventing precipitation and stabilizing the wash water. For example, inorganic phosphates, chelating agents such as aminopolycarboxylic acids, organophosphonic acids, etc., disinfectants and biocides for preventing the growth of various bacteria, algae and fungi, for example, the compounds disclosed in *J. Antibact. Antifung. Agents*, Vol. 11, No. 5, pp. 207-223 (1983), and the compounds disclosed in *The Chemistry of Germicides and Biocides*, Horiguchi, metal salts as typified by magnesium salts and aluminum salts, alkali metal and ammonium salts, and surfactants with respect to the drying load and the prevention of unevenness, etc., can be added as required. Alternatively, the compounds disclosed on pages 344–359 of *Journal Phot. Sci. Eng.*, Vol. 6 (1965) by West may be added. Furthermore, the use of the method in which wash water in which the levels of calcium and magnesium, etc., have been reduced, as disclosed in Japanese Patent Application OPI No. 288838/87 is especially desirable in this invention.

Moreover, the invention is especially effective in cases where chelating agents, disinfectants and biocides are added to the wash water. Considerable reductions are achieved in the amount of wash water used by using a multistage counter flow washing system which has at least two stages. It is also particularly effective to use a multistage counter flow stabilization treatment process (a so-called stabilization process) of the type disclosed in Japanese Patent Application (OPI) No. 8543/82. In such cases, the bleach-fix component concentration in the final bath should be not more than $5\times10^{-2}$, and preferably not more than $1\times10^{-2}$.

Various compounds can be added to the stabilizing bath for the purpose of stabilizing the image. Typical examples include, for example, various buffers (for example, combinations of borates, metaborates, borax, phosphates, carbonates, potassium hydroxide, sodium hydroxide, aqueous ammonia, monocarboxylic acids, carboxylic acids, polycarboxylic acids, etc., and aldehydes such as formalin, etc., can be used for adjusting the film pH (for example, to pH 3 to 8). Various other additives, such as chelating agents (inorganic phosphoric acid, aminopolycarboxylic acids, organic phosphonic acids, aminopolyphosphonic acids, phosphonocarboxylic acids, etc.), disinfectants (thiazoles, isothiazoles, halophenols, sulfanilamide, benzotriazole, etc.), surfactants, fluorescent whiteners, film hardening agents, etc., may also be used. Two or more compounds intended for the same or different purposes can be used concurrently.

Furthermore, the addition of various ammonium salts, such as ammonium chloride, ammonium nitrate, ammonium sulfate, ammonium phosphate, ammonium sulfite, ammonium thiosulfate, etc., as post-processing film pH adjusting agents, is preferred for improving the image storing properties.

In cases where considerable water savings are achieved in the ways described above, it is desirable that some or all of the overflowing wash water should be introduced into the bleach-fix or fixing bath, which is the bath established prior to the washing bath, in order to minimize the amount of waste liquid.

In continuous processing, a replenisher is used for each processing bath in order to prevent fluctuation in bath compositions. A constant finish can be obtained in this way. The amount of replenishment is preferably as small as possible, as long as good photographic properties can be maintained by establishing processing conditions such as the composition, temperature, processing time and agitation, etc., in such a way as to reduce costs, etc.

Heaters, temperature sensors, liquid level sensors, circulating pumps, filters, various floating lids, squeegees, nitrogen agitators and air agitators, etc., are preferably established as required in each of the processing baths.

Color photographic processing can be applied to any processing system provided that the treatment involves the use of a color developer. For example, it can be applied to the processing of color papers, color reversal papers, color positive film, color negative film, color reversal film, etc.

Examples of the invention are described below, but the invention is understood not to be limited by these examples.

EXAMPLE 1

A red-sensitive layer emulsion was prepared in the following way.

Lime-treated gelatin (30 g) was added to 1,000 cc of distilled water and dissolved at 40° C., after which the pH was adjusted to 3.8 with sulfuric acid, 6.5 g of sodium chloride and 0.02 g of N,N'-dimethylethylenethiourea were added and the temperature was raised to 75° C. A solution obtained by dissolving 62.5 g of silver nitrate in 750 cc of distilled water and a solution obtained by dissolving 35.0 g of potassium bromide and 4.3 g of sodium chloride in 500 cc of distilled water were added to and mixed with the aforementioned solution over a period of 40 minutes while maintaining a temperature of 75° C. The emulsion so obtained was observed using an electron microscope, and it was found that cubic grains with an average side length of about 0.43 μm had been formed. A solution obtained by dissolving 62.5 g of silver nitrate in 500 cc of distilled water and a solution obtained by dissolving 26.3 g of potassium bromide and 8.6 g of sodium chloride in 300 cc of distilled water were added to and mixed with this emulsion over a period of 20 minutes at a temperature of 65° C. On observing the emulsion so obtained under an electron microscope, it was found that cubic grains which had an average side length of about 0.55 μm had been formed. On measuring the grain size distribution of this emulsion, it was found to be a monodispersed emulsion in which about 87% of all grains were within ±20% of the average grain size (referred to below as the degree of monodispersion) in terms of the number of grains. The emulsion was washed, desalted, and then chemically sensitized optimally using sodium thiosulfate in the presence of nucleic acid degradation products. The resulting emulsion is referred to below as Emulsion (A).

Moreover, a similar emulsion which had been subjected to optimum sulfur sensitization and which had a degree of monodispersion of 92% consisting of cubic-tetradecahedral grains with an average side length of 0.35 μm, being rather square but tending toward the tetradecahedral, was prepared by changing the reaction temperature for grain formation. This emulsion is referred to below as Emulsion (B).

The illustrative Compounds (III−1) ($2\times10^{-3}$ mol/molAg) (V−1) ($9\times10^{-5}$ mol/molAg), (F−7) ($2\times10^{-3}$ mol/molAg) and (II−1) ($3\times10^{-4}$ mol/molAg) were added to and used in Emulsions (A) and (B). A green-sensitive layer emulsion was prepared in the following way.

Lime-treated gelatin (30 g) was added to 1,000 cc of distilled water and dissolved at 40° C., after which the pH was adjusted to 3.8 with sulfuric acid, 6.5 g of sodium chloride and 0.02 g of N,N'-dimethylethylenethiourea were added and the temperature was raised to 60° C. A solution obtained by dissolving 62.5 g of silver nitrate in 750 cc of distilled water and a solution obtained by dissolving 26.3 g of potassium bromide and 8.6 g of sodium chloride in 500 cc of distilled water were added to and mixed with the aforementioned solution over a period of 40 minutes while maintaining a temperature of 60° C. The emulsion so obtained was observed using an electron microscope, and it was found that cubic grains with an average side length of about 0.36 μm had been formed. A solution obtained by dissolving 62.5 g of silver nitrate in 500 cc of distilled water and a solution obtained by dissolving 35.0 g of potassium bromide and 4.3 g of sodium chloride in 300 cc of distilled water were added to and mixed with this emulsion over a period of 20 minutes at a temperature of 70° C. On observing the emulsion so obtained under an electron microscope, it was found that cubic grains which had an average side length of about 0.45 μm had been formed. On measuring the grain size distribution of this emulsion, it was found to be a monodispersed emulsion with a degree of monodispersion of about 89%. This emulsion was washed, desalted, and then chemically sensitized optimally using sodium thiosulfate in the presence of nucleic acid degradation products. The resulting emulsion is referred to below a Emulsion (C).

Moreover, a similar emulsion which had been subjected to optimum sulfur sensitization and which had a degree of monodispersion of 93% consisting of cubic-tetradecahedral grains with an average side length of 0.30 μm, being rather square but tending toward the tetradecahedral, was prepared by changing the reaction temperature for grain formation. This emulsion is referred to below as Emulsion (D).

The illustrative compounds (III−1)($1\times10^{-3}$ mol/molAg), (V−26) ($6\times10^{-5}$ mol/molAg), (V−42)($3\times10^{-3}$ mol/molAg) and (I−2)($4\times10^{-4}$ mol/molAg) were added to and used in Emulsions (C) and (D).

A blue-sensitive layer emulsion was prepared in the following way.

Lime-treated gelatin (30 g) was added to 700 cc of distilled water and dissolved at 40° C., after which the pH was adjusted to 4.2 with sulfuric acid, 8.5 g of sodium chloride and 0.03 g of N,N'-dimethylethylenethiourea were added and the temperature was raised to 78° C. A solution obtained by dissolving 31.25 g of silver nitrate in 750 cc of distilled water and a solution obtained by dissolving 20.8 g of potassium bromide and 0.5 g of sodium chloride in 500 cc of distilled water were added to and mixed with the aforementioned solution over a period of 40 minutes while maintaining a temperature of 78° C. The emulsion so obtained was observed using an electron microscope, and it was found that tetradecahedral grains approaching a cubic form with an average side length of about 0.50 μm had been formed. A solution obtained by dissolving 93.7 g of silver nitrate in 500 cc of distilled water and a solution obtained by dissolving 49.2 g of potassium bromide and 8.1 g of sodium chloride in 300 cc of distilled water were added to and mixed with this emulsion over a period of 20 minutes at a temperature of 72° C. On observing the emulsion so obtained under an electron microscope, it was found that cubic grains which had an average side length of about 0.80 μm had been formed. The emulsion was a monodispersed emulsion with a degree of monodispersion of about 90%. This emulsion was washed, desalted, and then chemically sensitized optimally using sodium thiosulfate in the presence of nucleic acid degradation products. The resulting emulsion is referred to below as Emulsion (E).

Moreover, a similar emulsion which had been subjected to optimum sulfur sensitization and which had a degree of monodispersion of 90% consisting of cubic grains with an average side length of 0.55 μm was prepared by changing the reaction temperature for grain formation. This emulsion is referred below as Emulsion (F).

The illustrative Compound (III−1) ($4\times10^{-3}$ mol/molAg), (V−34) ($6\times10^{-4}$ mol/molAg) and (I−2) ($6\times10^{-5}$ mol/molAg were added to and used in Emulsions (E) and (F).

A red-sensitive layer emulsified dispersion was prepared in the following way:

Illustrative Compound (P57) of this invention of average molecular weight of about 60,000 (15 g), 10 g of illustrative Compound (C-1), 1.0 g of illustrative Compound (X-9), 1.5 g of (X-10), 1.5 g of (X-12), 2 g of illustrative Compound (S-11), 4 g of (S-16), and 0.2 g of Compound (a) were mixed with 30 cc of ethyl acetate and a solution was formed at 50° C. This solution was added to 190 cc of 10% aqueous gelatin solution which had been mixed with 12 cc of 10% sodium dodecylbenzenesulfonate, and the mixture was emulsified and dispersed using a homogenizer. This is referred to as Emulsified Dispersion (i) below.

A green-sensitive layer emulsified dispersion was prepared in the following way:

Illustrative Compound (P-57) of this invention of average molecular weight of about 80,000 (10 g), 10 g of illustrative Compound (M-15), 1.2 g of illustrative Compound (A-1), 1.5 g of (B-1), 10 g of illustrative Compound (S-7) and 5 g of (S-16), and 4.4 g of Compound (b) were mixed with 40 cc of ethyl acetate and a solution was formed at 50° C. This solution was added to 210 cc of 10% aqueous gelatin solution which had been mixed with 13 cc of 10% sodium dodecylbenzenesulfonate and the mixture was dispersed using a homogenizer and an emulsified dispersion. This is referred to as Emulsified Dispersion (ii) below.

A blue-sensitive layer emulsified dispersion was prepared in the following way:

Illustrative Compound (P-57) of this invention of average molecular weight of about 50,000 (19 g), 19 g of illustrative Compound (Y-1), 6.0 g of illustrative Compound (S-25), and 4.3 g of Compound (c) were mixed with 27 cc of ethyl acetate and a solution was formed at 50° C. This solution was added to 180 cc of 10% aqueous gelatin solution which had been mixed with 8 cc of 10% sodium dodecylbenzenesulfonate and the mixture was dispersed using a homogenizer and an emulsified dispersion was obtained. This is referred to as Emulsified Dispersion (iii) below.

A coated sample which had the layer construction and compound composition shown in Table 1 was prepared by constructing red-sensitive, green-sensitive and blue-sensitive layers using the above-mentioned Emulsions (A) to (F) and Emulsified Dispersions (i) to (iii) and by establishing intermediate layers such as ultraviolet absorbing layers and anti-color mixing layers, and a protective layer.

Materials prepared in the same way as the emulsified dispersions for the emulsion layers described above were also used for the emulsified dispersions for the ultraviolet absorbing layer and the anti-color mixing layers.

Illustrative Compounds (D-1), (D-4), (D-7) and (D-8) were used at rates varying from 0.002 g/m$^2$ to 0.04 g/m$^2$ and used conjointly in these coated samples with the intention of preventing irradiation and improving the sharpness of the image, etc.

Furthermore, Compounds (e) and (f) indicated below were used concurrently as gelatin hardeners.

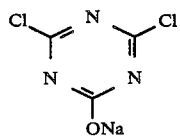

(e)

A 3/1 (by mol) mixture of

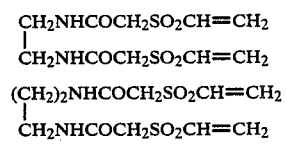

(f)

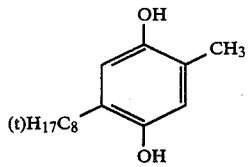

(a)

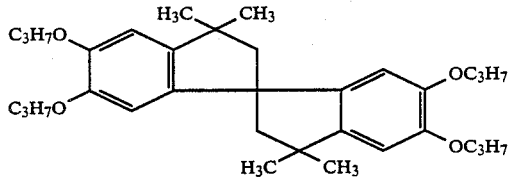

(b)

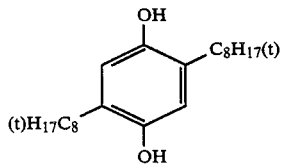

(d)

-continued

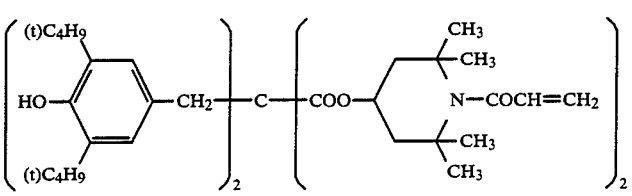

(c)

TABLE 1

| | Use Rate* ($g/m^2$) |
|---|---|
| Seventh Layer: Protective Layer | |
| Gelatin | 1.30 |
| Acrylic modified polymer of polyvinyl alcohol (17% modification) | 0.15 |
| Liquid paraffin | 0.05 |
| Sixth Layer: Ultraviolet Absorbing Layer | |
| Gelatin | 0.65 |
| Ultraviolet Absorber (X-9) | 0.02 |
| Ultraviolet Absorber (X-10) | 0.09 |
| Ultraviolet Absorber (X-16) | 0.10 |
| Anti-Color Mixing Agent (d) | 0.02 |
| Solvent (S-11) | 0.10 |
| Fifth Layer: Red-Sensitive Layer | |
| Emulsion (A) | 0.05 |
| Emulsion (B) | 0.19 |
| Gelatin | 1.76 |
| Polymer (P-57) | 0.54 |
| Cyan Coupler (C-1) | 0.36 |
| Color Image Stabilizer (X-9) | 0.04 |
| Color Image Stabilizer (X-10) | 0.05 |
| Color Image Stabilizer (X-12) | 0.05 |
| Color Image Regulating Agent (a) | 0.01 |
| Solvent (S-11) | 0.07 |
| Solvent (S-16) | 0.14 |
| Fourth Layer: Ultraviolet Absorbing Layer | |
| Gelatin | 1.60 |
| Ultraviolet Absorber (X-9) | 0.06 |
| Ultraviolet Absorber (X-10) | 0.27 |
| Ultraviolet Absorber (X-16) | 0.29 |
| Anti-Color Mixing Agent (d) | 0.05 |
| Solvent (S-11) | 0.24 |
| Third Layer: Green-Sensitive Layer | |
| Emulsion (C) | 0.08 |
| Emulsion (D) | 0.08 |
| Gelatin | 2.20 |
| Polymer (P-57) | 0.45 |
| Magenta Coupler (M-15) | 0.45 |
| Colored Image Stabilizer (A-1) | 0.05 |
| Colored Image Stabilizer (B-1) | 0.07 |
| Colored Image Stabilizer (b) | 0.20 |
| Solvent (S-7) | 0.45 |
| Solvent (S-16) | 0.23 |
| Second Layer: Anti-Color Mixing Layer | |
| Gelatin | 0.99 |
| Anti-Color Mixing Agent (d) | 0.09 |
| Solvent (S-25) | 0.08 |
| First Layer: Blue-Sensitive Layer | |
| Emulsion (E) | 0.16 |
| Emulsion (F) | 0.11 |
| Gelatin | 2.68 |
| Polymer (P-57) | 0.74 |
| Yellow Coupler (Y-1) | 0.74 |
| Colored Image Stabilizer (c) | 0.17 |
| Solvent (S-25) | 0.23 |
| Support: | |
| Polyethylene laminated paper (with $TiO_2$ and ultramarine in the polyethylene laminated on the first layer side) | |

*The coating rates for emulsions are calculated as silver.
In the sixth layer (X-9) and (X-10) act as ultraviolet absorber, while in the fifth layer they act as a colored image stabilizer.

Emulsions for comparison purposes were prepared in the following way:

Lime-treated gelatin (30 g) was added to 1,000 cc of distilled water and dissolved at 40° C., after which it was adjusted to pH 3.8 with sulfuric acid, and 10.5 g of sodium chloride was added and the temperature was raised to 75° C. A solution obtained by dissolving 62.5 g of silver nitrate in 750 cc of distilled water and a solution obtained by dissolving 30.6 g of potassium bromide and 6.5 g of sodium chloride in 500 cc of distilled water were added to and mixed with the aforementioned solution over a period of 40 minutes while maintaining a temperature of 75° C. A solution obtained by dissolving 62.5 g of silver nitrate in 500 cc of distilled water and a solution obtained by dissolving 30.6 g potassium bromide and 6.5 g of sodium chloride in 300 cc of distilled water were added to and mixed with this emulsion over a period of 20 minutes. On observing the emulsion so obtained under an electron microscope, it was found that octahedral grains which had an average diameter calculated for the corresponding sphere of about 0.62 μm had been formed. This emulsion was washed and desalted and then it was chemically sensitized optimally using sodium thiosulfate in the presence of nucleic acid degradation products. This is referred to below as Emulsion (G).

The illustrative Compounds (III−1)($2\times10^{-3}$ mol/molAg), (V−1) ($9\times10^{-5}$ mol/molAg), (F−7)($2\times10^{-3}$ mol/molAg) and (II−1)($3\times10^{-4}$ mol/molAg) were added to and used in Emulsion (G).

An emulsion consisting of octahedral grains of average diameter calculated for the corresponding sphere of about 0.52 μm, and which contained 70 mol % of silver bromide, was prepared in the same way as above and sulfur sensitized optimally to provide Emulsion (H). The illustrative Compounds (III−1)($4\times10^{-3}$ mol/molAg), (V−26) ($6\times10^{-5}$ mol/molAg), (V−43)($6\times10^{-4}$ mol/molAg) and (I−2)($6\times10^{-5}$ mol/molAg) were added to and used in Emulsion (H).

Moreover, an emulsion consisting of octahedral grains of average diameter calculated for the corresponding sphere of about 0.90 μm and which contained 80 mol % of silver bromide was prepared in the same way and sulfur sensitized optimally to provide Emulsion (I).

The illustrative compounds (III−1)($4\times10^{-3}$ mol/molAg), (V−34)($6\times10^{-4}$ mol/molAg) and (I−2)($6\times10^{-5}$ mol/molAg) were added to and used in Emulsion (I).

Furthermore, emulsified dispersions (iv), (v) and (vi) for comparative purposes were prepared in the same way as the aforementioned emulsified dispersions (i), (ii) and (iii), respectively, except that the illustrative compound (P-57) was omitted in each case.

Furthermore, Emulsified Dispersions (vii), (viii) and (ix) were prepared by omitting the illustrative Compounds (S-1) and (S-16) from Emulsified Dispersion (i), illustrative Compounds (S-7) and (S-16) from Emulsified Dispersion (ii) and the illustrative Compound (S-25) from the Emulsified Dispersion (iii), respectively.

The coated Samples 101 to 106 were prepared by combining these emulsions and emulsified dispersions in the ways indicated in Table 2. Sample 101 is the same as the sample shown in Table 1.

TABLE 2

| | Sample | | | | | |
|---|---|---|---|---|---|---|
| | 101 | 102 | 103 | 104 | 105 | 106 |
| Red-sensitive layer emulsion | A + B | A + B | A + B | G | G | G |
| Red-sensitive layer emulsified dispersion | (i) | (iv) | (vii) | (i) | (iv) | (vii) |
| Green-sensitive layer emulsion | C + D | C + D | C + D | H | H | H |
| Green-sensitive layer emulsified dispersion | (ii) | (v) | (viii) | (ii) | (v) | (viii) |
| Blue-sensitive layer emulsion | E + F | E + F | E + F | I | I | I |
| Blue-sensitive layer emulsified dispersion | (iii) | (vi) | (ix) | (iii) | (vi) | (ix) |

The mixing ratios of Emulsions (A) and (B), (C) and (D), and (E) and (F) were all the same as those in Sample 101, and the coating rates (silver) for each layer were the same in all of the samples. The coating rates of the couplers included in each layer in the emulsified dispersion were the same as in Sample 101.

Samples 101 to 106 were exposed to white light through an optical wedge and through blue, green and red optical filters for a period of 0.1 second and then they were processed in the manner described below. After processing, the cyan, magenta and yellow densities of each sample were measured, and the sensitivities were obtained from the values of the reciprocal of the exposure corresponding to a density of 0.5. The sensitivities of Sample 102 were taken to be 100 when obtaining the relative sensitivities of Samples 101 and 103. The sensitivities of Sample 105 were taken to be 100 when obtaining the relative sensitivities of Samples 104 and 106. Furthermore, coated samples which had been stored at 35° C., 80% R.H. for a period of 21 days were exposed and processed in the same way and the sensitivities were obtained. These sensitivities are indicated as the relative value taking the values of the sensitivities described earlier for each sample to be 100. Moreover, the aforementioned processed samples were used in light fastness and dark fastness tests. The reduction in density from an initial density of 1.0 was measured in each case for each sample after storing for 6 days at a temperature of 100° C., after storing for 10 days at 80° C. under conditions of 72% relative humidity and after storing for 6 days in a xenon fadometer at a brightness level of 84,000 lux. The results obtained are shown in Table 3.

| Process | Temperature | Time |
|---|---|---|
| Color Development | 37° C. | 3 min 30 sec |
| Bleach-Fix | 33° C. | 1 min 30 sec |
| Wash | 24–34° C. | 3 min |
| Drying | 70–80° C. | 1 min |

The compositions of the various processing solutions were as follows:

| | |
|---|---|
| Color Developer: | |
| Water | 800 cc |
| Diethylenetriaminepentaacetic Acid | 1.0 g |

-continued

| | |
|---|---|
| Nitrilotriacetic Acid | 2.0 g |
| Benzyl Alcohol | 15.0 cc |
| Dietylene Glycol | 10.0 cc |
| Sodium Sulfite | 2.0 g |
| Potassium Bromide | 1.0 g |
| Potassium Carbonate | 30.0 g |
| N—Ethyl-N—(β-methanesulfonamido-ethyl)-3-methyl-4-aminoaniline Sulfate | 4.5 g |
| Hydroxylamine Sulfate | 3.0 g |
| Fluorescent Whitener (Whitex 4B, made by Sumitomo Chemicals) | 1.0 g |
| Water to make | 1,000 cc |
| pH (25° C.) | 10.25 |
| Bleach-Fix Bath: | |
| Water | 400 cc |
| Ammonium Thiosulfate (70 wt %) | 150 cc |
| Ethylenediaminetetraacetic Acid Iron (III) Complex Ammonium Salt | 55.0 g |
| Ethylenediaminetetraacetic Acid Disodium Salt | 5.0 g |
| Water to make | 1,000 cc |
| pH (25° C.) | 6.70 |

TABLE 3

| | | Relative Sensitivity | | Color Image Fastness | | |
|---|---|---|---|---|---|---|
| Sample | Layer | IAC* | 21 Days at 35° C., 80% R.H. | 6 Days at 100° C. (%) | 10 Days at 89° C., 72% R.H. (%) | 6 Days Xenon Lamp (%) |
| 101 | R | 93 | 95 | 28 | 17 | 13 |
| | G | 95 | 93 | 2 | 2 | 10 |
| | B | 93 | 91 | −3 | −2 | 7 |
| 102 | R | 100 | 85 | 60 | 39 | 27 |
| | G | 100 | 81 | 5 | 5 | 18 |
| | B | 100 | 78 | −3 | −2 | 16 |
| 103 | R | 81 | 83 | 30 | 20 | 41 |
| | G | 79 | 81 | 3 | 3 | 11 |
| | B | 76 | 72 | −3 | −3 | 11 |
| 104 | R | 72 | 76 | 26 | 17 | 14 |
| | G | 93 | 78 | 1 | 2 | 10 |
| | B | 81 | 79 | −3 | −3 | 8 |
| 105 | R | 100 | 72 | 59 | 42 | 30 |
| | G | 100 | 76 | 4 | 5 | 19 |
| | B | 100 | 74 | −2 | −1 | 19 |
| 106 | R | 81 | 74 | 33 | 17 | 40 |
| | G | 76 | 76 | 2 | 3 | 10 |
| | B | 78 | 72 | −3 | −2 | 12 |

*IAC: Immediately after coating

Sample 101 is an example of this invention and Samples 102 to 106 are comparative examples.

It is clear from the results shown in Table 3 that in comparison to Sample 102, which did not contain Polymer (P-57), there was very little reduction in the sensitivity of each layer in the case of Sample 101 of this invention, and that the loss of sensitivity on storing the samples for 21 days at 35° C., 80% R.H. was good. Furthermore, the dark fastness of the cyan and magenta images was improved, and the cyan, magenta and yellow colored images all had improved light fastness. With Sample 103, from which the high boiling point organic solvent had been omitted, the sensitivities of all the photosensitive layers relative to Sample 102 were lower than those observed with Sample 101 of this invention, and there was a considerable reduction in sensitivity on storing the material at 35° C., 80% R.H.

Furthermore, with Samples 104 to 106 in which silver halide emulsions outside the scope of this invention had been used, the fastness of the colored images displayed similar trends to those observed with Samples 101 to 103. However, on comparing the relationship of the sensitivities of Sample 101 with those of Sample 102, the reduction in sensitivity resulting from the use of (P-57) is very marked and there is not much reduction of the lowering of the sensitivities on storage at 35° C., 80% R.H. This is undesirable.

Thus, only Sample 101 of this invention did not exhibit a lowering of sensitivity at the time of coating, had a small reduction in sensitivity on storage and had excellent colored image storage properties. It is clear that the use of a silver halide emulsion in which in the main the (100) plane is enclosed is effective when the polymer and the high boiling point organic solvent of this invention are used and the colored image storage properties are, therefore, improved.

EXAMPLE 2

Samples 101 to 106 used in Example 1 were processed in the way indicated below, and similar results were obtained on carrying out the same tests as used in Example 1.

| Process | Temperature (°C.) | Time |
|---|---|---|
| Color Development | 33 | 3 min 30 sec |
| Bleach-Fix | 33 | 1 min 30 sec |
| Wash | 24–34 | 3 min |
| Drying | 70–80 | 1 min |

The compositions of the processing baths were as follows:

| | |
|---|---|
| Color Developer: | |
| Water | 800 cc |
| Diethylenetriaminepentaacetic Acid | 1.0 g |
| Nitrilotriacetic Acid | 1.5 g |
| Benzyl Alcohol | 15.0 cc |
| Diethylene Glycol | 10.0 cc |
| Sodium Sulfite | 2.0 g |
| Potassium Bromide | 0.5 g |
| Potassium Carbonate | 30.0 g |
| N—Ethyl-N—(β-methanesulfonamidoethyl)-3-methyl-4-aminoaniline Sulfate | 5.0 g |
| Hydroxylamine Sulfate | 4.0 g |
| Fluorescent Whitener (Whitex 4B, made by Sumitomo Chemicals) | 1.0 g |
| Water to make | 1,000 cc |
| pH (25° C.) | 10.20 |
| Bleach-Fix Bath: | |
| Water | 400 cc |
| Ammonium Thiosulfate (70 wt %) | 150 cc |
| Ethylenediaminetetraacetic Acid Iron (III) Complex Ammonium Salt | 55.0 g |
| Ethylenediaminetetraacetic Acid Disodium Salt | 5.0 g |
| Water to make | 1,000 cc |
| pH (25° C.) | 6.70 |

EXAMPLE 3

Samples 101 to 106 used in Example 1 were processed in the way indicated below and similar results were obtained on carrying out the same tests a used in Example 1.

| Process | Temperature (°C.) | Time |
|---|---|---|
| Color Development | 38 | 1 min 40 sec |
| Bleach-Fix | 30–34 | 1 min 00 sec |
| Rinse (1) | 30–34 | 20 sec |
| Rinse (2) | 30–34 | 20 sec |
| Rinse (3) | 30–34 | 20 sec |

-continued

| Process | Temperature (°C.) | Time |
|---|---|---|
| Drying | 70–80 | 50 sec |

(Tank counter flow from rinse (3) to rinse (1))

The compositions of the processing baths were as follows:

| | |
|---|---|
| Color Developer: | |
| Water | 800 cc |
| Diethylenetriaminepentaacetic Acid | 1.0 g |
| 1-Hydroxyethylene-1,1-disulfonic Acid (60 wt %) | 2.0 g |
| Nitrilotriacetic Acid | 2.0 g |
| Benzyl Alcohol | 16.0 cc |
| Diethylene Glycol | 10.0 cc |
| Sodium Sulfite | 2.0 g |
| Potassium Bromide | 0.5 g |
| Potassium Carbonate | 30.0 g |
| N—Ethyl-N—(βmethanesulfonamidoethyl)-3-methyl-4-aminoaniline Sulfate | 5.5 g |
| Hydroxylamine Sulfate | 3.0 g |
| Fluorescent Whitener (Whitex 4B, made by Sumitomo Chemicals) | 1.5 g |
| Water to make | 1,000 cc |
| pH (25° C.) | 10.25 |
| Bleach-Fix Bath: | |
| Water | 400 cc |
| Ammonium Thiosulfate (70 wt %) | 200 cc |
| Sodium Sulfite | 20.0 g |
| Ethylenediaminetetraacetic Acid Iron (III) Complex Ammonium Salt | 60.0 g |
| Ethylenediaminetetraacetic Acid Disodium Salt | 10.0 g |
| Water to make | 1,000 |
| pH (25° C.) | 6.70 |
| Rinse Bath: | |
| Benzotriazole | 1.0 g |
| Ethylenediamine-N,N,N',N'—tetramethylene-phosphonic Acid | 0.3 g |
| Water to make | 1,000 cc |
| pH (25° C.) | 7.5 |

EXAMPLE 4

Samples 101 to 106 used in Example 1 were processed in the way indicated below and the results obtained on carrying out the same tests as used in Example 1 are shown in Table 4.

| Process | Temperature (°C.) | Time |
|---|---|---|
| Color Development | 38 | 1 min 40 sec |
| Bleach-Fix | 30–34 | 1 min 00 sec |
| Rinse (1) | 30–34 | 20 sec |
| Rinse (2) | 30–34 | 20 sec |
| Rinse (3) | 30–34 | 20 sec |
| Drying | 70–80 | 50 sec |

(Tank counter flow system from rinse (3) to rinse (1))

The compositions of the processing baths were as follows.

| | |
|---|---|
| Color Developer: | |
| Water | 800 cc |
| Diethylenetriaminepentaacetic Acid | 1.0 |
| 1-Hydroxyethylidene-1,1-disulfonic Acid (60 wt %) | 2.0 g |
| Nitrilotriacetic Acid | 2.0 g |
| 1,4-Diazabicyclo[2,2,2]octane | 7.5 g |
| Potassium Bromide | 0.5 g |
| Potassium Carbonate | 30.0 g |

-continued

| | |
|---|---|
| N—Ethyl-N—(β-methanesulfonamidoethyl)-3-methyl-4-aminoaniline Sulfate | 5.5 g |
| Hydroxylamine Sulfate | 4.0 g |
| Fluorescent Whitener (UVITEX-CK, made by Ciba-Geigy) | 1.5 g |
| Water to make | 1,000 cc |
| pH (25° C.) | 10.25 |
| Bleach-Fix Bath: | |
| Water | 400 cc |
| Ammonium Thiosulfate (70 wt %) | 200 cc |
| Sodium Sulfite | 20.0 g |
| Ethylenediaminetetraacetic Acid Iron(III) Complex Ammonium Salt | 60.0 g |
| Ethylenediaminetetraacetic Acid Disodium Salt | 10.0 g |
| Water to make | 1,000 |
| pH (25° C.) | 7.0 |
| Rinse Bath: | |
| Ion exchanged water (calcium and magnesium both less than 3 ppm) | |

With this processing system Sample 101 of this invention had better all-round sensitivity, storage stability of the coated material and colored image fastness than Samples 102 to 106 which were outside the scope of the invention, well indicating the usefulness of the constructions of this invention.

TABLE 4

| Sample | Layer | Relative Sensitivity IAC* | Relative Sensitivity 21 Days at 35° C., 80% R.H. | Color Image Fastness 6 Days at 100° C. (%) | Color Image Fastness 10 Days at 89° C., 72% R.H. (%) | Color Image Fastness 6 Days Xenon Lamp (%) |
|---|---|---|---|---|---|---|
| | R | 91 | 93 | 33 | 21 | 15 |
| 101 | G | 98 | 93 | 2 | 3 | 10 |
| | B | 91 | 81 | −2 | −2 | 8 |
| | R | 100 | 83 | 70 | 46 | 30 |
| 102 | G | 100 | 83 | 4 | 5 | 20 |
| | B | 100 | 78 | −2 | −2 | 18 |
| | R | 83 | 81 | 36 | 24 | 47 |
| 103 | G | 81 | 83 | 3 | 4 | 12 |
| | B | 78 | 76 | −3 | −2 | 12 |
| | R | 69 | 74 | 32 | 20 | 16 |
| 104 | G | 95 | 74 | 2 | 3 | 10 |
| | B | 78 | 78 | −3 | −2 | 9 |
| | R | 100 | 71 | 68 | 49 | 33 |
| 105 | G | 100 | 81 | 4 | 5 | 21 |
| | B | 100 | 74 | −2 | −2 | 22 |
| | R | 81 | 72 | 40 | 21 | 46 |
| 106 | G | 81 | 76 | 3 | 3 | 11 |
| | B | 79 | 69 | −2 | −2 | 13 |

*IAC: Immediately after coating

EXAMPLE 5

Samples 101 to 106 used in Example 1 were processed in the way indicated below and similar results were obtained on carrying out the same tests as used in Example 1.

| Process | Temperature (°C.) | Time |
|---|---|---|
| Color Development | 33 | 3 min 30 sec |
| Bleach-Fix | 33 | 1 min 30 sec |
| Wash | 24–34 | 3 min 30 sec |
| Drying | 70–80 | 1 min |

The compositions of the processing baths were as follows:

| | |
|---|---|
| Color Developer: | |
| Water | 800 cc |
| 1-Hydroxyethylidene-1,1-disulfonie Acid (60 wt %) | 2.0 g |
| Triethanolamine | 11.0 cc |
| Benzyl Alcohol | 15.0 cc |
| Diethylene Glycol | 0.2 cc |
| Potassium Sulfite | 1.8 g |
| Potassium Bromide | 0.6 g |
| Potassium Carbonate | 28.0 g |
| N—Ethyl-N—(β-methanesulfonamidoethyl)-3-methyl-4-aminoaniline Sulfate | 4.5 g |
| Hydroxylamine Sulfate | 3.0 g |
| Fluorescent Whitener (4,4'-diaminostilbene) | 0.5 g |
| Lithium Chloride | 2.0 g |
| Water to make | 1,000 cc |
| pH (25° C.) | 10.10 |
| Bleach-Fix Bath: | |
| Water | 400 cc |
| Ammonium Thiosulfate (70 wt %) | 120 cc |
| Sodium Sulfite | 18.0 g |
| Ethylenediaminetetraacetic Acid Iron(III) Complex Ammonium Salt | 60.0 g |
| Ethylenediaminetetraacetic Acid Disodium Salt | 5.0 g |
| Water to make | 1,000 |
| pH (25° C.) | 6.70 |

EXAMPLE 6

The processing baths used in Examples 1 to 5 were used to prepare imitation running solutions in which 600 cc of each bleach-fix bath was mixed with 400 cc of each color developer, and these were used in place of the bleach-fix baths in each of the processes described above. Samples 101 to 106 used in Example 1 were processed in each case and tests were carried out in the same way as in Example 1. In all cases the results obtained showed that the sensitivities of Sample 101 of this invention were high and the storage properties and the colored image fastness were excellent as in each of the examples.

EXAMPLE 7

Samples in which the illustrative Compound (P-57) used in the emulsified dispersions for Samples 101 and 104 prepared in Example 1 was replaced with a compound of molecular weight 6,100 were prepared and these are referred to below as Samples 107 and 108. Samples 109 and 110 were similarly prepared by substituting a compound of molecular weight 290,000. These samples were tested in the same way as in Example 1, and the results obtained are shown in Table 5. Here, for Samples 107 and 109, the relative stabilities immediately after coating were obtained by taking the sensitivities of Sample 101 to be 100 and for Samples 108 and 110 the relative values were obtained by taking the sensitivities for Sample 104 to be 100.

In Table 5, Samples 101, 107 and 109 are samples of this invention and Samples 104, 108 and 110 are outside the scope of the invention. Upon comparison, including the results shown in Table 3 obtained in Example 1, although the effect was slightly less pronounced when the molecular weight was low, only the samples of this invention provided excellent sensitivity, storage properties and colored image fastness at the same time.

TABLE 5

| Sample | Layer | Relative Sensitivity IAC* | Relative Sensitivity 21 Days at 35° C., 80% R.H. | Color Image Fastness 6 at Days 100° C. (%) | Color Image Fastness 10 Days at 89° C., 72% R.H. (%) | Color Image Fastness 6 Days Xenon Lamp (%) |
|---|---|---|---|---|---|---|
| | R | 100 | 95 | 27 | 19 | 14 |
| 101 | G | 100 | 93 | 3 | 1 | 11 |
| | B | 100 | 93 | −1 | −3 | 7 |
| | R | 95 | 93 | 35 | 22 | 17 |
| 107 | G | 98 | 91 | 3 | 2 | 12 |
| | B | 93 | 93 | −3 | −2 | 10 |
| | R | 102 | 95 | 27 | 15 | 12 |
| 109 | G | 99 | 93 | 2 | 3 | 10 |
| | B | 100 | 93 | −3 | −2 | 8 |
| | R | 100 | 76 | 28 | 16 | 14 |
| 104 | G | 100 | 80 | 2 | 2 | 9 |
| | B | 100 | 77 | 0 | −1 | 7 |
| | R | 98 | 74 | 36 | 24 | 18 |
| 108 | G | 100 | 77 | 1 | 2 | 14 |
| | B | 98 | 77 | −1 | 0 | 10 |
| | R | 100 | 76 | 27 | 16 | 13 |
| 110 | G | 102 | 78 | 0 | 3 | 11 |
| | B | 99 | 78 | 0 | −2 | 8 |

*IAC: Immediately after coating

EXAMPLE 8

Samples in which the illustrative Compound (P-57) used in the emulsified dispersions for Samples 101 and 104 prepared in Example 1 was replaced with illustrative Compound (P-56) of molecular weight 70,000, illustrative Compound (P-59) of molecular weight 95,000 and illustrative Compound (P-65) of molecular weight 155,000, and these are referred to below as Samples 111 and 112, Samples 113 and 114 and Samples 115 and 116, respectively. These samples and Samples 102 and 105 were processed and tested in the same way as in Example 2 and the results obtained are shown in Table 6. Here, for Samples 111, 113 and 115, the relative stabilities immediately after coating were obtained by taking the sensitivities of Sample 102 to be 100. For Samples 112, 114 and 116, the relative values were obtained by taking the sensitivities for Sample 105 to be 100.

Samples 111, 113 and 115 are samples of this invention, and Samples 102, 105, 112, 114 and 116 are outside the scope of the invention. Only the samples of this invention provided excellent sensitivity, storage properties and colored image fastness at the same time.

TABLE 6

| Sample | Layer | Relative Sensitivity IAC* | Relative Sensitivity 21 Days at 35° C., 80% R.H. | Color Image Fastness 6 at Days 100° C. (%) | Color Image Fastness 10 Days at 89° C., 72% R.H. (%) | Color Image Fastness 6 Days Xenon Lamp (%) |
|---|---|---|---|---|---|---|
| | R | 95 | 93 | 27 | 17 | 15 |
| 111 | G | 98 | 92 | 3 | 2 | 11 |
| | G | 95 | 91 | −3 | 0 | 9 |
| | R | 95 | 93 | 30 | 18 | 12 |
| 113 | G | 98 | 91 | 4 | 2 | 11 |
| | B | 95 | 95 | −3 | 0 | 11 |
| | R | 91 | 93 | 31 | 19 | 15 |
| 115 | G | 98 | 95 | 2 | 3 | 12 |
| | B | 95 | 95 | −1 | 1 | 10 |
| | R | 100 | 85 | 57 | 41 | 29 |
| 102 | G | 100 | 81 | 5 | 7 | 19 |
| | B | 100 | 76 | −3 | −3 | 18 |
| | R | 74 | 74 | 26 | 18 | 16 |
| 112 | G | 93 | 78 | 2 | 2 | 12 |
| | B | 79 | 76 | −2 | −2 | 8 |
| | R | 76 | 79 | 30 | 17 | 13 |
| 114 | G | 95 | 78 | −2 | 1 | 11 |
| | B | 78 | 78 | −2 | −1 | 12 |
| | R | 71 | 81 | 33 | 20 | 16 |

TABLE 6-continued

| Sample | Layer | Relative Sensitivity IAC* | Relative Sensitivity 21 Days at 35° C., 80% R.H. | Color Image Fastness 6 at Days 100° C. (%) | Color Image Fastness 10 Days at 89° C., 72% R.H. (%) | Color Image Fastness 6 Days Xenon Lamp (%) |
|---|---|---|---|---|---|---|
| 116 | G | 95 | 83 | 2 | 2 | 14 |
| | B | 78 | 79 | −2 | −1 | 10 |
| | R | 100 | 71 | 59 | 41 | 31 |
| 105 | G | 100 | 79 | 5 | 6 | 18 |
| | B | 100 | 76 | −2 | −2 | 19 |

*IAC: Immediately after coating

EXAMPLE 9

Samples were prepared by replacing illustrative Compound (C-1), used in the emulsified dispersions in Samples 101, 102, 104 and 105 prepared in Example 1, with equimolar amounts of illustrative Compounds (C-3), (C-12) and (C-37) to provide Samples 117 to 120, 121 to 124 and 125 to 128, respectively. Furthermore, samples were prepared by replacing the illustrative Compound (M-15) with equimolar amounts of the illustrative Compounds (M-12) and (M-16) in order to provide Samples 129 to 132 and 133 to 136, respectively. Moreover, Samples 137 to 140 were prepared by replacing illustrative Compound (Y-1) with an equimolar amount of illustrative Compound (Y-2). These samples were processed and tested in the same way as in Example 2, and the results obtained are shown in Table 7.

The results for the unmodified photosensitive layers for each sample were the same as the results in the examples described earlier. Accordingly, only the results obtained with the modified photosensitive layers are shown here.

The sensitivities immediately after coating with the samples obtained by modifying Sample 101 were obtained by taking the sensitivities of the samples obtained by modifying Sample 102 to be 100. For the samples obtained by modifying Sample 104 the sensitivities were obtained by taking the sensitivities of the samples obtained by modifying Sample 105 to be 100.

Samples 117, 121, 125, 129, 133 and 137 are samples of this invention, and the other samples are outside the scope of the invention.

Only the samples of this invention had excellent sensitivities, storage properties after coating and colored image fastness, all at the same time.

Samples 117 to 140 were processed and tested in the same ways as in Examples 2 and 3, and the results obtained were approximately the same as those obtained with the process of Example 1 shown in Table 7.

These samples were also processed and tested in the way indicated in Example 4 and the results obtained were much the same as those shown in Table 7, except that there was more fading, as is the case when the results shown in Table 4 are compared with those shown in Table 3.

On the basis of these facts, it is clear that the samples which satisfied the conditions of this invention provided the best levels of performance.

TABLE 7

| Sample | Layer | Relative Sensitivity IAC* | Relative Sensitivity 21 Days at 35° C., 80% R.H. | Color Image Fastness 6 Days at 100° C. (%) | Color Image Fastness 10 Days at 89° C., 72% R.H. (%) | Color Image Fastness 6 Days Xenon Lamp (%) |
|---|---|---|---|---|---|---|
| 117 | R | 91 | 93 | 12 | 7 | 15 |
| 118 | R | 100 | 85 | 27 | 18 | 30 |
| 119 | R | 66 | 74 | 13 | 8 | 16 |
| 120 | R | 100 | 72 | 27 | 18 | 32 |
| 121 | R | 95 | 95 | 13 | 9 | 17 |
| 122 | R | 100 | 83 | 30 | 20 | 28 |
| 123 | R | 69 | 72 | 14 | 9 | 15 |
| 124 | R | 100 | 71 | 32 | 22 | 27 |
| 125 | R | 93 | 95 | 14 | 9 | 16 |
| 126 | R | 100 | 85 | 28 | 19 | 28 |
| 127 | R | 67 | 74 | 13 | 8 | 15 |
| 128 | R | 100 | 76 | 28 | 19 | 30 |
| 129 | G | 98 | 95 | 2 | 3 | 9 |
| 130 | G | 100 | 79 | 7 | 8 | 19 |
| 131 | G | 91 | 76 | 3 | 3 | 8 |
| 132 | G | 100 | 74 | 8 | 9 | 18 |
| 133 | G | 95 | 98 | 2 | 4 | 11 |
| 134 | G | 100 | 81 | 6 | 7 | 21 |
| 135 | G | 89 | 72 | 3 | 5 | 10 |
| 136 | G | 100 | 71 | 7 | 9 | 23 |
| 137 | B | 95 | 91 | −2 | −1 | 8 |
| 138 | B | 100 | 91 | −3 | −1 | 18 |
| 139 | B | 81 | 79 | −3 | −2 | 8 |
| 140 | B | 100 | 76 | −2 | −2 | 19 |

*IAC: Immediately after coating

EXAMPLE 10

A red-sensitive layer emulsion was prepared in the following way.

Lime-treated gelatin (30 g) was added to 1,000 cc of distilled water and dissolved at 40° C., after which the pH was adjusted to 6.0 with sulfuric acid, 6.5 g of sodium chloride and 0.02 g of N,N'-dimethylethylenethiourea were added and the temperature was raised to 67.5° C. A solution obtained by dissolving 62.5 g of silver nitrate in 750 cc of distilled water and a solution obtained by dissolving 26.3 g of potassium bromide and 8.6 g of sodium chloride in 500 cc of distilled water were added to and mixed with the aforementioned solution over a period of 40 minutes, while maintaining a temperature of 67.5° C. In addition, a solution obtained by dissolving 62.5 g of silver nitrate in 500 cc of distilled water and a solution obtained by dissolving 17.5 g of potassium bromide and 12.9 g of sodium chloride in 300 cc of distilled water ere added to and mixed with this emulsion over a period of 20 minutes at a temperature of 62.5° C. On observing the emulsion so obtained under an electron microscope, it was found that cubic grains which had an average side length of about 0.46 μm had been formed. On measuring the grain size distribution of this emulsion, it was found to be a monodispersed emulsion with a degree of monodispersion of 91%. The emulsion was washed, desalted, and then chemically sensitized optimally using triethylthiourea in the presence of nucleic acid degradation products. The resulting emulsion is referred to below as Emulsion (J).

Moreover, a similar emulsion which had been subjected to optimum sulfur sensitization and which had a degree of monodispersion of about 92% consisting of cubic grains with an average side length of 0.33 μm was prepared by changing the reaction temperature for grain formation. This emulsion is referred to below as Emulsion (K).

Potassium bromide (0.5 mol %/molAg) and illustrative Compounds (II−1)($2\times10^{-3}$ mol/molAg), (V−1)($4\times10^{-5}$ mol/molAg), (F−7)($1\times10^{-3}$ mol/molAg) and (II−1)($2\times10^{-4}$ mol/molAg) were added after the completion of chemical ripening and used in Emulsions (J) and (K).

A green-sensitive layer emulsion was prepared in the following way.

Lime-treated gelatin (30 g) was added to 1,000 cc of distilled water and dissolved at 40° C., after which the pH was adjusted to 4.2 with sulfuric acid, 6.5 g of sodium chloride and 0.02 g of N,N'-dimethylethylenethiourea were added and the temperature was raised to 73° C. A solution obtained by dissolving 62.5 g of silver nitrate in 750 cc of distilled water and a solution obtained by dissolving 36.1 g of potassium bromide and 3.8 g of sodium chloride in 500 cc of distilled water were added to and mixed with the aforementioned solution over a period of 40 minutes while maintaining a temperature of 73° C. In addition, a solution obtained by dissolving 62.5 g of silver nitrate in 500 cc of distilled water and a solution obtained by dissolving 25.2 g of potassium bromide and 9.1 g of sodium chloride in 300 cc of distilled water were added to and mixed with this emulsion over a period of 20 minutes at a temperature of 67° C. On observing the emulsion so obtained under an electron microscope, it was found that cubic grains having an average side length of about 0.45 μm had been formed. On measuring the grain size distribution of this emulsion, it was found to be a monodispersed emulsion with a degree of monodispersion of about 89%. The emulsion was washed, desalted and then chemically sensitized optimally using triethylthiourea in the presence of nucleic acid degradation products. The resulting emulsion is referred to below as Emulsion (L).

Moreover, a similar emulsion which had been subjected to optimum sulfur sensitization and which had a degree of monodispersion of 93% consisting of cubic grains with an average side length of 0.33 μm was prepared by changing the reaction temperature for grain formation. This emulsion is referred to below as Emulsion (M).

The illustrative Compounds (III−1)($2\times10^{-3}$ mol/molAg), (V−26)($6\times10^{-5}$ mol/molAg), (V−41)($4\times10^{-4}$ mol/molAg), (I−2) ($6\times10^{-4}$ mol/molAg) and (III−11)($8\times10^{-4}$ mol/molAg) were added to and used in Emulsions (L) and (M).

A blue-sensitive layer emulsion was prepared in the following way.

Lime-treated gelatin (30 g) was added to 700 cc of distilled water and dissolved at 40° C., after which the pH was adjusted to 5.2 with sulfuric acid, 8.5 g of sodium chloride and 0.03 g of N,N'-dimethylethylenethiourea were added and the temperature was raised to 73° C. A solution obtained by dissolving 31.25 g of silver nitrate in 750 cc of distilled water and a solution obtained by dissolving 18.6 g of potassium bromide and 1.6 g of sodium chloride in 500 cc of distilled water were added to and mixed with the aforementioned solution over a period of 40 minutes while maintaining a temperature of 73° C. In addition, a solution obtained by dissolving 93.75 g of silver nitrate in 500 cc of distilled water and a solution obtained by dissolving 42.7 g of potassium bromide and 11.3 g of sodium chloride in 300 cc of distilled water were added to and mixed with this emulsion over a period of 20 minutes at a temperature of 69° C. On observing the emulsion so obtained under an electron microscope, it was found that cubic grains having an average side length of about 0.82 μm had been formed. On measuring the grain size distribution of this emulsion, it was found to be a monodispersed emulsion with a degree of monodispersion of about 92%. The emulsion was washed, desalted and then chemically sensitized optimally using triethylthiourea in the presence of nucleic acid degradation products. The resulting emulsion is referred to below as Emulsion (N).

Moreover, a similar emulsion which had been subjected to optimum sulfur sensitization and which had a degree of monodispersion of 90% consisting of cubic grains with an average side length of 0.53 μm was prepared by changing the reaction temperature for grain formation. This emulsion is referred to below as Emulsion (O). The illustrative Compounds (III−1)($3\times10^{-3}$ mol/molAg), (V−36)($5\times10^{-4}$mol/molAg) and (I=2)($4\times10^{-5}$ mol/molAg) were added after the completion of chemical ripening and used in Emulsions (N) and (O).

An emulsion for comparative purposes was prepared in the following way.

Lime-treated gelatin (30 g) was added to 1,000 cc of distilled water and dissolved at 40° C., after which the pH was adjusted to 4.2 with sulfuric acid, 6.5 g of sodium chloride was added and the temperature was raised to 62.5° C. A solution obtained by dissolving 62.5 g of silver nitrate in 750 cc of distilled water and a solution obtained by dissolving 17.5 g of potassium bromide and 12.9 g of sodium chloride in 500 cc of distilled water were added to and mixed with the aforementioned solution over a period of 40 minutes while maintaining a temperature of 62.5° C. In addition, a solution obtained by dissolving 62.5 g of silver nitrate in 500 cc of distilled water and a solution obtained by dissolving 17.5 g of potassium bromide and 12.9 g of sodium chloride in 300 cc of distilled water were added to and mixed with this emulsion over a period of 20 minutes and then 88 cc of a 10% aqueous solution of potassium bromide was added and halogen replacement was carried out. On observing the emulsion so obtained under an electron microscope, it was found that somewhat broken down spherical grains of which the average diameter calculated as the corresponding sphere was about 0.47 μm had been formed and the degree of monodispersion was about 84%. The emulsion was washed, desalted, and then chemically sensitized optimally using triethylthiourea in the presence of nucleic acid degradation products. The resulting emulsion is referred to below as Emulsion (P).

The illustrative Compounds (III−1)($2\times10^{-3}$mol/molAg), (V−1)($4\times10^{-5}$mol/molAg), (F−7)($1\times10^{-3}$mol/molAg) and (II−1) ($2\times10^{-4}$mol/molAg) were used in Emulsion (P).

Broken down spherical emulsions of average grain size 0 45 μm and a degree of monodispersion of with a silver bromide content of 70 mol % an 10 mol % halogen exchange was prepared in the same way, and sulfur sensitized optimally using triethylthiourea in the presence of nucleic acid degradation products, and this is referred to below as Emulsion (Q).

Illustrative Compounds (III−1)($2\times10^{-4}$ mol/mol), (V−1)($4\times10^{-5}$ mol/molAg), (V−41) ($4\times10^{-4}$ mol/molAg) and (I−2) ($6\times10^{-4}$ mol/molAg) were used in Emulsion (Q).

Moreover, an emulsion consisting of spherical grains of which the average grain size of the corresponding sphere was 0.83 μm and which had a degree of monodispersion of 83% with a silver bromide content of 70 mol % and 8 mol % halogen exchange was prepared similarly and sulfur sensitized optimally in the same way. This is referred to below as Emulsion (R).

Illustrative Compounds (III−1)($3\times10^{-3}$ mol/molAg), (V−36)($5\times10^{-4}$ mol/molAg) and (I−2)($4\times10^{-5}$ mol/molAg) were used in Emulsion (R).

$K_2IrCl_6$ was added at rates of $2\times10^{-8}$ to $8\times10^{-7}$ mol/mol Ag during the formation of grains when forming Emulsions (A) to (R).

A red-sensitive layer emulsified dispersion was prepared in the following way.

Illustrative Compound (P-57) of this invention of average molecular weight of about 115,000 (5.5 g), 5.1 g of illustrative Compound (C-1), 6.3 g of (C-14), 1 g of illustrative Compound (X-9), 1.8 g of (X-10), 2.1 g of (X-12), 2.0 g of illustrative Compound (S-25), 4.4 g of (S-13), and 0.4 g of Compound (a) were mixed with 15 cc of ethyl acetate and a solution was formed at 50° C. This solution was added to 190 cc of aqueous gelatin solution which had been mixed with cc of 10% sodium dodecylbenzenesulfonate and the mixture was emulsified and dispersed using a homogenizer. This is referred to as Emulsified Dispersion (x) below.

A green-sensitive layer emulsified dispersion was prepared in the following way.

Illustrative Compound (P-57) of this invention of average molecular weight of about 95,000 (10 g), 13 g of illustrative Compound (M-4), 1.2 g of illustrative Compound (A-1), 1.5 g of (B-1), 13 g of illustrative Compound (S-7), 6.5 g of (S-16), and 4.4 g of Compound (b) were mixed with 40 cc of ethyl acetate and a solution was formed at 50° C. This solution was added to 210 cc of 10% aqueous gelatin solution which had been mixed with 13 cc of 10% sodium dodecylbenzenesulfonate and the mixture was dispersed using a homogenizer. This is referred to as Emulsified Dispersion (xi) below.

A blue-sensitive layer emulsified dispersion was prepared in the following way.

Illustrative Compound (P-57) of this invention of average molecular weight of about 95,000 (19 g), 19 g of illustrative Compound (Y-2), 7.6 g of illustrative Compound (S-13), and 4.3 g of Compound (c) were mixed with 27 cc of ethyl acetate and a solution was formed at 50° C. This solution was added to 180 cc of 10% aqueous gelatin solution which had been mixed with 8 cc of 10% sodium dodecylbenzenesulfonate, and the mixture was dispersed using a homogenizer. This is referred to as Emulsified Dispersion (xii) below.

Furthermore, emulsified dispersion for comparative purposes were prepared by excluding the illustrative Compound (P-57) from aforementioned Emulsified Dispersions (x), (xi) and (xii). These are referred to below as Emulsified Dispersions (xiii), (xiv) and (xv), respectively.

Coated Samples 141 to 144 were prepared as shown in Table 8, by combining Emulsions (J) to (R) with Emulsified Dispersions (x) to (xv). Samples 142 to 144 in Table 8 are such that the emulsions and emulsified dispersions for the sample shown in Table 9 are substituted with equimolar silver or coupler contents.

The illustrative Compounds (D-2) and (D-4) and Compound (e) were used in these samples.

TABLE 8

| | Sample | | | |
|---|---|---|---|---|
| | 141 | 142 | 143 | 144 |
| Red-sensitive layer emulsion | J + K | J + K | P | P |

TABLE 8-continued

| | Sample | | | |
|---|---|---|---|---|
| | 141 | 142 | 143 | 144 |
| Red-sensitive layer emulsified dispersion | (x) | (xiii) | (x) | (xiii) |
| Green-sensitive layer emulsion | L + M | L + M | Q | Q |
| Green-sensitive layer emulsified Dispersion | (xi) | (xiv) | (xi) | (xiv) |
| Blue-sensitive layer emulsion | N + O | N + O | R | R |
| Blue-sensitive layer emulsified dispersion | (vi) | (ix) | (iii) | (vi) |

The mixing ratios of the emulsions of Samples 141 and 142 were the same.

TABLE 9

| | Use Rate* ($g/m^2$) |
|---|---|
| Seventh Layer: Protective Layer | |
| Gelatin | 1.30 |
| Acrylic modified polymer of polyvinyl alcohol (17% modification) | 0.15 |
| Liquid paraffin | 0.05 |
| Sixth Layer: Ultraviolet Absorbing Layer | |
| Gelatin | 0.65 |
| Ultraviolet Absorber (X-9) | 0.02 |
| Ultraviolet Absorber (X-10) | 0.09 |
| Ultraviolet Absorber (X-16) | 0.10 |
| Anti-Color Firming Agent (d) | 0.02 |
| Solvent (S-66) | 0.11 |
| Fifth Layer: Red-Sensitive Layer | |
| Emulsion (J) | 0.08 |
| Emulsion (K) | 0.16 |
| Gelatin | 1.76 |
| Polymer (P-57) | 0.19 |
| Cyan Coupler (C-1) | 0.18 |
| Cyan Coupler (C-14) | 0.22 |
| Colored Image Stabilizer (X-9) | 0.04 |
| Colored Image Stabilizer (X-10) | 0.06 |
| Colored Image Stabilizer (X-12) | 0.07 |
| Color Image Regulating Agent (a) | 0.01 |
| Solvent (S-25) | 0.07 |
| Solvent (S-13) | 0.16 |
| Fourth Layer: Ultraviolet Absorbing Layer | |
| Gelatin | 1.60 |
| Ultraviolet Absorber (X-9) | 0.06 |
| Ultraviolet Absorber (X-10) | 0.27 |
| Ultraviolet Absorber (X-16) | 0.29 |
| Anti-Color Mixing Agent (d) | 0.05 |
| Solvent (S-66) | 0.26 |
| Third Layer: Green-Sensitive Layer | |
| Emulsion (L) | 0.05 |
| Emulsion (M) | 0.11 |
| Gelatin | 2.20 |
| Polymer (P-57) | 0.45 |
| Magenta Coupler (M-4) | 0.59 |
| Colored Image Stabilizer (A-1) | 0.05 |
| Colored Image Stabilizer (B-1) | 0.07 |
| Colored Image Stabilizer (b) | 0.20 |
| Solvent (S-7) | 0.59 |
| Solvent (S-16) | 0.29 |
| Second Layer: Anti-Color Mixing Layer | |
| Gelatin | 0.99 |
| Anti-Color Mixing Agent (d) | 0.09 |
| Solvent (S-25) | 0.08 |
| First Layer: Blue-Sensitive Layer | |
| Emulsion (N) | 0.08 |
| Emulsion (O) | 0.19 |
| Gelatin | 2.68 |
| Polymer (P-57) | 0.88 |
| Yellow Coupler (Y-2) | 0.88 |
| Colored Image Stabilizer (c) | 0.20 |
| Solvent (S-13) | 0.35 |
| Support; | |

TABLE 9-continued

| | Use Rate* ($g/m^2$) |
|---|---|
| Polyethylene laminated paper (with $TiO_2$ and ultramarine in the polyethylene laminated on the first layer side) | |

*The coating rates for emulsions are calculated as silver
In the sixth layer (X-9) and (X-10) act as an ultraviolet absorber, while in the fifth layer they act as a colored image stabilizer.

Samples 141 to 144 were processed and tested in the same way as in Example 2 and the results obtained are shown in Table 10.

In this example, Sample 141 of this invention had improved storage properties after coating while maintaining about the same level of sensitivity when compared to Comparative Sample 142. Also, there was a marked improvement in both dark fastness and light fastness. Comparative Sample 143 had a similar colored image fastness to Sample 141 of this invention, but the reduction in the emulsion sensitivities was larger than that in the case of Sample 144, and moreover, there was a considerable reduction in the sensitivities on storage after coating. With Comparative Sample 144, both the storage properties after coating and the colored image fastness were worse than those of Sample 141 of this invention.

This can be taken to mean that Sample 141 which has the structure of this invention is excellent. Samples in which the red-sensitive, green-sensitive and blue-sensitive layers of Samples 141 to 144 were alternately replaced were prepared, and similar tests were carried out. The results showed that there was virtually no effect on the other layers which gave similar results to the respective layers in Table 10.

TABLE 10

| | | Relative Sensitivity | | Color Image Fastness | | |
|---|---|---|---|---|---|---|
| Sample | Layer | IAC* | 21 Days at 35° C., 80% R.H. | 6 Days at 100° C. (%) | 10 Days at 89° C., 72% R.H. (%) | 6 Days Xenon Lamp (%) |
| 141 | R | 91 | 93 | 15 | 8 | 17 |
| | G | 97 | 95 | 4 | 5 | 13 |
| | B | 93 | 93 | −2 | −2 | 8 |
| 142 | R | 100 | 83 | 34 | 19 | 32 |
| | G | 100 | 83 | 8 | 9 | 22 |
| | B | 100 | 81 | −3 | −3 | 18 |
| 143 | R | 69 | 72 | 16 | 9 | 17 |
| | G | 91 | 78 | 5 | 5 | 15 |
| | B | 83 | 81 | −3 | −3 | 8 |
| 142 | R | 100 | 69 | 33 | 20 | 31 |
| | G | 100 | 78 | 9 | 10 | 24 |
| | B | 100 | 76 | −2 | −3 | 20 |

*IAC: Immediately after coating

EXAMPLE 11

Samples 141 to 144 prepared in Example 10 were processed and tested in the same way as in Example 4. The results showed that although the color image fastness was somewhat lower than in Example 10 the results were more or less the same as those shown in Table 10.

EXAMPLE 12

Green layer emulsified dispersions were prepared in the following way.

Illustrative Compound (P-57) of this invention of average molecular weight of about 95,000 (10 g), 10 g of illustrative Compound (M-1), 2 g of Compound (g)

which is shown below, 1 g of Compound (h), g of Compound (i), 3 g of Compound (j), 7.5 g of illustrative Compound (S-7) and 6 g of illustrative Compound (S-16) were mixed with 20 cc of ethyl acetate and a solution was formed at 50° C. This solution was added to 160 cc of 10% aqueous gelatin solution which had been mixed with 7 cc of 10% sodium dodecylbenzenesulfonate, and the mixture was emulsified and dispersed using a homogenizer. This is referred to as Emulsified Dispersion (xiii) below.

Emulsified Dispersion (xiv) was prepared by excluding the illustrative Compound (P-57) from the above-mentioned Emulsified Dispersion (xii).

Similarly, 10 g of illustrative Compound (P-57) of this invention of average molecular weight of about 95,000, 10 g of illustrative Compound (M-2), 2 g of Compound (k) which is shown below, 3 g of Compound (i), 5 g of Compound (l), 3 g of illustrative Compound (S-7) and 7 g of illustrative Compound (S-16) were mixed with 25 cc of ethyl acetate and a solution was formed at 50° C. This solution was added to 160 cc of 10% delimed gelatin solution which had been mixed with 7 cc of 10% sodium dodecylbenzenesulfonate, and the mixture was emulsified and dispersed using a homogenizer. This is referred to as Emulsified Dispersion (xv) below.

Emulsified Dispersion (xvi) was prepared by excluding the illustrative Compound (P-57) from the above-mentioned Emulsified Dispersion (xv).

Samples were prepared by replacing the emulsified dispersion in the green-sensitive layers of Samples 141 and 143 prepared in Example 10 with Emulsified Dispersions (xiii), (xiv), (xv) and (xvi). Thus, the samples in which the green layer emulsified dispersion of Samples 141 and 143 had been replaced by Emulsified Dispersion (xiii) became Samples 145 and 147, respectively, the samples in which it was replaced by Emulsified Dispersion (xiv) became Samples 146 and 148, respectively, those in which it was replaced by Emulsified Dispersion (xv) became Samples 149 and 151, respectively, and those in which it was replaced by Emulsified Dispersion (xvi) became Samples 150 and 152, respectively.

Samples 145 to 152 were processed and tested in the same way as in Example 2, and the results obtained are shown in Table 11. In this example, the unmodified red-sensitive and blue-sensitive layers gave the same results as shown in Example 10 and so only the results obtained for the green layer are shown here.

In this example, Samples 145 and 149 of this invention had excellent storage properties after coating and colored image fastness.

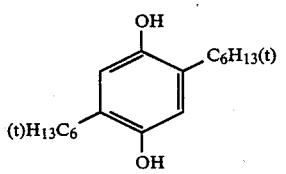

(g)

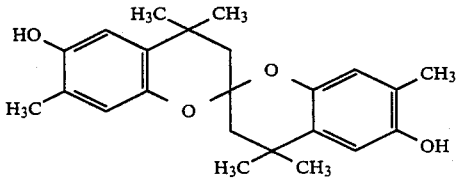

(h)

-continued

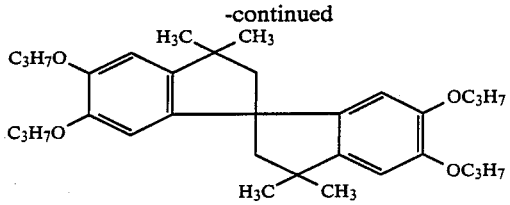

(i)

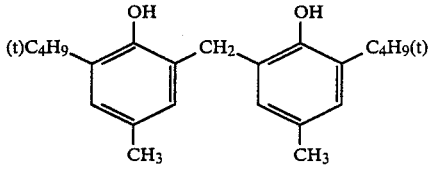

(j)

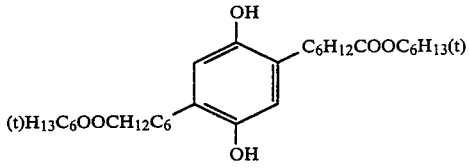

(k)

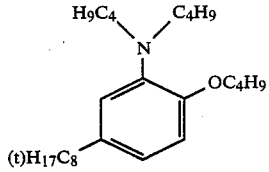

(l)

TABLE 11

| Sample | Layer | Relative Sensitivity: IAC* | Relative Sensitivity: 21 Days at 35° C., 80% R.H. | Color Image Fastness: 6 Days at 100° C. (%) | Color Image Fastness: 10 Days at 80° C., 72% R.H. (%) | Color Image Fastness: 6 Days Xenon Lamp (%) |
|---|---|---|---|---|---|---|
| 145 | G | 98 | 93 | 8 | 7 | 50 |
| 146 | G | 100 | 85 | 15 | 12 | 55 |
| 147 | G | 93 | 83 | 9 | 9 | 52 |
| 148 | G | 100 | 81 | 17 | 12 | 56 |
| 149 | G | 98 | 95 | 5 | 2 | 26 |
| 150 | G | 100 | 83 | 8 | 3 | 30 |
| 151 | G | 95 | 85 | 5 | 3 | 25 |
| 152 | G | 100 | 81 | 8 | 3 | 31 |

*IAC: Immediately after coating

As shown by the above comparative data, the silver halide color photographic materials having a high sensitivity and excellent storage properties after coating and color image fastness are obtained by this invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic photosensitive material comprising on a support, at least one silver halide photographic emulsion layer comprising an emulsified dispersion of fine lipophilic particles comprising at least one type of oil-soluble coupler which is nondiffusible and which forms a dye by coupling with the oxidized form of a primary aromatic amine color developing agent and at least one type of high boiling point organic solvent, said emulsified dispersion of fine lipophilic particles comprises a dispersion obtained by emulsifying and dispersing a mixed solution which comprises at least one type of coupler, and at least one type of high boiling point organic solvent as mentioned above, and at least one type of homopolymer or copolymer which is water-insoluble and soluble in organic solvent and which comprises at least one type of repeating unit which does not have acid groups on the main chain or on a side chain, and said silver halide emulsion comprises a monodispersed silver chloride, silver chlorobromide or silver bromide emulsion, containing essentially no silver iodide and of which the (100) plane has, in the main, been enclosed.

2. A silver halide color photographic photosensitive material as in claim 1, wherein said repeating unit of said polymer which does not have an acid group has a —CO— bond in its main chain or in a side chain.

3. A silver halide color photographic photosensitive material as in claim 2, wherein said repeating unit of said polymer which does not have an acid group has a —COO— group in the main chain or in a side chain.

4. A silver halide color photographic photosensitive material as in claim 2, wherein said repeating unit of said polymer which does not have an acid group has a

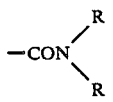

group (wherein R represents two substituent groups which may be the same or different, and each R represents a hydrogen atom, a substituted or unsubstituted alkyl group or an aryl group) in a side chain.

5. A silver halide color photographic photosensitive material as in claim 1, wherein at least one of said oil-soluble couplers is a phenol based cyan coupler.

6. A silver halide color photographic photosensitive material as in claim 1, wherein at least one of said oil-soluble couplers is a pyrazoloazole based coupler.

7. A silver halide color photographic photosensitive material in claim 1, wherein at least one of the said oil soluble couplers is a pivaloylacetanilide based yellow coupler.

8. A silver halide color photographic photosensitive material as in claim 1, wherein said silver halide emulsion is spectrally sensitized.

9. A silver halide color photographic photosensitive material as in claim 8, wherein the spectral sensitizing dye is selected from among the monomethine, trimethine or pentamethine cyanine dyes.

10. A silver halide color photographic photosensitive material as in claim 1, wherein the said silver halide emulsion has a grain size distribution of 0.20 or less in terms of the coefficient of variation $\sigma$-$\overline{\gamma}$ (where $\sigma$ is standard deviation and $\overline{\gamma}$ is mean grain diameter).

11. A silver halide color photographic photosensitive material as in claim 1; wherein the said silver halide emulsion has a grain size distribution of 0.15 or less in terms of the coefficient of variation $\sigma$-$\overline{\gamma}$.

12. A silver halide color photographic photosensitive material as in claim 1, wherein said silver halide emulsion layer contains at least two of said monodispersed silver halide emulsions.

13. A silver halide color photographic photosensitive material as in claim 1, wherein the said silver halide emulsion has a K value of 5 or more wherein K is the ratio of the intensity of diffracted ray attributable to (200) face to the intensity of diffracted ray attributable to (222) face which is measured according to the X-ray diffraction analytical method.

14. A silver halide color photographic photosensitive material as in claim 1, wherein the polymer is comprised of methacrylate based monomers, acrylamide based monomers and/or methacrylamide based monomers.

15. A silver halide color photographic photosensitive material as in claim 1, wherein the polymer has a molecular weight of less than 1,000,000 and greater than 2,000.

16. A silver halide color photographic photosensitive material as in claim 1, wherein the silver halide emulsion comprises less than 3 mol % of silver iodide.

17. A silver halide color photographic photosensitive material as in claim 1, comprising a high boiling point organic solvent having a boiling point of at least 140° C.

18. A silver halide color photographic photosensitive material as in claim 1, wherein the ratio of said high boiling point organic solvent and the coupler is from 0.05 to 20 by weight.

19. A silver halide color photographic photosensitive material as in claim 1, wherein the ratio of the high boiling point organic solvent and the polymer is from 0.02/1 to 100/1 by weight.

20. A silver halide color photographic photosensitive material as in claim 1, wherein the proportion of the coupler to the polymer is from 1.0/0.05 to 1.0/20 by weight.

21. A silver halide color photographic photosensitive material as in claim 1, comprising the couplers in the amount of from 0.005 to 4 mol/mol of silver halide.

22. A silver halide color photographic photosensitive material as in claim 1, wherein the couplers are coated onto the support in an amount of from $2\times10^{-5}$ mol/m$^2$ to $1\times10^{-2}$ mol/m$^2$.

23. A silver halide color photographic photosensitive material as in claim 1, wherein the average particle size of the fine lipophilic particles is greater than 0.03 $\mu$m and less than 2 $\mu$m.

24. A silver halide color photographic photosensitive material as in claim 9, wherein the amount of spectral sensitizing dye is from $1\times10^{-6}$ to $1\times10^{-2}$ mol/mol of silver halide.

25. A silver halide color photographic photosensitive material as in claim 1, wherein the copolymer is comprised of at least one type of repeating unit which does not have acid groups on the main chain or on a side chain and at least one type of repeating unit which has acid groups on the main chain or on a side chain.

* * * * *